US009557670B2

(12) United States Patent
Shiba et al.

(10) Patent No.: US 9,557,670 B2
(45) Date of Patent: Jan. 31, 2017

(54) TONER, DEVELOPER, AND COLOR TONER SET

(71) Applicants: Masana Shiba, Shizuoka (JP); Hiroshi Yamashita, Shizuoka (JP); Tsuyoshi Sugimoto, Shizuoka (JP); Daisuke Asahina, Shizuoka (JP); Yukari Fukuda, Kanagawa (JP); Rintaro Takahashi, Kanagawa (JP); Satoyuki Sekiguchi, Shizuoka (JP)

(72) Inventors: Masana Shiba, Shizuoka (JP); Hiroshi Yamashita, Shizuoka (JP); Tsuyoshi Sugimoto, Shizuoka (JP); Daisuke Asahina, Shizuoka (JP); Yukari Fukuda, Kanagawa (JP); Rintaro Takahashi, Kanagawa (JP); Satoyuki Sekiguchi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/382,619

(22) PCT Filed: Feb. 28, 2013

(86) PCT No.: PCT/JP2013/056223
§ 371 (c)(1),
(2) Date: Sep. 3, 2014

(87) PCT Pub. No.: WO2013/141029
PCT Pub. Date: Sep. 26, 2013

(65) Prior Publication Data

US 2015/0024312 A1 Jan. 22, 2015

(30) Foreign Application Priority Data

Mar. 22, 2012 (JP) ..... 2012-065422
Oct. 25, 2012 (JP) ..... 2012-235956

(51) Int. Cl.
*G03G 9/087* (2006.01)
*G03G 9/093* (2006.01)
*G03G 9/08* (2006.01)
*G03G 9/09* (2006.01)

(52) U.S. Cl.
CPC ..... *G03G 9/08755* (2013.01); *G03G 9/0821* (2013.01); *G03G 9/08797* (2013.01); *G03G 9/09* (2013.01); *G03G 9/09321* (2013.01); *G03G 9/09328* (2013.01); *G03G 9/09371* (2013.01)

(58) Field of Classification Search
CPC ..... G03G 9/09371; G03G 9/09321; G03G 9/08755; G03G 9/0821; G03G 9/08797
USPC ..... 430/107.1, 45.51, 109.4, 110.2
See application file for complete search history.

(56) References Cited

U.S. PATENT DOCUMENTS

| | | | | |
|---|---|---|---|---|
| 5,753,399 | A | 5/1998 | Hayase et al. | |
| 5,968,701 | A | 10/1999 | Onuma et al. | |
| 6,002,903 | A | 12/1999 | Hayase et al. | |
| 6,326,115 | B1 | 12/2001 | Nakanishi et al. | |
| 6,503,676 | B2 | 1/2003 | Yamashita et al. | |
| 6,824,945 | B2 | 11/2004 | Emoto et al. | |
| 7,074,541 | B2 | 7/2006 | Yamashita et al. | |
| 7,364,828 | B2 | 4/2008 | Yamashita et al. | |
| 8,062,819 | B2 * | 11/2011 | Yasukawa et al. | 430/108.21 |
| 8,932,789 | B2 * | 1/2015 | Sugimoto | G03G 9/0821 430/108.1 |
| 9,034,548 | B2 * | 5/2015 | Moritani et al. | 430/109.1 |
| 2003/0027066 | A1 | 2/2003 | Yamashita et al. | |
| 2003/0027074 | A1 | 2/2003 | Emoto et al. | |
| 2003/0055159 | A1 | 3/2003 | Yamashita et al. | |
| 2003/0096185 | A1 | 5/2003 | Yamashita et al. | |
| 2003/0113648 | A1 | 6/2003 | Tomita et al. | |
| 2003/0219670 | A1 | 11/2003 | Sawada et al. | |
| 2006/0045571 | A1 * | 3/2006 | Matsuura et al. | 399/149 |
| 2007/0184370 | A1 | 8/2007 | Yamashita et al. | |
| 2008/0069606 | A1 | 3/2008 | Yamashita et al. | |
| 2008/0261141 | A1 | 10/2008 | Yasukawa et al. | |
| 2009/0155711 | A1 | 6/2009 | Yamashita et al. | |
| 2009/0162780 | A1 | 6/2009 | Yamashita et al. | |
| 2009/0186290 | A1 | 7/2009 | Yoshizaki et al. | |
| 2010/0035170 | A1 | 2/2010 | Sugimoto et al. | |
| 2010/0075243 | A1 | 3/2010 | Shimota et al. | |
| 2010/0081075 | A1 | 4/2010 | Watanabe et al. | |
| 2010/0310980 | A1 | 12/2010 | Sugimoto et al. | |
| 2011/0045403 | A1 | 2/2011 | Yamashita et al. | |
| 2011/0086305 | A1 | 4/2011 | Watanabe et al. | |
| 2011/0129773 | A1 | 6/2011 | Shu et al. | |

(Continued)

FOREIGN PATENT DOCUMENTS

| | | |
|---|---|---|
| EP | 0 743 563 A2 | 11/1996 |
| EP | 0 926 565 A1 | 6/1999 |

(Continued)

OTHER PUBLICATIONS

Japanese Patent Office machine-assisted English-language translation of Japanese Patent 2004-198692 (pub. Jul. 2004).*

Extended European Search Report issued Mar. 2, 2015 in Patent Application No. 13763784.9.

International Search Report Issued in May 21, 2013 for counterpart International Patent Application No. PCT/JP2013/056223 filed Feb. 28, 2013.

Korean Office Action issued Feb. 25, 2016, in corresponding Korean Patent Application No. 10-2014-7029510 (with English-language Translation).

(Continued)

*Primary Examiner* — Janis L Dote
(74) *Attorney, Agent, or Firm* — Oblon, McClelland, Maier & Neustadt, L.L.P.

(57) ABSTRACT

A toner, including: a binder resin; and a colorant, wherein the toner has a storage modulus of $1.0\times10^7$ Pa or more at 50° C., a loss modulus of $8.0\times10^4$ Pa to $2.0\times10^5$ Pa at 80° C., and a loss modulus of $2.0\times10^2$ Pa to $1.0\times10^3$ Pa at 160° C.

11 Claims, No Drawings

(56) References Cited

U.S. PATENT DOCUMENTS

| | | | |
|---|---|---|---|
| 2011/0151372 | A1 | 6/2011 | Watanabe et al. |
| 2011/0223532 | A1 | 9/2011 | Sugimoto et al. |
| 2011/0318053 | A1 | 12/2011 | Yamashita et al. |
| 2012/0052431 | A1 | 3/2012 | Hozumi et al. |
| 2012/0052434 | A1 | 3/2012 | Sugimoto et al. |
| 2012/0122027 | A1 | 5/2012 | Watanabe et al. |
| 2012/0219896 | A1 | 8/2012 | Asahina et al. |
| 2012/0237869 | A1 | 9/2012 | Chiba et al. |
| 2012/0237870 | A1 | 9/2012 | Watanabe et al. |
| 2012/0264043 | A1 | 10/2012 | Watanabe et al. |

FOREIGN PATENT DOCUMENTS

| | | |
|---|---|---|
| JP | 03-163566 | 7/1991 |
| JP | 04-349474 | 12/1992 |
| JP | 2579150 | 11/1996 |
| JP | 11-133665 | 5/1999 |
| JP | 2001-158819 | 6/2001 |
| JP | 2002-131969 | 5/2002 |
| JP | 2002-287400 | 10/2002 |
| JP | 2002-351143 | 12/2002 |
| JP | 2004-046095 | 2/2004 |
| JP | 2004-151438 | 5/2004 |
| JP | 2004-198692 | 7/2004 |
| JP | 2005-221891 | 8/2005 |
| JP | 2006-301618 | 11/2006 |
| JP | 2007-271789 | 10/2007 |
| JP | 2008-281830 | 11/2008 |
| JP | 2009-109917 | 5/2009 |
| JP | 2010-072033 | 4/2010 |
| JP | 2010-072570 | 4/2010 |
| JP | 2010-107838 | 5/2010 |
| JP | 2011-047998 | 3/2011 |
| JP | 2011-185973 | 9/2011 |
| JP | 2013-054178 | 3/2013 |

OTHER PUBLICATIONS

Japanese Information Offer Form dated Nov. 16, 2015.In corresponding Japanese Patent Application No. 2012-235956 (with attached English Translation).

* cited by examiner

TONER, DEVELOPER, AND COLOR TONER SET

TECHNICAL FIELD

The present invention relates to a toner, a developer, and a color toner set.

BACKGROUND ART

What is recently required of toners is a reduction in particle diameter from the viewpoint of improving the quality of output images, high-temperature anti-offset property, low-temperature fixability for energy saving, and heat-resistant storage property high enough to withstand high temperature and high humidity during storage or transport after the production thereof. In particular, since power consumption in toner fixation occupies a major part of power consumption in an image formation process, an improvement in low-temperature fixability is very important.

Toners prepared by a kneading/grinding method have hitherto been used. The toners prepared by the kneading/grinding method, however, involve difficulties in reducing the particle diameter and have irregular shapes and a broad particle size distribution, posing problems such as unsatisfactory output image quality and high fixation energy. Further, when wax is added (releasing agent) for fixability improvement purposes, toners prepared by the kneading/grinding method, when ground, are broken at the interface of wax and, thus, a large amount of the wax is disadvantageously present on the surface of the toners. Accordingly, a release effect is attained, but on the other hand, deposition (filming) of the wax on a carrier, a photoconductor, and a blade is likely to occur. Thus, the toners prepared by the kneading/grinding method are disadvantageously unsatisfactory in the overall properties.

Therefore, in order to overcome the problems involved in the kneading/grinding method, a method for producing toners by a polymerization method has been proposed. In the polymerization method, toners having a reduced particle diameter can easily be produced, and the toners have a sharper particle size distribution than the toners produced by the grinding method. Further, embedding of the releasing agent is also possible. The production of a toner from an extension reaction product of a urethane-modified polyester as a toner binder has been proposed as a process for producing a toner by the polymerization method with a view to improving the low-temperature fixability and improving the high-temperature anti-offset property (see, for example, PTL 1).

Further, a process for producing a toner that excels in powder flowability and transferability in a small particle diameter form and, at the same time, excels in all of the heat-resistant storage property, the low-temperature fixability, and the high-temperature anti-offset property has been proposed (see, for example, PTLs 2 and 3).

Further, a process for producing a toner including the production of a toner binder having a stable molecular-weight distribution and the step of aging to simultaneously satisfy the low-temperature fixability and the high-temperature anti-offset property has been proposed (see, for example, PTLs 4 and 5).

These proposed techniques, however, do not meet a high level of low-temperature fixability that has recently been required.

Accordingly, a toner that contains a resin including a crystalline polyester resin and wax (a releasing agent) which are incompatible with each other and have an islands-sea-type phase-separated structure has been proposed with a view to providing a high level of low-temperature fixability (see, for example, PTL 6).

Further, a toner containing a crystalline polyester resin, a release resin, and a graft polymer has been proposed (see, for example, PTL 7).

These proposed techniques are advantageous in that the crystalline polyester resin is melted earlier than the amorphous polyester resin and, thus, low-temperature fixation can be realized. However, even when the crystalline polyester resin constituting islands in the islands-sea-type phase-separated structure is melted, the amorphous polyester resin constituting sea that occupies a major part of the islands-sea structure remains unmelted. Fixation does not occur until both the crystalline polyester resin and the amorphous polyester resin are melted to some extent. Accordingly, these proposed techniques do not meet a high level of low-temperature fixability that has recently been required.

Further, in addition to excellent low-temperature fixability, high-temperature anti-offset property, and heat-resistant storage property, good color reproducibility is also required of toners because of a requirement for high-quality images.

Techniques in which a fluorescent brightening agent is incorporated in a toner have been proposed (see, for example, PTLs 8 and 9). In these techniques, however, the purpose of adding the fluorescent brightening agent is not to enhance the color reproducibility of visible images.

In general, organic pigments having excellent heat resistance and lightfastness are used in toners. When a resin having poor spreadability is used as the resin in the toner, in a secondary color of blue, red, or green prepared by superimposing two different color toners on top of each other, the color toner constituting the lowermost layer is disadvantageously concealed by the color toner constituting the overlying layer in the superimposed individual color toners. Accordingly, the color of the toner constituting the lowermost layer cannot be viewed without difficulties, and the chroma is lowered, resulting in a drawback that the color reproducibility of images is inhibited.

Therefore, when the high-temperature anti-offset property and the heat-resistant storage property are improved, the color reproducibility is disadvantageously lowered.

Accordingly, at the present time, toners that have excellent low-temperature fixability, high-temperature anti-offset property, and heat-resistant storage property and, at the same time, have excellent color reproducibility have been desired.

CITATION LIST

Patent Literature

PTL 1: Japanese Patent Application Laid-Open (JP-A) No. 11-133665
PTL 2: JP-A No. 2002-287400
PTL 3: JP-A No. 2002-351143
PTL 4: Japanese Patent (JP-B) No. 2579150
PTL 5: JP-A No. 2001-158819
PTL 6: JP-A No. 2004-46095
PTL 7: JP-A No. 2007-271789
PTL 8: JP-A No. 04-349474
PTL 9: JP-A No. 2005-221891

SUMMARY OF INVENTION

Technical Problem

The present invention aims at solving the above-described various problems of the prior art and at attaining the following object. Thus, an object of the present invention is to provide a toner that has excellent low-temperature fixability, high-temperature anti-offset property, and heat-resistant storage property and, at the same time, has excellent color reproducibility.

Solution to Problem

The above object can be attained by the following means.

The toner of the present invention includes: a binder resin; and a colorant, wherein the toner has a storage modulus of $1.0\times10^7$ Pa or more at 50° C., a loss modulus of $8.0\times10^4$ Pa to $2.0\times10^5$ Pa at 80° C., and a loss modulus of $2.0\times10^2$ Pa to $1.0\times10^3$ Pa at 160° C.

Advantageous Effects of Invention

The present invention can solve the above-described various problems of the prior art and can provide a toner that has excellent low-temperature fixability, high-temperature anti-offset property, and heat-resistant storage property and, at the same time, has excellent color reproducibility.

DESCRIPTION OF EMBODIMENTS (Toner)

The toner of the present invention contains a binder resin and a colorant and optionally other components.

The toner has a storage modulus of $1.0\times10^7$ Pa or more at 50° C., a loss modulus of $8.0\times10^4$ Pa to $2.0\times10^5$ Pa at 80° C., and a loss modulus of $2.0\times10^2$ Pa to $1.0\times10^3$ Pa at 160° C.

The present inventors have made extensive and intensive studies with a view to providing a toner that has excellent low-temperature fixability, high-temperature anti-offset property, and heat-resistant storage property and, at the same time, has excellent color reproducibility. As a result, the present inventors have found that a toner that has excellent low-temperature fixability, high-temperature anti-offset property, and heat-resistant storage property and, at the same time, has excellent color reproducibility can be obtained, when the toner contains a binder resin and a colorant and has a storage modulus of $1.0\times10^7$ Pa or more at 50° C., a loss modulus of $8.0\times10^4$ Pa to $2.0\times10^5$ Pa at 80° C., and a loss modulus of $2.0\times10^2$ Pa to $1.0\times10^3$ Pa at 160° C.

<Storage Modulus and Loss Modulus>

The toner has a storage modulus of $1.0\times10^7$ Pa or more at 50° C., a loss modulus of $8.0\times10^4$ Pa to $2.0\times10^5$ Pa at 80° C., and a loss modulus of $2.0\times10^2$ Pa to $1.0\times10^3$ Pa at 160° C.

Here the temperature of 50° C. is a temperature which, when images are continuously formed with an image forming apparatus, the surface temperature of a toner bearing member, a photoconductor, and a peripheral member thereof reaches. The toner is applied to a development step in this, temperature range. Accordingly, when the toner is likely to be deformed at the temperature (50° C.), aggregation of toners themselves at a developing portion and fixation of toners on the toner bearing member occur, posing problems of toner aggregate-derived spotty contamination on the image and dropout due to abnormal supply of toner to the photoconductor. Further, the heat-resistant storage property is lowered. Accordingly, the toner is required to be less likely to be deformed at this temperature, and, thus, the storage modulus at 50° C. should be $1.0\times10^7$ Pa or more.

For example, the storage modulus of the toner at 50° C. can be brought to $1.0\times10^7$ Pa or more by using a resin having high Tg or regulating the amount of a crystalline resin having low elasticity.

The storage modulus of the toner at 50° C. is not particularly limited as long as the value is $1.0\times10^7$ Pa or more and may be properly selected according to purposes. The storage modulus of the toner at 50° C., however, is preferably $1.0\times10^7$ Pa to $2.0\times10^7$ Pa, more preferably $1.0\times10^7$ Pa to $1.5\times10^7$ Pa. When the storage modulus at 50° C. is less than $1.0\times10^7$ Pa, the high-temperature anti-offset property and the heat-resistant storage property are unsatisfactory. When the storage modulus at 50° C. is in a more preferred range, a toner having better low-temperature fixability and heat-resistant storage property can be advantageously obtained.

On the other hand, in order to realize excellent low-temperature fixability, the toner should have a low loss modulus. In the toner, the loss modulus at 80° C. is $8.0\times10^4$ Pa to $2.0\times10^5$ Pa. In order to realize excellent low-temperature fixability, the toner melting temperature should be lowered. The temperature of 80° C. is considered as a temperature which the surface temperature of the toner bearing member, the photoconductor, and the peripheral member thereof reaches when the image is continuously formed in a high-temperature and high-humidity environment. For this reason, a high loss modulus of approximately $1.0\times10^7$ Pa at 80° C. has been demanded from the viewpoint of ensuring reliability. On the other hand, toner according to the present invention can hold the heat-resistant storage property even when the loss modulus at 80° C. is low and $8.0\times10^4$ Pa to $2.0\times10^5$ Pa, making it possible to simultaneously meet the heat-resistant storage property and the low-temperature fixability. This can be suitably realized by incorporating an amorphous polyester resin A, described hereinafter, that has a glass transition temperature in an ultralow temperature range and is less likely to flow due to its high melt viscosity, and amorphous polyester resin B, described hereinafter, that has a high glass transition temperature of 40° C. to 70° C. Preferably, the amorphous polyester resin A and the amorphous polyester resin B are compatible with each other.

For example, the loss modulus of the toner at 80° C. can be brought to $8.0\times10^4$ Pa to $2.0\times10^5$ Pa by regulating the molecular weight, the property values such as the glass transition temperature, and the mixing amount of the amorphous polyester resin A described hereinafter, and regulating the property values such as the melting point, and the mixing amount of the crystalline polyester resin C described hereinafter.

The loss modulus of the toner at 80° C. is not particularly limited as long as the value is $8.0\times10^4$ Pa to $2.0\times10^5$ Pa. The loss modulus of the toner at 80° C. can be properly selected according to purposes but is preferably $1.0\times10^5$ Pa to $1.8\times10^5$ Pa, more preferably $1.0\times10^5$ Pa to $1.6\times10^5$ Pa. When the loss modulus of the toner at 80° C. is less than $8.0\times10^4$ Pa, the heat-resistant storage property is unsatisfactory and the toner has lower flowability after storage and, when exposed to heat in a machine (an image forming apparatus), is solidified and causes a transfer failure. When the loss modulus at 80° C. exceeds $2.0\times10^5$ Pa, the viscosity necessary for the fixation cannot be ensured and, consequently, the low-temperature fixation is impossible. When the loss modulus at 80° C. is in the above-described more preferred range, a toner having better low-temperature fixability and heat-resistant storage property can be advantageously obtained.

The toner meets a loss modulus at 160° C. of $2.0\times10^2$ Pa to $1.0\times10^3$ Pa from the viewpoints of ensuring an excellent high-temperature anti-offset property, a satisfactorily broad fixation temperature width, and a satisfactorily high toner spreadability in a fixation temperature range, and obtaining excellent color reproducibility. When the loss modulus at 160° C. is less than $2.0\times10^2$ Pa, high-temperature offset is likely to occur. In general, during the fixation, since heat is absorbed by a recording medium such as paper, a temperature of about 20° C. blow the fixation temperature is applied to the toner. The toner having a loss modulus at 160° C. of $2.0\times10^2$ Pa to $1.0\times10^3$ Pa can be suitably realized by using an amorphous polyester resin A, described hereinafter, that has a glass transition temperature in an ultralow temperature range and is less likely to flow due to its high melt viscosity.

For example, the loss modulus of the toner at 160° C. can be brought to $2.0\times10^2$ Pa to $1.0\times10^3$ Pa by regulating the monomer composition and the mixing amount of the amorphous polyester resin A described hereinafter.

The loss modulus of the toner at 160° C. is not particularly limited as long as the value is $2.0\times10^2$ Pa to $1.0\times10^3$ Pa. The loss modulus at 160° C. can be properly selected according to purposes but is preferably $3.0\times10^2$ Pa to $8.0\times10^2$ Pa, more preferably $3.0\times10^2$ Pa to $6.0\times10^2$ Pa. When the loss modulus at 160° C. is less than $2.0\times10^2$ Pa, the temperature at which high-temperature offset occurs is lowered and, thus, a satisfactory fixation temperature width cannot be ensured. When the loss modulus at 160° C. exceeds $1.0\times10^3$ Pa, the fixation temperature width can be ensured, but on the other hand, the spreadability of the toner is lowered. As a result, the color reproduction range of the toner in the fixation is narrowed (that is, the color reproducibility is lowered). When the loss modulus at 160° C. is in the above-described preferred range, a toner having better low-temperature fixability and high-temperature anti-offset property, and heat-resistant storage property and better color reproducibility can be advantageously obtained.

<<Method for Measuring Storage Modulus G' and Loss Modulus G" of Toner>>

The storage modulus (G') and loss modulus (G") of the toner may be measured, for example, with a dynamic viscoelasticity measuring device (ARES, manufactured by TA Instruments). The frequency in the measurement is 1 Hz.

Specifically, the storage modulus and the loss modulus are measured by molding a measurement sample into a pellet having a diameter of 8 mm and a thickness of 1 mm to 2 mm, fixing the pellet in a parallel plate having a diameter of 8 mm, then stabilizing at 40° C., and raising the temperature to 200° C. at a temperature rise rate of 2.0° C./rain under conditions of a frequency of 1 Hz (6.28 rad/sec) and a strain level of 0.1% (a strain level control mode).

In the present specification, in some cases, the storage modulus at 50° C. is represented by G' (50° C.), the loss modulus at 80° C. is represented by G" (80° C.), and the loss modulus at 160° C. is represented by G" (160° C.).

<Inflection Temperature>

Preferably, the function when the storage modulus of the toner is expressed as a function of temperature (° C.) has an inflection point in a range of 55° C. to 65° C., more preferably in a range of 57° C. to 61° C.

At the inflection point, the second derivative of the function is 0 (zero). In a given temperature range below a temperature at the inflection point, the second derivative of the function is negative. On the other hand, in a given temperature range above a temperature at the inflection point, the second derivative of the function is positive. The given temperature range refers to a temperature width of about 5° C. at the minimum.

At a temperature below the temperature at which the inflection point appears, it is considered that entanglement among molecular chains within the toner is so strong that the molecular chains are less likely to be moved. On the other hand, at a temperature above the temperature at which the inflection point appears, it is considered that entanglement among molecular chains (polymer) within the toner is somewhat loosened and the molecular chains are likely to gradually conduct micro-Brown motion, whereby the toner is in a rubbery state. When the temperature at the inflection point is below 55° C., it sometimes becomes difficult to ensure the heat-resistant storage property. On the other hand, when the temperature at the inflection point is above 65° C., it sometimes becomes difficult to ensure a satisfactory low-temperature fixability.

The temperature at the inflection point can be determined, for example, with a software attached to a dynamic viscoelasticity measuring device, or alternatively may be determined by taking advantage of a spreadsheet software such as Excel manufactured by Microsoft. A method that utilizes the Excel will be described. The measured data of the dynamic viscoelasticity measuring device is output in a CSV form, and the temperature and the storage modulus are read by the Excel. The first derivative of the function of the temperature and storage modulus (above function) can be determined by plotting values, obtained by dividing a storage modulus difference by a temperature difference for the two adjacent read points, against the original temperature.

Likewise, for the value determined by dividing the storage modulus difference by the temperature difference and the temperature, the slope of two adjacent points is determined and is plotted against the original temperature to determine a second derivative of a function of the storage modulus and the temperature (the above function). A region where a section in which the second derivative becomes negative is changed to a section in which the second derivative becomes positive is determined from the plot, and a point which is located halfway and becomes zero can be determined as the inflection point.

<Binder Resin>

The binder resin is not particularly limited and may be properly selected according to purposes. The incorporation of an amorphous polyester resin A obtained by a reaction between a nonlinear reactive precursor and a curing agent and have a glass transition temperature of −60° C. to 0° C. and a crystalline polyester resin C is preferred, and the further incorporation of an amorphous polyester resin B having a glass transition temperature of 40° C. to 70° C. is more preferred.

A toner having a storage modulus at 50° C. of $1.0\times10^7$ Pa or more, a loss modulus at 80° C. of $8.0\times10^4$ Pa to $2.0\times10^5$ Pa, and a loss modulus at 160° C. of $2.0\times10^2$ Pa to $1.0\times10^3$ Pa can easily be obtained by incorporating the amorphous polyester resin A and the crystalline polyester resin C in the toner. Further, a toner according to the present invention having the above properties can more easily be obtained by incorporating the amorphous polyester resin A, the amorphous polyester resin B, and the crystalline polyester resin C.

In order to further improve the low-temperature fixability, a method for lowering the glass transition temperature or a method for lowering the molecular weight is generally considered to melt an amorphous polyester resin together with a crystalline polyester resin. When the melt viscosity is lowered by simply lowering the glass transition temperature of the amorphous polyester resin or by simply lowering the molecular weight, it is highly expected that the heat-resistant storage property and the high-temperature offset property in the fixation of the toner are deteriorated.

Against this, in the above toner, the glass transition temperature of the amorphous polyester resin A is so low that the amorphous polyester resin A has a property of causing deformation at low temperatures, is deformed upon exposure to heat and pressure during the fixation, and is easily bonded to recording media such as paper at lower temperatures. Further, in the amorphous polyester resin A, since the reactive precursor is nonlinear, a branch structure is present in the molecular skeleton and the molecular chain has a three-dimensional network structure. Accordingly, the amorphous polyester resin A has a rubbery property, that is, is deformed but not flowable at low temperatures. Accordingly, the heat-resistant storage property and the high-temperature anti-offset property of the toner can easily be held. When the amorphous polyester resin A has a urethane bond or a urea bond having a high cohesive energy, adhesion to recording media such as paper is better. Since the urethane bond or the urea bond exhibits a behavior like a pseudo crosslinking point, rubbery properties are further strengthened. As a result, the heat-resistant storage property and the high-temperature anti-offset property of the toner are better.

Specifically, in the toner, the combined use of the amorphous polyester resin A that has a glass transition temperature in an ultralow temperature range but has a high melt viscosity and is less likely to flow, with the amorphous polyester resin B and the crystalline polyester resin C can allow the heat-resistant storage property and the high-temperature anti-offset property to be held even when the glass transition temperature is set to a value below that of the conventional toner. Further, when the glass transition temperature of the toner is lowered (for example, when the glass transition temperature at the first temperature rise in differential scanning calorimetry (DSC) of the toner (Tg1st) is brought to 20° C. to 40° C.), an excellent low-temperature fixability can be realized.

<<Amorphous Polyester Resin A>>

The amorphous polyester resin A is obtained by a reaction between a nonlinear reactive precursor and a curing agent and has a glass transition temperature of −60° C. to 0° C.

Preferably, the amorphous polyester resin A has any one of a urethane bond and a urea bond from the viewpoint of providing higher adhesion to recording media such as paper and thus preferably. When the amorphous polyester resin A has any one of the urethane bond and the urea bond, the amorphous polyester resin A exhibits a behavior like a pseudo crosslinking point and has strengthened rubbery properties. As a result, a toner having better heat-resistant storage property and high-temperature anti-offset property can be obtained.

—Nonlinear Reactive Precursor—

Any polyester resin that contains a group reactive with the curing agent (hereinafter referred to as "prepolymer") may be used as the nonlinear reactive precursor without particular limitation, and a proper nonlinear reactive precursor may be selected therefrom according to purposes.

An example of the group reactive with the curing agent in the prepolymer is a group reactive with an active hydrogen group. Groups reactive with the active hydrogen group include, for example, isocyanate, epoxy, carboxyl, and acid chloride groups. Among them, an isocyanate group is preferred because the urethane bond or the urea bond can be introduced into the amorphous polyester resin A.

The prepolymer is nonlinear. The "nonlinear" means the presence of a branch structure imparted by at least any one of trihydric or higher alcohols or tricarboxylic or higher carboxylic acids.

The prepolymer is preferably a polyester resin containing an isocyanate group.

—Polyester Resin Containing Isocynate Group—

The polyester resin containing an isocyanate group is not particularly limited and may be properly selected according to purposes. An example thereof is a product of a reaction between a polyester resin containing an active hydrogen group and a polyisocyanate. The polyester resin containing an active hydrogen group is obtained, for example, by polycondensing a diol and a dicarboxylic acid with one or more of trihydric or higher alcohols and tricarboxylic or higher carboxylic acids. The trihydric or higher alcohols and the tricarboxylic or higher carboxylic acids impart a branch structure to the polyester resin containing the isocyanate group.

———Diol———

The diol is not particularly limited and may be properly selected according to purposes. Examples thereof include aliphatic diols, diols containing an oxyalkylene group, alicyclic diols, alkylene oxide adducts of alicyclic diols, bisphenols, and alkylene oxide adducts of bisphenols.

Examples of aliphatic diols include ethylene glycol, 1,2-propylene glycol, 1,3-propylene glycol, 1,4-butanediol, 3-methyl-1,5-pentanediol, 1,6-hexanediol, 1,8-octanediol, 1,10-decanediol, and 1,12-dodecanediol.

Examples of diols containing an oxyalkylene group include diethylene glycol, triethylene glycol, dipropylene glycol, polyethylene glycol, polypropylene glycol, and polytetramethylene glycol.

Examples of alicyclic diols include 1,4-cyclohexane dimethanol, and hydrogenated bisphenol A.

Examples of bisphenols include bisphenol A, bisphenol F, and bisphenol S.

Examples of alkylene oxides include ethylene oxide, propylene oxide, and butylene oxide.

Among them, aliphatic diols having 4 to 12 carbon atoms are preferred.

These diols may be used solely or in a combination of two or more of them.

———Dicarboxylic Acid———

The dicarboxylic acid is not particularly limited and may be properly selected according to purposes. Examples thereof include aliphatic dicarboxylic acids and aromatic dicarboxylic acids. Further, anhydrides thereof may also be used. Lower (number of carbon atoms: 1 to 3) alkyl esterification products or halides thereof may also be used.

The aliphatic dicarboxylic acid is not particularly limited and may be properly selected according to purposes. Examples thereof include succinic acid, adipic acid, sebacic acid, dodecanedioic acid, maleic acid, and fumaric acid.

The aromatic dicarboxylic acid is not particularly limited and may be properly selected according to purposes. Aromatic dicarboxylic acids having 8 to 20 carbon atoms are preferred. The aromatic dicarboxylic acid having 8 to 20 carbon atoms is not particularly limited and may be properly selected according to purposes. Examples thereof include phthalic acid, isophthalic acid, terephthalic acid, and naphthalenedicarboxylic acids.

Among them, aliphatic dicarboxylic acids having 4 to 12 carbon atoms are preferred.

These dicarboxylic acids may be used solely or in a combination of two or more of them.

———Trihydric or Higher Alcohol———

The trihydric or higher alcohol is not particularly limited and may be properly selected according to purposes. Examples thereof include trihydric or higher aliphatic alcohols, trihydric or higher polyphenols, and alkylene oxide adducts of trihydric or higher polyphenols.

Examples of trihydric or higher aliphatic alcohols include glycerin, trimethylolethane, trimethylolpropane, pentaerythritol, and sorbitol.

Examples of trihydric or higher polyphenols include trisphenol PA, phenol novolak, and cresol novolak.

Examples of alkylene oxide adducts of trihydric or higher polyphenols include adducts of trihydric or higher polyphenols with alkylene oxide adducts such as ethylene oxide, propylene oxide, or butylene oxide.

———Tricarboxylic or Higher Carboxylic Acid———

The tricarboxylic or higher carboxylic acid is not particularly limited and may be properly selected according to purposes. Examples thereof include tricarboxylic or higher aromatic carboxylic acids. Anhydrides thereof may also be used. Further, lower (number of carbon atoms: 1 to 3) alkyl esterification products or halides thereof may also be used.

Tricarboxylic or higher aromatic carboxylic acids having 9 to 20 carbon atoms are preferred as the tricarboxylic or higher aromatic carboxylic acids. Examples of such tricarboxylic or higher aromatic carboxylic acids having 9 to 20 carbon atoms include trimellitic acid and pyromellitic acid.

———Polyisocyanate———

The polyisocyanate is not particularly limited and may be properly selected according to purposes. Examples thereof include diisocyanates and tri- or higher isocyanates.

Examples of diisocyanates include aliphatic diisocyanate, alicyclic diisocyanate, aromatic diisocyanate, araliphatic diisocyanate, isocyanurates, and the above diisocyanates blocked with phenol derivatives, oxime, caprolactam or the like.

The aliphatic diisocyanate is not particularly limited and may be properly selected according to purposes. Examples thereof include tetramethylene diisocyanate, hexamethylene diisocyanate, methyl 2,6-diisocyanatocaproate, octamethylene diisocyanate, decamethylene diisocyanate, dodecamethylene diisocyanate, tetradecamethylene diisocyanate, trimethylhexane diisocyanate, and tetramethylhexane diisocyanate.

The alicyclic diisocyanate is not particularly limited and may be properly selected according to purposes. Examples thereof include isophorone diisocyanate and cyclohexylmethane diisocyanate.

The aromatic diisocyanate is not particularly limited and may be properly selected according to purposes. Examples thereof include tolylene diisocyanate, diisocyanatodiphenylmethane, 1,5-naphthylene diisocyanate, 4,4'-diisocyanatodiphenyl, 4,4'-diisocyanato-3,3'-dimethyldiphenyl, 4,4'-diisocyanato-3-methyldiphenylmethane, and 4,4'-diisocyanatodiphenyl ether.

The araliphatic diisocyanate is not particularly limited and may be properly selected according to purposes. Examples thereof include α,α,α',α'-tetramethylxylylene diisocyanate.

The isocyanurates is not particularly limited and may be properly selected according to purposes. Examples thereof include tris(isocyanatoalkyl)isocyanurate and tris(isocyanatocycloalkyl)isocyanurate.

These polyisocyanates may be used solely or in a combination of two or more of them.

—Curing Agent—

Any curing agent that is reactive with the nonlinear reactive precursor to produce the amorphous polyester resin A may be used without particular limitation, and a proper curing agent may be selected according to purposes. Examples thereof include compounds containing an active hydrogen group.

——Compound Containing Active Hydrogen Group——

The active hydrogen group in the compound containing an active hydrogen group is not particularly limited and may be properly selected according to purposes. Examples thereof include hydroxyl (alcoholic hydroxyl and phenolic hydroxyl), amino, carboxyl, and mercapto groups. They may be used solely or in a combination of two or more of them.

The compounds containing an active hydrogen group are not particularly limited and are properly selected according to purposes. However, amines are preferred because a urea bond can be formed.

The amines are not particularly limited and are properly selected according to purposes. Examples thereof include diamines, tri- or higher amines, aminoalcohols, aminomercaptans, amino acids, and these compounds containing a blocked amino group. They may be used solely or in a combination of two or more of them.

Among them, diamines and mixtures of diamines with a small amount of tri- or higher amines are preferred.

The diamine is not particularly limited and may be properly selected according to purposes. Examples thereof include aromatic diamines, alicyclic diamines and aliphatic diamines.

The aromatic diamine is not particularly limited and may be properly selected according to purposes. Examples thereof include phenylene diamines, diethyltoluene diamines, and 4,4'-diaminodiphenylmethane.

The alicyclic diamine is not particularly limited and may be properly selected according to purposes. Examples thereof include 4,4'-diamino-3,3'-dimethyldicyclohexylmethane, diaminocyclohexane, and isophorone diamine.

The aliphatic diamine is not particularly limited and may be properly selected according to purposes. Example thereof include ethylene diamines, tetramethylene diamines, and hexamethylene diamines.

The tri- or higher amine is not particularly limited and may be properly selected according to purposes. Examples thereof include diethylene triamine and triethylene tetramine.

The amino alcohol is not particularly limited and may be properly selected according to purposes. Examples thereof include ethanolamine and hydroxyethylaniline.

The aminomercaptan is not particularly limited and may be properly selected according to purposes. Examples thereof include aminoethylmercaptan and aminopropylmercaptan.

The amino acid is not particularly limited and may be properly selected according to purposes. Examples thereof include aminopropionic acid and aminocaproic acid.

The compound containing a blocked amino group is not particularly limited and may be properly selected according to purposes. Examples thereof include ketimine compounds and oxazoline compounds obtained by blocking the amino group with ketones such as acetone, methyl ethyl ketone, or methyl isobutyl ketone.

In order to lower Tg of the amorphous polyester resin A and thus to easily impart low-temperature deformable properties, preferably, the amorphous polyester resin A contains a diol component as a constituent, and the diol component contains 50% by mass or more of an aliphatic diol having 4 to 12 carbon atoms.

In order to lower Tg of the amorphous polyester resin A and thus to easily impart low-temperature deformable properties, preferably, the amorphous polyester resin A contains 50% by mass or more, based on the whole alcohol component, of an aliphatic diol having 4 to 12 carbon atoms.

In order to lower Tg of the amorphous polyester resin A and thus to easily impart low-temperature deformable properties, preferably, the amorphous polyester resin A contains a dicarboxylic acid component as a constituent, and the dicarboxylic acid component contains 50% by mass or more of an aliphatic dicarboxylic acid having 4 to 12 carbon atoms.

The glass transition temperature of the amorphous polyester resin A is −60° C. to 0° C., more preferably −40° C. to −20° C. When the glass transition temperature is below −60° C., the flow of the toner at low temperatures cannot be suppressed, sometimes leading to a deteriorated heat-resistant storage property and a deteriorated anti-filming property. On the other hand, when the glass transition temperature is above 0° C., the toner cannot be satisfactorily deformed by heating and pressing during fixation and, consequently, the low-temperature fixability is sometimes unsatisfactory.

The weight average molecular weight of the amorphous polyester resin A is not particularly limited and may be properly selected according to purposes. Preferably, however, the weight average molecular weight of the amorphous polyester resin A is 20,000 to 1,000,000 as measured by GPC (gel permeation chromatography). The weight average molecular weight of the amorphous polyester resin A is a molecular weight of a product of a reaction between the nonlinear reactive precursor and the curing agent. When the weight average molecular weight is less than 20,000, toner is likely to flow at low temperatures, sometimes leading to a poor heat-resistant storage property. Further, in some cases, the viscosity is lowered in a melted state, and, consequently, the high-temperature offset property is lowered.

The molecule structure of the amorphous polyester resin A may be confirmed by solution or solid NMR measurement or by X-ray diffractometry, GC/MS, LC/MS, IR or other methods. A simple method is to detect, as an amorphous polyester resin, a resin that, in an infrared absorption spectrum, does not have an absorption attributable to SCH (out-of-plane deformation vibration) of an olefin at 965±10 $cm^{-1}$ and 990±10 $cm^{-1}$.

The content of the amorphous polyester resin A is not particularly limited and may be properly selected according to purposes. The content of the amorphous polyester resin A, however, is preferably 5 parts by mass to 25 parts by mass, more preferably 10 parts by mass to 20 parts by mass, based on 100 parts of the toner. When the content is less than 5 parts by mass, the low-temperature fixability and the high-temperature anti-offset property are sometimes deteriorated. When the content exceeds 25 parts by weight, a deterioration in heat-resistant storage property and a lowering in gloss of images obtained by the fixation sometimes occur. When the content is in the more preferred range, all of the low-temperature fixability, the high-temperature anti-offset property, and the heat-resistant storage property are advantageously excellent.

<Amorphous Polyester Resin B>

Any amorphous polyester resin that has a glass transition temperature of 40° C. to 70° C. may be used as an amorphous polyester resin B without particular limitation and may be properly selected according to purposes.

The amorphous polyester resin B is preferably a linear polyester resin. The linear polyester resin means a polyester resin that does not contain a side chain containing an ester bond. Accordingly, polyester resins containing a trihydric or higher alcohol residue or a tricarboxylic or higher carboxylic acid residue at the end of the polymer are embraced in the linear polyester resin.

The amorphous polyester resin B is preferably an unmodified polyester resin. The unmodified polyester resin is a polyester resin that is produced using a polyhydric alcohol and a polycarboxylic carboxylicacid or a derivative thereof, such as a polycarboxylic carboxylic acid, a polycarboxylic carboxylic anhydride, or a polycarboxylic carboxylic ester, and is not modified with an isocyanate compound or the like.

The polyhydric alcohol is, for example, a diol.

Examples of diols include alkylene (number of carbon atoms: 2 or 3) oxide (mean number of moles added: 1 to 10) adducts of bisphenol A, ethylene glycol, propylene glycol, hydrogenated bisphenol A, and alkylene (number of carbon atoms: 2 or 3) oxide (mean number of moles added: 1 to 10) adducts of hydrogenated bisphenol A.

Examples of alkylene (number of carbon atoms: 2 or 3) oxide (mean number of moles added: 1 to 10) adducts of bisphenol A include polyoxypropylene (2.2)-2,2-bis(4-hydroxyphenyl)propane and polyoxyethylene (2.2)-2,2-bis(4-hydroxyphenyl)propane.

They may be used solely or in a combination of two or more of them.

Examples of polycarboxylic carboxylic acids include dicarboxylic acids.

Examples of dicarboxylic acids include adipic acid, phthalic acid, isophthalic acid, terephthalic acid, fumaric acid, maleic acid, and succinic acid substituted by an alkyl group having 1 to 20 carbon atoms or an alkenyl group having 2 to 20 carbon atoms.

Examples of succinic acid substituted by an alkyl group having 1 to 20 carbon atoms or an alkenyl group having 2 to 20 carbon atoms include dodecenylsuccinic acid and octylsuccinic acid.

They may be used solely or in a combination of two or more of them.

The amorphous polyester resin B may contain one or more of tricarboxylic or higher carboxylic acids and trihydric or higher alcohols at the end of the resin chain from the viewpoint of regulating the acid value and the hydroxyl value.

Examples of tricarboxylic or higher carboxylic acids include trimellitic acid, pyromellitic acid, or acid anhydrides thereof.

Examples of trihydric or higher alcohols include glycerin, pentaerythritol, and trimethylolpropane.

The molecular weight of the amorphous polyester resin B is not particularly limited and may be properly selected according to purposes. When the molecular weight is excessively low, the heat-resistant storage property of the toner and the durability of the toner against stress produced, for example by stirring within a developing machine are sometimes poor. On the other hand, when the molecular weight is excessively high, the viscoelasticity of the toner in a melted state is so high that the low-temperature fixability is sometimes poor. Accordingly, as measured by GPC (gel permeation chromatography), the weight average molecular weight (Mw) is preferably 3,000 to 10,000. The number average molecular weight (Mn) is preferably 1,000 to 4,000. Further, Mw/Mn is preferably 1.0 to 4.0.

The weight average molecular weight (Mw) is more preferably 4,000 to 7,000. The number average molecular weight (Mn) is more preferably 1,500 to 3,000. Mw/Mn is more preferably 1.0 to 3.5.

The acid value of the amorphous polyester resin B is not particularly limited and may be properly selected according to purposes. The acid value is preferably 1 mg KOH/g to 50 mg KOH/g, more preferably 5 mg KOH/g to 30 mg KOH/g. When the acid value is 1 mg KOH/g or more, the toner is likely to be negatively charged. Further, in fixation to recording media such as water, the affinity between the recording media such as paper and the toner is improved, and, thus, the low-temperature fixability can be improved. When the acid value exceeds 50 mg KOH/g, the charge stability, particularly the charge stability against an environmental variation, is sometimes lowered.

The hydroxyl value of the amorphous polyester resin B is not particularly limited and may be properly selected according to purposes. Preferably, however, the hydroxyl value is 5 mg KOH/g or more.

The glass transition temperature (Tg) of the amorphous polyester resin B is 40° C. to 70° C., more preferably 50° C. to 60° C. When the glass transition temperature is below 40° C., the heat-resistant storage property of the toner, the durability of the toner against stress produced, for example by stirring within a developing machine and an anti-filming property of the toner are sometimes deteriorated. When the glass transition temperature is above 70° C., deformation of the toner by heating and pressing during fixation is unsatisfactory, and, thus, the low-temperature fixability is sometimes unsatisfactory.

The molecule structure of the amorphous polyester resin B may be confirmed by solution or solid NMR measurement or by X-ray diffractometry, GC/MS, LC/MS, IR or other measurement methods. A simple method is to detect, as an amorphous polyester resin, a resin that, in an infrared absorption spectrum, does not have an absorption attributable to δCH (out-of-plane deformation vibration) of an olefin at 965±10 $cm^{-1}$ and 990±10 $cm^{-1}$.

The content of the amorphous polyester resin B is not particularly limited and may be properly selected according to purposes. The content of the amorphous polyester resin B is preferably 50 parts by mass to 90 parts by mass, more preferably 60 parts by mass to 80 parts by mass, based on 100 parts by mass of the toner. When the content is less than 50 parts by mass, the dispersibility of the pigment and the releasing agent in the toner is deteriorated, sometimes leading to fogging and disturbance of images. On the other hand, when the content is more than 90 parts by mass, the contents of the crystalline polyester resin C and the amorphous polyester resin A are reduced, sometimes leading to poor low-temperature fixability. When the content is in the above more preferred range, advantageously, both the high-quality image and the low-temperature fixability are excellent.

<<Crystalline Polyester Resin C>>

The crystalline polyester resin C is highly crystalline and thus has such a hot-melt property that the viscosity is rapidly lowered at a temperature around a fixation start temperature. When the crystalline polyester resin C having the above property is used together with the amorphous polyester resin B, a toner that simultaneously realizes good heat-resistant storage property and low-temperature fixability can be obtained for the reason that, in a period just before the melt start temperature, the heat-resistant storage property is good because of the crystalline property, and, at the melt start temperature, a rapid lowering in viscosity (a sharp melting property) occurs due to the melting of the crystalline polyester resin C, leading to compatibilization of the crystalline polyester resin C with the amorphous polyester resin B that causes a rapid lowering viscosity in both the resins, whereby fixation takes place. Further, the release width (difference between the fixation lower limit temperature and high-temperature anti-offset generation temperature) is also good.

The crystalline polyester resin C is obtained using, for example, a polyhydric alcohol and a polycarboxylic carboxylic acid or a derivative thereof, such as a polycarboxylic carboxylic acid, a polycarboxylic carboxylic anhydride, or a polycarboxylic carboxylic ester.

As long as the crystalline polyester resin C according to the present invention is a crystalline polyester resin, as described above, the crystalline polyester resin C may be one obtained by using a polyhydric alcohol and a polycarboxylic carboxylic acid or a derivative thereof, such as a polycarboxylic carboxylic acid, a polycarboxylic carboxylic anhydride, or a polycarboxylic carboxylic ester, or a modification product of the obtained crystalline polyester resin, for example, a resin obtained by modifying a crystalline polyester resin having a hydroxyl group with a polyisocyanate and conducting any one of or both crosslinking and extension reactions.

—Polyhydric Alcohol—

The polyhydric alcohol is not particularly limited and may be properly selected according to purposes. Examples thereof include diols and trihydric or higher alcohols.

Examples of such diols include saturated aliphatic diols. Examples of such saturated aliphatic diols include straight-chain saturated aliphatic diols, and branched saturated aliphatic diols. Among them, straight-chain saturated aliphatic diols are preferred. Straight-chain saturated aliphatic diols having 2 to 12 carbon atoms are more preferred. When the saturated aliphatic diols are of a branched type, the crystallinity of the crystalline polyester resin C is lowered, sometimes leading to lowered melting point. When the number of carbon atoms in the saturated aliphatic diols is more than 12, the availability of practical materials is low. The number of carbon atoms is preferably 12 or less.

Examples of saturated aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among them, ethylene glycol, 1,4-butanediol, 1,6-hexanediol, 1,8-octanediol, 1,10-decanediol, and 1,12-dodecanediol are preferred from the viewpoints of high crystallinity and excellent sharp melt properties of the crystalline polyester resin C.

Examples of trihydric or higher alcohols include glycerin, trimethylolethane, trimethylolpropane, and pentaerythritol.

They may be used solely or in a combination of two or more of them.

—Polycarboxylic Carboxylic Acid—

The polycarboxylic carboxylic acid is not particularly limited and may be properly selected according to purposes. Examples thereof include dicarboxylic carboxylic acids and tricarboxylic or higher carboxylic acids.

Examples of dicarboxylic carboxylic acids include saturated aliphatic dicarboxylic acids and aromatic dicarboxylic acids. Examples of additional dicarboxylic carboxylic acids include anhydrides or lower (number of carbon atoms: 1 to 3) alkyl esters thereof.

Examples of saturated aliphatic dicarboxylic acids include oxalic acid, succinic acid, glutaric acid, adipic acid, suberic acid, azelaic acid, sebacic acid, 1,9-nonanedicarboxylic acids, 1,10-decanedicarboxylic acids, 1,12-dodecanedicarboxylic acids, 1,14-tetradecanedicarboxylic acids, and 1,18-octadecanedicarboxylic acids.

Examples of aromatic dicarboxylic acids include dibasic acids such as phthalic acid, isophthalic acid, terephthalic acid, naphthalene-2,6-dicarboxylic acids, malonic acid, and mesaconic acid.

Examples of tricarboxylic or higher carboxylic acids include 1,2,4-benzenetricarboxylic acid, 1,2,5-benzenetricarboxylic acid, 1,2,4-naphthalenetricarboxylic acid, and anhydrides or lower (number of carbon atoms: 1 to 3) alkyl esters thereof.

The polycarboxylic carboxylic acid may contain, in addition to the saturated aliphatic dicarboxylic acid and the aromatic dicarboxylic acid, a dicarboxylic acid having a sulfonic acid group. Further, in addition to the saturated aliphatic dicarboxylic acid and the aromatic dicarboxylic acid, a dicarboxylic acid having a double bond may be contained.

They may be used solely or in a combination of two or more of them.

Preferably, the crystalline polyester resin C includes a straight-chain saturated aliphatic dicarboxylic acid having 4 to 12 carbon atoms and a straight-chain saturated aliphatic diol having 2 to 12 carbon atoms. That is, preferably, the crystalline polyester resin C includes constituent units derived from a saturated aliphatic dicarboxylic acid having 4 to 12 carbon atoms and a saturated aliphatic diol having 2 to 12 carbon atoms. The crystalline polyester resin C having this constitution has a high crystallinity and an excellent sharp melt property and thus can advantageously exert an excellent low-temperature fixability.

The melting point of the crystalline polyester resin C is not particularly limited and may be properly selected according to purposes. The melting point, however, is 60° C. to 80° C. When the melting point is below 60° C., the crystalline polyester resin C is likely to be melted at low temperatures and, consequently, the heat-resistant storage property of the toner is sometimes disadvantageously lowered. On the other hand, when the melting point is above 80° C., melting of the crystalline polyester resin C by heating in the fixation is unsatisfactory, and the low-temperature fixability is sometimes disadvantageously lowered.

The molecular weight of the crystalline polyester resin C is not particularly limited and may be properly selected according to purposes. From the viewpoint of the fact that a crystalline polyester resin having a sharp molecular weight distribution and a low molecular weight has an excellent low-temperature fixability and, further, a high low-molecular weight content results in a lowered heat-resistant storage property, preferably, o-dichlorobenzene solubles in the crystalline polyester resin C have a weight average molecular weight (Mw) of 3,000 to 30,000, a number average molecular weight (Mn) of 1,000 to 10,000, and Mw/Mn of 1.0 to 10.

More preferably, the weight average molecular weight (Mw) is 5,000 to 15,000, the number average molecular weight (Mn) is 2,000 to 10,000, and Mw/Mn is 1.0 to 5.0.

The acid value of the crystalline polyester resin C is not particularly limited and may be properly selected according to purposes. The acid value is preferably 5 mg KOH/g or more, more preferably 10 mg KOH/g or more, in order to attain a desired low-temperature fixability from the viewpoint of affinity between the paper and the resin. On the other hand, the acid value is preferably 45 mg KOH/g or less from the viewpoint of improving the high-temperature anti-offset property.

The hydroxyl value of the crystalline polyester resin C is not particularly limited and may be properly selected according to purposes. The hydroxyl value is preferably 0 mg KOH/g to 50 mg KOH/g, more preferably 5 mg KOH/g to 50 mg KOH/g, from the viewpoint of attaining a desired low-temperature fixability and good charging characteristics.

The molecule structure of the crystalline polyester resin C can be confirmed, for example, by NMR measurement in a solution or a solid or by X-ray diffractometry, GC/NIS, LC/MS, or IR measurement. A simple method is that, in an infrared absorption spectrum, a substance that has an absorption based on δCH (out-of-plane deformation vibration) of an olefin at 965±10 $cm^{-1}$ or 990±10 $cm^{-1}$ is detected as the crystalline polyester resin C.

The content of the crystalline polyester resin C is not particularly limited and may be properly selected according to purposes. The content of the crystalline polyester resin C is preferably 2 parts by mass to 20 parts by mass, more preferably 5 parts by mass to 15 parts by mass, based on 100 parts by mass of the toner. When the content of the crystalline polyester resin C is less than 2 parts by mass, the sharp melt property exerted by the crystalline polyester resin C is unsatisfactory and, consequently, the low-temperature fixability is sometimes poor. On the other hand, when the content of the crystalline polyester resin C is more than 20 parts by mass, a lowered heat-resistant storage property and fogging of images are likely to occur. When the content of the crystalline polyester resin C is in the above-defined more preferred range, advantageously, both high image quality and low-temperature fixability are excellent.

When the proportions (by mass) of the amorphous polyester resin A (resin A), the amorphous polyester resin B (resin B), and the crystalline polyester resin C (resin C) are not particularly limited and may be properly selected according to purposes. The proportions in terms of mass ratio are preferably resin A:resin B:resin C=5 to 25:50 to 90:2 to 20, more preferably 10 to 20:60 to 80:5 to 15.

<Colorant>

The colorant is not particularly limited and may be properly selected according to purposes. Examples of colorants include black pigments, yellow pigments, magenta pigments, and cyan pigments. The incorporation of any of yellow pigments, magenta pigments, and cyan pigments is preferred.

The black pigments are used, for example, in black toners. Examples of black pigments include carbon black, copper oxide, manganese dioxide, aniline black, activated carbon, non-magnetic ferrite, magnetite, nigrosine dyes, and black iron oxide.

The yellow pigments are used, for example, in yellow toners. Examples of yellow pigments include C.I. Pigment Yellow 74, 93, 97, 109, 128, 151, 154, 155, 166, 168, 180, and 185, Naphthol Yellow S, Hanza Yellow (10G, 5G, G), cadmium yellow, yellow iron oxide, Chinese yellow, chrome yellow, titanium yellow, and polyazo yellow.

The magenta pigments are used, for example, in magenta toners. Examples of magenta pigments include monoazo pigments such as quinacridone-based pigments and C.I. Pigment Red 48:2, 57:1, 58:2, 5, 31, 146, 147, 150, 176, 184, and 269. The monoazo pigments may be used in combination with the quinacridone-based pigments. C.I. Pigment Red 122, C.I. Pigment Red 202, and C.I. Pigment Violet 19 are preferred as the quinacridone pigments, and C.I. Pigment Red 122 is more preferred.

The cyan pigments are used, for example, in cyan toners. Examples of cyan pigments include Cu-phthalocyanine pigments, Zn-phthalocyanine pigments, and Al-phthalocyanine pigments. Among them, at least any one of the Al-phthalocyanine pigments and the Zn-phthalocyanine pigments can extend, to a green direction (−a direction in an Lab space), an a value of cyan that, in Cu-phthalocyanine colorant, is likely to shift in a red direction (+a direction in an Lab space) against Japan Color. Thus, the Al-phthalocyanine pigments and the Zn-phthalocyanine pigments are preferably used in combination with the Cu-phthalocyanine pigments. The mixing ratio in the combination is preferably 40:60 to 10:90 in terms of mass ratio (Al-phthalocyanine pigments and Zn-phthalocyanine pigments:Cu-phthalocyanine pigments).

The content of the colorant is not particularly limited and may be properly selected according to purposes. The content of the colorant is preferably 1 part by mass to 15 parts by mass, more preferably 3 parts by mass to 10 parts by mass, based on 100 parts by mass of the toner.

The colorants can also be used as a master batch composited with resins. Examples of resins to be used in the production of the master batch or to be kneaded together with the master batch include, in addition to the amorphous polyester resin B, polymers of styrene or substituted styrene such as polystyrene, poly-p-chlorostyrene, and polyvinyltoluene; styrenic copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-α-chloromethyl methacrylate copolymers, styrene-acrylonitrile copolymers, styrene-vinylmethylketone copolymers, styrene-butadiene copolymers, styrene-isoprene copolymers, styrene-acrylonitrile-indene copolymers, styrene-maleic acid copolymers, and styrene-maleic ester copolymers; and polymethyl methacrylates, polybutyl methacrylates, polyvinyl chlorides, polyvinyl acetates, polyethylenes, polypropylenes, polyesters, epoxy resins, epoxy polyol resins, polyurethanes, polyamides, polyvinyl butyrals, polyacrylic acid resins, rosins, modified rosins, terpene resins, aliphatic or alicyclic hydrocarbon resins, aromatic petroleum resins, chlorinated paraffins, and paraffin waxes. They may be used solely or in a combination of two or more of them.

The master batch can be obtained by mixing the resin for the master batch and the colorant while applying a high shear force and kneading the mixture. An organic solvent may be used to enhance an interaction between the colorant and the resin. Further, a method that is so-called "flushing method" including mixing kneading an aqueous paste of the colorant with the resin and the organic solvent, allowing the colorant to be transferred to the resin side, and removing the water and the organic solvent component is also preferred, because a wet cake of the colorant as such may be used and, thus, drying is unnecessary.

High-shearing dispersers such as three-roll mills are preferred for mixing and kneading purposes.

<Other Components>

Examples of other components include fluorescent brightening agents, releasing agents, charge control agents, external additive, flowability improvers, cleanability improvers, and magnetic materials.

—Fluorescent Brightening Agent—

The fluorescent brightening agent is not particularly limited and may be properly selected according to purposes. Examples thereof include organic materials that absorb ultraviolet light and emit fluorescence having a fluorescence peak at 350 nm to 450 nm.

Examples of fluorescent brightening agents include benzoxazole derivatives, benzothiazole derivatives, benzimidazole derivatives, stilbene derivatives, coumarin derivatives, naphthalimide derivatives, and benzidine derivatives.

The benzoxazole derivatives are not particularly limited and may be properly selected according to purposes. Examples thereof include compounds represented by general formula (K-A), compounds represented by general formula (K—B), and compounds represented by structural formula (K—C).

(K-A)

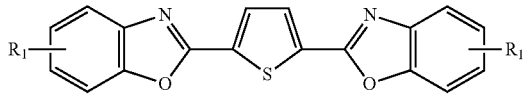

(K-B)

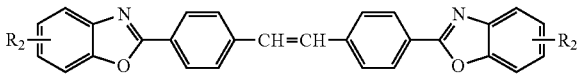

(K-C)

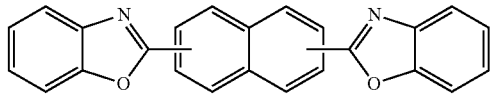

In general formula (K-A), $R_1$ represents an alkyl group. In general formula (K—B), $R_2$ represents an alkyl group.

The coumarin derivatives are not particularly limited and may be properly selected according to purposes. Examples thereof include compounds represented by general formula (K-D).

The naphthalimide derivatives are not particularly limited and may be properly selected according to purposes. Examples thereof include compounds represented by general formula (K-E).

(K-D)

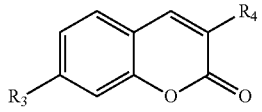

(K-E)

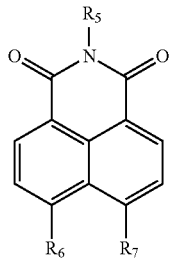

In general formula (K-D), $R_3$ represents a substituent having at least any one of a triazine ring and a triazole ring; and $R_4$ represents any one of alkyl, alkoxy, and aryl groups. In general formula (K-E), $R_5$ represents an alkyl group; and $R_6$ and $R_7$ each independently represent any one of alkyl, alkoxy, and acylamino groups.

Among them, benzoxazole derivatives and stilbene derivatives are preferred, and benzoxazole derivatives are more preferred.

Specific examples of fluorescent brightening agents are as follows.

(K-1)
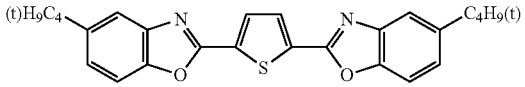
(K-2)
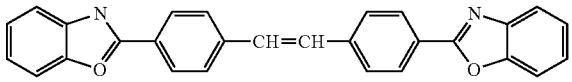
(K-3)
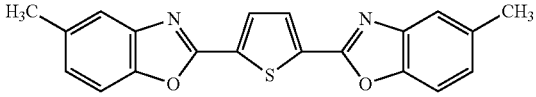
(K-4)
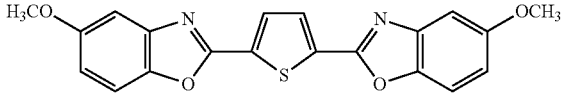
(K-5)
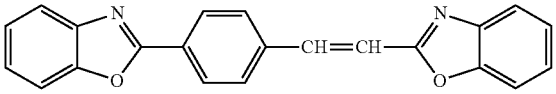
(K-6)
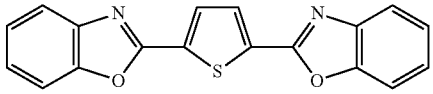
(K-7)
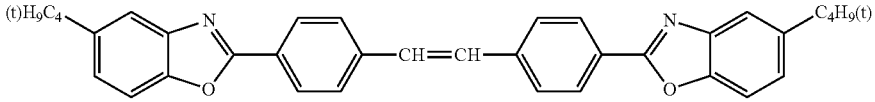
(K-8)
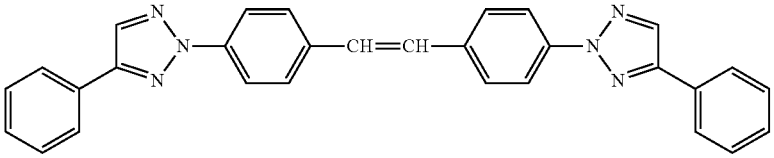
(K-9)
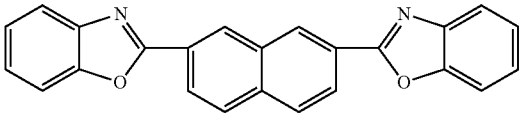
(K-10)
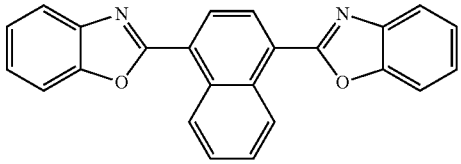
(K-11)
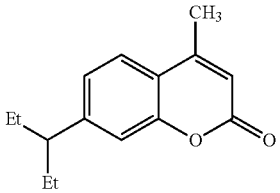
(K-12)
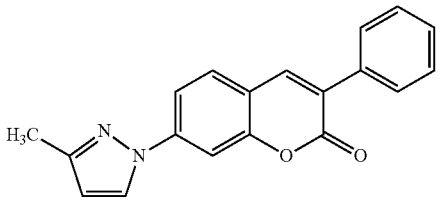
(K-13)
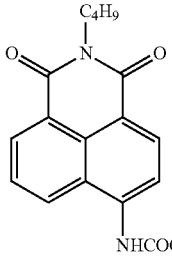
(K-14)
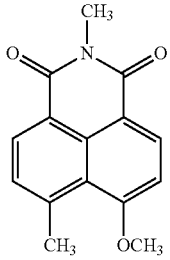

-continued (K-15)

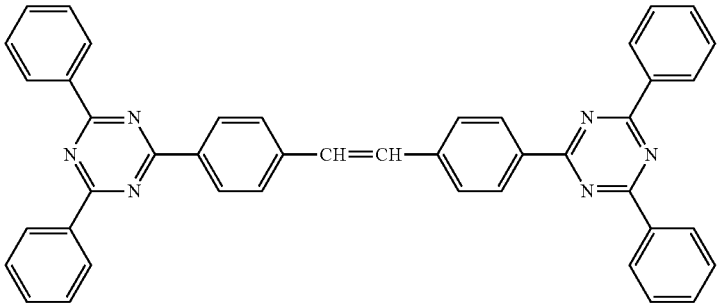

In the structural formula, "(t)$H_9C_4$—" and "—$C_4H_9$(t)" represent a tert-butyl group. "Et" represents an ethyl group.

The fluorescent brightening agent may be somewhat colored. The fluorescent brightening agent that is in a color toner form is preferably colorless to white under visible light so that the fluorescent brightening agent has no adverse effect on appearance such as design or color of electronic copies. From this standpoint, the fluorescence wavelength peak of the fluorescent brightening agent is preferably 400 nm or less, particularly preferably 380 nm or less.

The content of the fluorescent brightening agent is not particularly limited and may be properly selected according to purposes. The content of the fluorescent brightening agent is preferably 0.01 parts by mass to 1.0 part by mass, more preferably 0.01 part by mass to 0.5 part by mass, particularly preferably 0.01 part by mass to 0.02 part by mass, based on 100 parts by mass of the toner. When the content of the fluorescent brightening agent is less than 0.01 parts by mass, light (color development) on short wavelength side lacks and, consequently, chroma sometimes lacks. On the other hand, when the content of the fluorescent brightening agent is more than 1.0 part by mass, light (color development) on short wavelength side is complemented beyond necessary. As a result, the hue angle is shifted, and the color reproducibility is sometimes lowered. When the content of the fluorescent brightening agent is in the particularly preferred range, a satisfactory chroma can be advantageously ensured while suppressing the shift of the hue angle.

—Releasing Agent—

The releasing agent is not particularly limited and may be properly selected from publicly known releasing agents, and examples thereof include waxes.

Releasing agents formed of waxes include naturally occurring waxes. Examples of naturally occurring waxes include vegetable waxes, animal waxes, mineral waxes, and petroleum waxes.

Examples of vegetable waxes include carnauba wax, cotton waxes, Japan waxes, and rice waxes.

Examples of animal waxes include beeswaxes and lanoline.

Examples of mineral waxes include ozokerite and ceresine.

Examples of petroleum waxes include paraffins, microcrystallines, and petrolatums.

Examples of releasing agents include hydrocarbon wax in addition to these naturally occurring waxes. Examples of hydrocarbon waxes include paraffin waxes, microcrystalline waxes, Fischer-Tropsch waxes, polyethylene waxes, and polypropylene waxes.

Examples of additional releasing agents include fatty acid amide-based compounds, low-molecular weight crystalline polymeric resins, and crystalline polymers having a long alkyl group in their side chain. Examples of fatty acid amide-based compounds include 12-hydroxystearic acid amide, stearic acid amide, and phthalic acid imide anhydrides. Examples of low-molecular weight crystalline polymeric resins include homopolymers or copolymers of polyacrylates (for example, copolymers of n-stearyl acrylate-ethyl methacrylate).

Among them, hydrocarbon waxes are preferred, and paraffin waxes, microcrystalline waxes, Fischer-Tropsch waxes, polyethylene waxes, and polypropylene waxes are more preferred.

The melting point of the releasing agent is not particularly limited and may be properly selected according to purposes. The melting point, however, is preferably 60° C. to 80° C. When the melting point is below 60° C., the releasing agent is likely to be melted at low temperatures and, consequently, the heat-resistant storage property is sometimes poor. A melting point above 80° C. is disadvantageous in that, even when the resin is melted and is in a fixation temperature range, in some cases, the releasing agent is not satisfactorily melted and fixation offset occurs, leading to image defects.

The content of the releasing agent is not particularly limited and may be properly selected according to purposes. The content of the releasing agent is preferably 2 parts by mass to 10 parts by mass, more preferably 3 parts by mass to 8 parts by mass, based on 100 parts by mass of the toner. When the content of the releasing agent is less than 2 parts by mass, the high-temperature anti-offset property and the low-temperature fixability in the fixation are sometimes poor. On the other hand, when the content of the releasing agent is more than 10 parts by mass, in some cases, for example, a lowering in heat-resistant storage property and fogging of images are likely to occur. When the content of the releasing agent is in the more preferred range, an increase in image quality and an improvement in fixation stability can be advantageously realized.

—Charge Control Agent—

The charge control agent is not particularly limited and may be properly selected according to purposes. Examples thereof include nigrosin-based dyes, triphenylmethane-based dyes, chrome-containing metal complex dyes, molybdenum acid chelate pigments, rhodamine dyes, alkoxy-based amines, quaternary ammonium salts (including fluorine-modified quaternary ammonium salts), alkylamides, phosphorus as a simple substance or compounds of phosphorus, tungsten as a simple substance or compounds of tungsten, fluorine-based active agents, metal salicylates, and metal salts of salicylic acid derivatives. Specific examples of charge control agents include BONTRON 03 (nigrosine-based dye), BONTRON P-51 (quaternary ammonium salt), BONTRON S-34 (metal-containing azo dye), E-82 (oxynaphthoic acid metal complex), E-84 (salicylic acid metal complex), and E-89 (phenolic condensates), which are manufactured by Orient Chemical Industries, Ltd.; TP-302 and TP415 (quaternary ammonium salt molybdenum complex), which are manufactured by Hodogaya Chemical Co., LTD.; LRA-901 and LR-147 (boron complex), which are manufactured by Japan Carlit Co., Ltd.; copper phthalocyanine, perylene, quinacridone, and azo pigments; and polymeric compounds having a functional group such as a sulfonate group, a carboxyl group, or a quaternary ammonium salt group.

The content of the charge control agent is not particularly limited and may be properly selected according to purposes. The content of the charge control agent is preferably 0.1 parts by mass to 10 parts by mass, more preferably 0.2 part by mass to 5 parts by mass, based on 100 parts by mass of the toner. When the content of the charge control agent is more than 10 parts by mass, electrification characteristics in the toner are so large that the effect of the main charge control agent is reduced and electrostatic attractive force between the toner and the development roller is increased, sometimes leading to lowered flowability of the developer and lowered image density. These charge control agents, together with the master batch and the resin, can be melted and kneaded followed by dissolution and dispersion. It is a matter of course that the charge control agent may be added directly in the organic solvent in dissolution and dispersion. Alternatively, after the preparation of toner mother particles, the charge control agent may be immobilized on the surface of the toner.

—External Additive—

In addition to fine particles of oxides, inorganic fine particles and hydrophobicized inorganic fine particles may be used as the external additive in combination therewith. For the inorganic fine particles, the average particle diameter of the hydrophobicized primary particles is preferably 1 nm to 100 nm, more preferably 5 nm to 70 nm.

The incorporation of one or more types of inorganic fine particles having a average particle diameter of 20 nm or less in terms of hydrophobicized primary particles and one or more types of inorganic fine particles having a average particle diameter of 30 nm or more in terms of hydrophobicized primary particles is preferred. The specific surface area as measured by the BET method is preferably 20 $m^2/g$ to 500 $m^2/g$.

The external additive is not particularly limited and may be properly selected according to purposes. Examples thereof include fine particles of silica, hydrophobic silica, fatty acid metal salts (for example, zinc stearate and aluminum stearate), metal oxides (for example, titania, alumina, tin oxide, and antimony oxide), and fluoro polymers.

Suitable additives include fine particles of hydrophobicized silica, titania, titanium oxide, and alumina. Examples of fine particles of silica include R972, R974, RX200, RY200, R202, R805, and R812, all of which are manufactured by Nippon Aerosil Co., Ltd. Examples of fine particles of titania include P-25 which is manufactured by Nippon Aerosil Co., Ltd., STT-30, and STT-65C-S, all of which are manufactured by Fuji Titanium Industry Co., Ltd.; TAF-140, which is manufactured by Fuji Titanium Industry Co., Ltd.; and MT-150W, MT-500B, MT-600B, and MT-150A, all of which are manufactured by Tayca Corporation.

Examples of fine particles of hydrophobicized titanium oxide include T-805 which is manufactured by Nippon Aerosil Co., Ltd.; STT-30A and STT-65S-S, both of which are manufactured by Fuji Titanium Industry Co., Ltd.; TAF-500T and TAF-1500T, both of which are manufactured by Fuji Titanium Industry Co., Ltd.; MT-100S and MT-100T, both of which is manufactured by Tayca Corporation; and IT-S which is manufactured by Ishihara Sangyo Kaisha Ltd.

The fine particles of hydrophobicized silica, the fine particles of the hydrophobicized titania, and the fine particles of the hydrophobicized alumina are obtained, for example, by treating hydrophilic fine particles with a silane coupling agent such as methyltrimethoxysilane, methyltriethoxysilane, or octyltrimethoxysilane. Further, fine particles of silicone oil-treated oxides or inorganic fine particles obtained by treating inorganic fine particles with silicone oils optionally while heating are also suitable.

Examples of silicone oils include dimethyl silicone oils, methyl phenyl silicone oils, chlorophenyl silicone oils, methyl hydrogen silicone oils, alkyl-modified silicone oils, fluorine-modified silicone oils, polyether-modified silicone oils, alcohol-modified silicone oils, amine-modified silicone oils, epoxy-modified silicone oils, epoxy/polyether-modified silicone oils, phenol-modified silicone oils, carboxyl-modified silicone oils, mercapto-modified silicone oils, methacryl-modified silicone oils, and α-methylstyrene-modified silicone oils. Examples of inorganic fine particles include silica, alumina, titanium oxide, barium titanate, magnesium titanate, calcium titanate, strontium titanate, iron oxide, copper oxide, zinc oxide, tin oxide, quartz sand, clay, mica, sand lime, diatomaceous earth, chromium oxide, ceric oxide, iron oxide red, antimony trioxide, magnesium oxide, zirconium oxide, barium sulfate, barium carbonate, calcium carbonate, silicon carbide, and silicon nitride. Among them, silica and titanium dioxide are particularly preferred.

The content of the external additive is not particularly limited and may be properly selected according to purposes. The content of the external additive, however, is preferably 0.1 parts by mass to 5 parts by mass, more preferably 0.3 parts by mass to 3 parts by mass based on 100 parts by mass of the toner.

The average particle diameter of primary particles of the inorganic fine particles is not particularly limited and may be properly selected according to purposes. The average particle diameter of the primary particles is preferably 100 nm or less, more preferably 3 nm to 70 nm. When the average particle diameter of the primary particles is below the lower limit of the above-defined range, the inorganic fine particles are embedded in the toner, making it difficult to effectively exert the function. On the other hand, when the average particle diameter of the primary particles is above the upper limit of the above-defined range, disadvantageously, the inorganic fine particles unevenly scratch the surface of the photoconductor.

—Flowability Improver—

Any flowability improver that can surface-treat to enhance hydrophobicity and to prevent a deterioration in flow properties and electrification characteristics can be used without particular limitation and the flowability improver may be properly selected according to purposes. Examples thereof include silane-coupling agents, silylating agents, silane-coupling agents having an alkyl fluoride group, organotitanate-based coupling agents, aluminum-based coupling agents, silicone oils, and modified silicone oils. Particularly preferably, the silica and the titanium oxide are surface-treated with the flowability improver and are used as hydrophobic silica and hydrophobic titanium oxide.

—Cleanability Improver—

Any cleanability improver that can be added to the toner to remove a developer which, after transfer, stays on the photoconductor and the primary transfer medium is not particularly limited and the cleanability improver may be properly selected according to purposes. Examples thereof include fatty acid metal salts and fine particles of polymers produced by soap-free emulsion polymerization. Examples of fatty acid metal salts include zinc stearate and calcium stearate. Examples of fine particles of polymers produced by the soap-free emulsion polymerization include fine particles of polymethyl methacrylate and polystyrene. The fine particles of polymers produced by the soap-free emulsion polymerization preferably have a relatively narrow particle size distribution, and a volume average particle diameter of 0.01 μm to 1 μm is suitable.

—Magnetic Material—

The magnetic material is not particularly limited and may be properly selected according to purposes. Examples thereof include iron powders, magnetite, and ferrite. Among them, magnetic materials having a white color is preferred from the viewpoint of color tone.

<Core-Shell Structure>

Preferably, the toner has a core-shell structure including a core and a shell from the viewpoint of ensuring heat-resistant storage property and flowability after storage.

An example of the core-shell structure is a structure including: a core that is a toner particle body containing the binder resin, the colorant and the like; and fine particles of an acrylic resin as the shell adhered on the surface of the core.

The core-shell structure can be formed, for example, by a process for producing a toner which will be described hereinafter.

Whether the toner has a core-shell structure can be determined by observing a cross-section of the toner under a transmission electron microscope.

<<Core>>

The core is not particularly limited and may be properly selected according to purposes. Preferably, the core contains the binder resin and the colorant.

<<Shell>>

The shell is not particularly limited and may be properly selected according to purposes. Preferably, however, the shell is formed of fine particles of an acrylic resin.

—Fine Particles of Acrylic Resin—

Any material for the fine particles of the acrylic resin may be used without particular limitation and the material may be properly selected according to purposes. Examples thereof include (meth)acrylic acid-acrylic ester copolymers.

Copolymers including a monomer having at least two unsaturated groups are also usable as the fine particles of the acrylic resin.

The monomer having at least two unsaturated groups is not particularly limited and may be properly selected according to purposes. Examples thereof include sodium salts of sulfate esters of ethylene oxide adducts of methacrylic acid (Eleminol RS-30, manufactured by Sanyo Chemical Industries, Ltd.), divinylbenzene, 1,6-hexanediol acrylate, and ethylene glycol dimethacrylate.

The fine particles of the acrylic resin are generally free from styrene as the constituent.

The volume average particle diameter of the fine particles of the acrylic resin is not particularly limited and may be properly selected according to purposes. The volume average particle diameter is preferably 10 nm to 500 nm, more preferably 100 nm to 400 nm. When fine particles of the acrylic resin having the volume average particle diameter is adhered on the surface of the core, the non-electrostatic attractive force of toner particles can be reduced by a spacer effect and, at the same time, even when a mechanical stress over time is large as experienced, for example, in high-speed machines, an increase in non-electrostatic attractive force caused by embedding of the fine particles of the acrylic resin on the surface of the toner can be suppressed, whereby a satisfactory transfer efficiency can be maintained over a long period of time. In particular, when two transfer steps of a primary transfer step and a secondary transfer step in an intermediate transfer method are carried out, the fine particles of the acrylic resin having the above-defined volume average particle diameter is very useful. The effect is large particularly in a relatively high-speed image formation process (linear velocity of transfer: 300 mm/sec to 1,000 mm/sec, transfer time at secondary nip portion: 0.5 msec to 20 msec).

When the volume average particle diameter is less than 10 nm, the spacer effect is unsatisfactory and, consequently, the non-electrostatic attractive force of the toner particles cannot be reduced. Further, when a mechanical stress over time is large as experienced, for example, in high-speed machines, fine particles of the acrylic resin and the external additives are likely to be embedded in the surface of the toner, sometimes making it impossible to maintain satisfactory transfer efficiency over a long period of time. When the volume average particle diameter is more than 500 nm, the flowability of the toner is poor and, consequently, even transfer is sometimes inhibited.

The volume average particle diameter may be measured, for example, with LA-920 (manufactured by Horiba, Ltd.).

The glass transition temperature (Tg) of the shell is not particularly limited and may be properly selected according to purposes. The glass transition temperature (Tg), however, is preferably 50° C. to 100° C., more preferably 50° C. to 90° C., particularly preferably 70° C. to 90° C. When the glass transition temperature (Tg) is below 50° C., the storage stability of the toner is deteriorated and, consequently, blocking sometimes occurs during storage and within a developing machine. On the other hand, when the glass transition temperature (Tg) is above 100° C., disadvantageously, the fine particles of the acrylic resin inhibits the adhesion to a fixation paper and, consequently, the fixation lower limit temperature is sometimes increased.

When the shell is formed of the fine particles of the acrylic resin, the glass transition temperature of the shell is the glass transition temperature of the fine particles of the acrylic resin.

In general, in the toner filled into the developing machine, the fine particles of the resin on the surface of the toner are embedded in the toner or moved to recesses on the surface of the toner particle body mainly by a mechanical stress within the developing machine and, consequently, the effect of reducing adherence is lost. Further, the external additives are exposed to the same stress and thus are embedded in the toner and, consequently, the adherence of the toner is increased.

In the toner that has the core-shell structure and includes the shell formed of the fine particles of the acrylic resin, the fine particles of the acrylic resin are relatively large and thus are less likely to be embedded in toner particle body. In particular, the fine particles of the acrylic resin are preferably fine particles of a crosslinked resin including an acrylic ester polymer or a methacrylic ester polymer. Such fine particles of the acrylic resin are relatively hard because of a crosslinked state, and, thus, the fine particles of the acrylic resin are not deformed on the surface of the toner particles even upon exposure to the mechanical stress within the developing machine and, at the same time, the spacer effect is also maintained, whereby embedding of the external additives can be prevented and the adherence can be further reliably maintained.

The molecular weight of the shell is not particularly limited and may be properly selected according to purposes. The molecular weight of the shell, however, is preferably in the range of 10,000 to 1,000,000 in terms of weight average molecular weight (Mw) of tetrahydrofuran solubles as measured by GPC. When Mw of the shell is less than 10,000, the solubility of the shell in an organic solvent (for example, ethyl acetate) is increased, sometimes making it difficult to adhere the material (for example, fine particles of the acrylic resin) constituting the shell to the surface of the toner. On the other hand, when Mw of the shell is more than 1,000,000, the viscosity of the resin in the shell is increased, the low-temperature fixability is sometimes deteriorated.

The average thickness of the shell is not particularly limited and may be properly selected according to purposes. The average thickness of the shell is preferably 10 nm to 500 nm, more preferably 20 nm to 300 nm, particularly preferably 30 nm to 200 nm. When the average thickness is less than 10 nm, the heat-resistant storage property and the stress resistance are sometimes unsatisfactory. On the other hand, a average thickness of more than 500 nm is disadvantageous in that, in some cases, the fixation lower limit is unsatisfactory and the flowability of the toner is so low that the even transfer cannot be ensured. A average thickness in the above particularly preferred range is advantageous in that the stress-derived embedding within the machine (image forming apparatus) is prevented and a satisfactory transfer efficiency can be maintained over a long period of time.

The average thickness of the shell can be measured, for example, by the following methods. In any of the following methods, the thickness of the shell is measured for randomly extracted 10 pieces of toner, and the mean value thereof is regarded as the average thickness of the shell.

(1) Evaluation with Transmission Electron Microscope (TEM)

At the outset, the toner is embedded in an epoxy-based resin in an amount approximately equal to a spatula of the toner, followed by curing. The shell and the core are subjected to discrimination dyeing by exposing the sample to gas using ruthenium tetraoxide for 5 min. The cross section is exposed with a knife, and an ultrathin section (thickness: 200 nm) of the toner is prepared with an ultramicrotome (manufactured by Leica, ULTRACUT UCT, diamond knife used). The ultrathin section is then observed under a transmission electron microscope (TEM; H7000, manufactured by Hitachi Hitec) at an acceleration voltage of 100 kV.

(2) Evaluation with FE-SEM (Scanning Electron Microscope)

The toner is embedded in an epoxy-based resin in an amount approximately equal to a spatula of the toner, followed by curing. The shell and the core are subjected to discrimination dyeing by exposing the sample to gas using ruthenium tetraoxide for 5 min. The cross section is exposed with a knife, and a cross section of the toner is prepared with an ultramicrotome (manufactured by Leica, ULTRACUT UCT, diamond knife used). A reflected electron image is then observed under FE-SEM (scanning electron microscope; Ultra55, manufactured by Zeiss) at an acceleration voltage of 0.8 kV.

(3) Evaluation with SPM

The toner is embedded in an epoxy-based resin in an amount approximately equal to a spatula of the toner, followed by curing. The cross section is exposed with a knife, and a cross section of the toner is prepared with an ultramicrotome (manufactured by Leica, ULTRACUT UCT, diamond knife used). A layer image is observed with SPM (scanning probe microscope; MMAFM-type multimode SPM unit, manufactured by Veeco) by taking advantage of a difference in viscoelasticity and adherence by a phase image in a tapping mode.

The content of the shell is not particularly limited and may be properly selected according to purposes. The content of the shell, however, is preferably 0.5 part by mass to 5 parts by mass, more preferably 1 part by mass to 4 parts by mass, based on 100 parts by mass of the toner. When the content of the shell is less than 0.5 part by mass, the spacer effect is unsatisfactory and, consequently, non-electrostatic attractive force of the toner particles cannot be sometimes reduced. On the other hand, a shell content of more than 5 parts by mass is disadvantageous in that the toner suffers from deteriorated flowability that inhibits even transfer; and the material (for example, fine particles of the acrylic resin) constituting the shell cannot be satisfactorily immobilized on the toner, is likely to be separated, and is adhered on a carrier, a photoconductor and the like, sometimes resulting in contamination of the photoconductor and the like.

The shell and the amorphous polyester resin A are preferably incompatible with each other because the shell can easily be immobilized on the surface of the toner in the emulsification in the production of the toner.

The shell and the amorphous polyester resin B are preferably incompatible with each other because the shell can easily be immobilized on the surface of the toner in the emulsification in the production of the toner.

The shell and the crystalline polyester resin C are preferably incompatible with each other because the shell can easily be immobilized on the surface of the toner in the emulsification in the production of the toner.

In the present invention, the expression the shell and the resin are "incompatible" with each other means that, when the shell is adhered to emulsion droplets of the toner material, the shell is not dissolved in the resin in the toner material. Whether the shell and the resin are "imcompatible" with each other can be determined by a method described hereinafter, that includes mixing the shell (for example, fine particles of the acrylic resin) in a polyester resin solution and visually confirming whether separation occurs.

Preferably, the toner has a glass transition temperature (Tg1st) of 20° C. to 40° C. at a first temperature rise in the differential scanning calorimetry (DSC).

In conventional toners, when Tg is about 50° C. or below, agglomeration of toners is likely to occur due to a temperature change during transportation and in a storage environment intended for use in summer or in tropical regions. As a result, solidification in toner bottles and adherence of the toner within the developing machine occur. Further, a supply failure due to toner clogging within toner bottles and abnormal images due to adherence of the toner within the developing machine are likely to occur.

Even when Tg of the toner of the present invention is below Tg of the conventional toner, the toner can hold the heat-resistant storage property because the amorphous polyester resin A that is a low-Tg component in the toner is nonlinear. In particular, when the amorphous polyester resin A has a urethane bond or a urea bond having a high cohesive force, the effect of holding the heat-resistant storage property is more significant.

When Tg1st is below 20° C., a lowering in heat-resistant storage property, blocking within the developing machine, and filming on the photoconductor sometimes occur. On the other hand, when Tg1st is above 40° C., the low-temperature fixability of the toner is sometimes lowered.

In the differential scanning calorimetry (DSC) of the toner, the difference between the glass transition temperature (Tg1st) at the first temperature rise and the glass transition temperature (Tg2nd) at the second temperature rise, that is, Tg1st-Tg2nd, is not particularly limited and may be properly selected according to purposes. The difference, however, is preferably 10° C. or above. The upper limit of the difference is not particularly limited and may be properly selected according to purposes. The upper limit of the difference, however, is preferably 50° C. or below.

A difference of 10° C. or above is advantageous in that the low-temperature fixability is better. The expression "difference of 10° C. or above" means that, for example, the crystalline polyester resin C, the amorphous polyester resin A, and the amorphous polyester resin B, which are present in a incompatible state before heating (before the first temperature rise) are compatible with each other after heating (after the first temperature rise). It is not necessary that the compatible state after heating is a completely compatible state.

The volume average particle diameter of the toner is not particularly limited and may be properly selected according to purposes. The volume average particle diameter, however, is preferably 3 μm to 7 μm. The ratio of the volume average particle diameter to the number average particle diameter is preferably 1.2 or less. Further, preferably, the content of a component having a volume average particle diameter of 2 μm or less is 1% by number to 10% by number.

<Method for Calculation and Method for Analysis of Various Properties of Toner and Toner Constituents>

The SP value, Tg, acid value, hydroxyl value, molecular weight, and melting point of the amorphous polyester resin A, the amorphous polyester resin B, the crystalline polyester resin C, and the releasing agent may be measured using these resins and releasing agent per se. Alternatively, a method may be adopted in which individual components are separated from an actual toner, for example, by gel permeation chromatography (GPC) and analyzing the separated components by analytical methods described hereinafter to calculate SP value, Tg, molecular weight, melting point, and mass ratio of constituents.

The separation of individual components by GPC can be carried out by the following method.

In GPC measurement using THF (tetrahydrofuran) as a mobile phase, an eluate is fractionated by a fraction collector or the like, and fractions corresponding to a desired molecular weight portion in a total area in an elution curve are combined.

The combined eluate is concentrated and dried by an evaporator. The solid matter is then dissolved in a heavy solvent such as heavy chloroform or heavy THF, and the resultant solution is subjected to $^{1}$H-NMR measurement, and the constituent monomer ratio of the resin in the eluted component is calculated from the integration ratio of the elements.

According to another method, the constituent monomer ratio is calculated by concentrating an eluate, then hydrolyzing the concentrate with sodium hydroxide or the like, and qualitatively and quantitatively analyzing the hydrolyzate by high-performance liquid chromatography (HPLC) or the like.

In the production process of the toner, when toner mother particles are formed while producing the amorphous polyester resin A by an extension reaction and/or a crosslinking reaction between the nonlinear reactive precursor and the curing agent, a method may be adopted in which separation is carried out from the actual toner by GPC or the like and Tg of the amorphous polyester resin A is determined. Alternatively, a method may be adopted in which the amorphous polyester resin A is synthesized by an extension reaction and/or a crosslinking reaction between the nonlinear reactive precursor and the curing agent and Tg and the like are measured from the synthesized amorphous polyester resin A.

<<Method for Separating Toner Constituents>>

One example of a method for separating individual components in the analysis of a toner will be described in detail.

At the outset, 1 g of the toner is introduced into 100 mL of THF, and a solution with solubles dissolved therein is obtained while stirring for 30 min at 25° C.

The solution is filtered through a membrane filter having an opening of 0.2 μm to obtain THF solubles in the toner.

Subsequently, the THF solubles are dissolved in THF to prepare a sample for GPC measurement, and the sample is injected into GPC for use in the measurement of the molecular weight of the individual resins.

On the other hand, a fraction collector is placed at an eluate discharge port of GPC. Eluates are fractionated for each predetermined count, and an eluate is obtained from the start of elution of an elution curve (rise in curve) for each 5% of the percentage area.

Subsequently, for each eluate, 30 mg of the sample is dissolved in 1 mL of deuterochloroform, and 0.05% by volume of tetramethylsilane (TMS) is added as a reference substance.

The solution is filled into a glass tube having a diameter of 5 mm for NMR measurement, and integration is carried out 128 times with a nuclear magnetic resonance apparatus (manufactured by Japan Electro Optical Laboratory, JNM-AL400) at a temperature of 23° C. to 25° C. to obtain a spectrum.

The monomer composition and constituent ratio of the amorphous polyester resin A, the amorphous polyester resin B, the crystalline polyester resin C and the like can be determined from the peak integration ratio of the spectrum.

For example, peak attribution is carried out as follows, and the constituent ratio of constituent monomers is determined from the integration ratios.

Peak attribution may be, for example, as follows.

Around 8.25 ppm: derived from benzene ring in trimellitic acid (corresponding to one hydrogen atom)

Around 8.07 ppm to 8.10 ppm: derived from benzene ring of terephthalic acid (corresponding to four hydrogen atoms)

Around 7.1 ppm to 7.25 ppm: derived from benzene ring of bisphenol A (corresponding to four hydrogen atoms)

Around 6.8 ppm: derived from benzene ring of bisphenol A (corresponding to four hydrogen atoms) and derived from double bond of fumaric acid (corresponding to two hydrogen atoms)

Around 5.2 ppm to 5.4 ppm: derived from methine in propylene oxide adduct of bisphenol A (corresponding to one hydrogen atom)

Around 3.7 ppm to 4.7 ppm: derived from methylene in propylene oxide adduct of bisphenol A (corresponding to two hydrogen atoms) and derived from methylene in ethylene oxide adduct of bisphenol A (corresponding to four hydrogen atoms)

Around 1.6 ppm: derived from methyl group in bisphenol A (corresponding to six hydrogen atoms)

From these results, for example, an extract recovered in a fraction, 90% by mass or more of which is accounted for by the amorphous polyester resin A can be regarded as the amorphous polyester resin A. Likewise, an extract recovered in a fraction, 90% by mass or more of which is accounted for by the amorphous polyester resin B can be regarded as the amorphous polyester resin B. An extract recovered in a fraction, 90% by mass or more of which is accounted for by the crystalline polyester resin C can be regarded as the crystalline polyester resin C.

<<Method for Measuring Hydroxyl Value of Resin>>

The hydroxyl value of the resin can be measured by a method according to JIS K 0070-1966.

Specifically, at the outset, 0.5 g of a sample is accurately weighed in a 100 mL measuring flask, and 5 mL of an acetylation reagent is then added thereto. The measuring flask is then heated for 1 hr to 2 hr in a hot water bath set to 100±5° C., is then taken out from the hot water bath, and is allowed to cool. Further, water is added to the measuring flask, followed by shaking to decompose acetic anhydride. In order to completely decompose acetic anhydride, the flask is again heated in the hot water bath for 10 min or longer and is then allowed to cool. Thereafter, the wall of the flask is thoroughly washed with an organic solvent.

The hydroxyl value is measured at 23° C. with a potentiometric automatic titrator DL-53 (manufactured by Metller-Toledo International Inc.) and an electrode DG113-SC (manufactured by Metller-Toledo International Inc.). The measurements are analyzed with an analysis software LabX Light Version 1.00.000. A mixed solvent composed of 120 mL of toluene and 30 mL of ethanol is used for the calibration of the apparatus.

Conditions for the measurement are as follows.

| (Conditions for measurement) | |
|---|---|
| Stir | |
| Speed [%] | 25 |
| Time [s] | 15 |
| EQP titration Titrant/Sensor | |
| Titrant | $CH_3ONa$ |
| Concentration [mol/L] | 0.1 |
| Sensor | DG115 |
| Unit of measurement | mV |
| Predispensing to volume | |
| Volume [mL] | 1.0 |
| Wait time [s] | 0 |
| Titrant addition | Dynamic |
| dE (set) [mV] | 8.0 |
| dV (min) [mL] | 0.03 |
| dV (max) [mL] | 0.5 |
| Measure mode | Equilibrium controlled |
| dE[mV] | 0.5 |
| dt [s] | 1.0 |
| t (min) [s] | 2.0 |
| t (max) [s] | 20.0 |
| Recognition | |
| Threshold | 100.0 |
| Steepest jump only | No |
| Range | No |
| Tendency | None |
| Termination | |
| at maximum volume [mL] | 10.0 |
| at potential | No |
| at slope | No |

-continued

| (Conditions for measurement) | |
|---|---|
| after number EQPs | Yes |
| n = 1 | |
| comb. termination conditions | No |
| Evaluation | |
| Procedure | Standard |
| Potential1 | No |
| Potential2 | No |
| Stop for reevaluation | No |

<<Method for Measuring Acid Value of Resin>>

The acid value can be measured by a method according to JIS K 0070-1992.

Specifically, at the outset, 0.5 g of a sample (ethyl acetate solubles: 0.3 g) is added to 120 mL of toluene, and the mixture is stirred at 23° C. for about 10 hr for dissolution. Ethanol (30 mL) is then added thereto to prepare a sample solution. When the sample is not dissolved in this solvent, dioxane, tetrahydrofuran or other solvent is used. The acid value is then measured at 23° C. with a potentiometric automatic titrator DL-53 (manufactured by Metller-Toledo International Inc.) and an electrode DG113-SC (manufactured by Metller-Toledo International Inc.). The measurements are analyzed with an analysis software LabX Light Version 1.00.000. A mixed solvent composed of 120 mL of toluene and 30 mL of ethanol is used for the calibration of the apparatus.

Conditions for the measurement are the same as those for the measurement of the hydroxyl value.

The acid value can be measured as described above. Specifically, titration is carried out with a pre-standardized 0.1N potassium hydroxide/alcohol solution, and the acid value is then calculated from the titer by the following equation: acid value (KOH mg/g)=titer (mL)×N×56.1 (mg/mL)/sample (g) wherein N is a factor of 0.1N potassium hydroxide/alcohol solution.

<<Methods for Measuring Melting Point and Glass Transition Temperature (Tg) of Resin and Releasing Agent>>

The melting point and the glass transition temperature (Tg) of resins in the present invention and releasing agents can be measured, for example, with a DSC system (a differential scanning calorimeter) ("Q-200," manufactured by TA Instruments).

Specifically, the melting point and the glass transition temperature of an object sample can be measured according to the following procedure.

At the outset, about 5.0 mg of an object sample is placed in an aluminum sample container. The sample container is placed on a holder unit and set in an electric furnace. The sample container is then heated in a nitrogen atmosphere from −80° C. to 150° C. at a temperature rise rate of 10° C./min (first temperature rise). Thereafter, the sample container is cooled from 150° C. to −80° C. at a temperature fall rate of 10° C./min and is then heated to 150° C. at a temperature rise rate of 10° C./min (second temperature rise). In each of the first temperature rise and the second temperature rise, a DSC curve is measured with a differential scanning calorimeter ("Q-200," manufactured by TA Instruments).

The glass transition temperature at the first temperature rise of the object sample can be determined from the DSC curve at the first temperature rise selected from the obtained DSC curves with an analysis program in the Q-200 system.

Likewise, the glass transition temperature at the second temperature rise of the object sample can be determined from the DSC curve at the second temperature rise selected from the obtained DSC curves.

The endothermic peak top temperature at the first temperature rise of the object sample can be determined as a melting point from the DSC curve at the first temperature rise selected from the obtained DSC curves with an analysis program in the Q-200 system. Likewise, the endothermic peak top temperature at the second temperature rise of the object sample can be determined as a melting point from the DSC curve at the second temperature rise selected from the obtained DSC curves.

In the present specification, the glass transition temperature of a toner as the object sample at the first temperature rise is defined as Test, and the glass transition temperature at the second temperature rise is defined as Tg2nd.

Further, in the present specification, for the glass transition temperature and the melting point of the amorphous polyester resin A, the amorphous polyester resin B, and the crystalline polyester resin C, and other constituents such as releasing agents, the endothermic peak top temperature and Tg at the second temperature rise are regarded as the melting point and Tg of each object sample, unless otherwise specified.

<<Method for Measuring Particle Size Distribution>>

The volume average particle diameter ($D_4$), the number average particle diameter ($D_n$), and the ratio ($D_4/D_n$) of the toner can be measured, for example, with Coulter COULTER COUNTER TA-II and Coulter MULTISIZER II (both the products being manufactured by Beckman Coulter, Inc.). In the present invention, the Coulter MULTISIZER II is used. The measurement method will be described.

Specifically, at the outset, 0.1 mL to 5 mL of a surfactant, preferably a polyoxyethylene alkyl ether (a nonionic surfactant), is added as a dispersant to 100 mL to 150 mL of an electrolysis solution. The electrolysis solution is a 1% (by mass) aqueous NaCl solution prepared using primary sodium chloride. For example, ISOTON-II (manufactured by Beckman Coulter, Inc.) can be used as the electrolysis solution. Subsequently, 2 mg to 20 mg of a measurement sample is added thereto. The aqueous electrolysis solution with the sample suspended therein is dispersed with an ultrasonic disperser for about 1 min to about 3 min. The volume and the number of the toner particles or the toner are measured with the above apparatus using an aperture of 100 μm, and the volume distribution and the distribution of the number of particles are calculated. The volume average particle diameter ($D_4$) and the number average particle diameter (Do) can be determined from the distributions thus obtained.

The following 13 channels are used: 2.00 μm to less than 2.52 μm; 2.52 μm to less than 3.17 μm; 3.17 μm to less than 4.00 μm; 4.00 μm to less than 5.04 μm; 5.04 μm to less than 6.35 μm; 6.35 μm to less than 8.00 μm; 8.00 μm to less than 10.08 μm; 10.08 μm to less than 12.70 μm; 12.70 μm to less than 16.00 μm; 16.00 μm to less than 20.20 μm; 20.20 μm to less than 25.40 μm; 25.40 μm to less than 32.00 μm; and 32.00 μm to less than 40.30 μm. That is, particles having particle diameters of 2.00 μm to less than 40.30 μm are used.

<Measurement of Molecular Weight>

The molecular weight of the constituents of the toner can be measured, for example, by the following method.

Gel permeation chromatography (GPC) measuring apparatus: GPC-8220GPC (manufactured by TOSOH CORPORATION)

Column: TSKgel, SuperHZM-H, 15 cm, triple (manufactured by TOSOH CORPORATION)

Temp.: 40° C.

Solvent: Tetrahydrofuran (THF)

Flow rate: 0.35 mL/min

Sample: 0.4 mL of sample (0.15% by mass) was injected.

Pretreatment of sample: The sample (0.15% by mass) was dissolved in tetrahydrofuran (THF, stabilizer incorporated, manufactured by Wako Pure Chemical Industries, Ltd.), the solution is filtered through a 0.2-μm filter, and the filtrate is used as the measurement sample. The THF sample solution (100 μL) is injected for the measurement. In the measurement of the molecular weight of the sample, the molecular weight distribution of the sample is calculated from a relationship between logarithmic values and counts in a calibration curve prepared using several types of monodispersed polystyrene standard samples. Std. No S-7300, S-210, S-390, S-875, S-1980, S-10.9, S-629, S-3.0, and S-0.580 in ShowdexSTANDARD manufactured by Showa Denko K.K. are used as standard polystyrene samples for the calibration curve. An RI (refractive index) detector is used as the detector.

<Process for Producing Toner>

The toner may be produced by any process without particular limitation as long as the resultant toner has a storage modulus of $1.0\times10^7$ Pa or more at 50° C., a loss modulus of $8.0\times10^4$ Pa to $2.0\times10^5$ Pa at 80° C., and a loss modulus of $2.0\times10^2$ Pa to $1.0\times10^3$ Pa at 160° C. The process may be properly selected according to purposes. Preferably, an oil phase containing a toner material including the amorphous polyester resin A, the crystalline polyester resin C, and the colorant and preferably the amorphous polyester resin B and optionally the releasing agent and the like is dispersed in an aqueous medium for granulation.

Preferably, for the toner, an oil phase containing a toner material including the nonlinear reactive precursor, the crystalline polyester resin C, and the colorant and preferably the amorphous polyester resin B and optionally the curing agent, the releasing agent and the like is dispersed in an aqueous medium for granulation.

A publicly known dissolution suspension method may be mentioned as one example of production processes of the toner.

A process that includes forming toner mother particles while producing the amorphous polyester resin A by an extension reaction and/or a crosslinking reaction between the nonlinear reactive precursor and the curing agent will be described as one example of the production process of the toner. This process involves the preparation of an aqueous medium, the preparation of an oil phase containing a toner material, emulsification or dispersion of the toner material, the removal of an organic solvent, and heating.

<<Preparation of Oil Phase>>

The preparation of the oil phase containing a toner material can be carried out by dissolving or dispersing a toner material containing at least the nonlinear reactive precursor, the crystalline polyester resin C, and the colorant and preferably the amorphous polyester resin B and optionally the curing agent, the releasing agent and the like in an organic solvent.

The organic solvent is not particularly limited and may be properly selected according to purposes. The organic solvent, however, is preferably an organic solvent having a boiling point below 150° C. because this organic solvent can easily be removed.

The organic solvent having a boiling point below 150° C. is not particularly limited and may be properly selected according to purposes. Examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. They may be used solely or in a combination of two or more of them.

Among them, ethyl acetate, toluene, xylene, benzene, methylene chloride, 1,2-dichloroethane, chloroform, and carbon tetrachloride are preferred, and ethyl acetate is more preferred.

<<Preparation of Aqueous Medium Phase (Aqueous Phase)>>

The aqueous medium phase can be prepared, for example, by dispersing fine particles of an acrylic resin in an aqueous medium and further, if necessary, dispersing fine particles of styrene/acrylic resin in the aqueous medium. The addition amount of the acrylic resin particles in an aqueous medium is not particularly limited and may be properly selected according to purposes. The addition amount is preferably 0.5 part by mass to 10 parts by mass based on 100 parts by mass of the aqueous medium.

When the aqueous medium phase contains the fine particles of the acrylic resin, a toner having a core-shell structure can be produced.

The aqueous medium is not particularly limited and may be properly selected according to purposes. Examples thereof include water, solvents miscible with water, and mixtures thereof. They may be used solely or in a combination of two or more of them.

Among them, water is preferred.

The solvent miscible with water is not particularly limited and may be properly selected according to purposes. Examples thereof include alcohols, dimethylformamide, tetrahydrofuran, cellosolves, and lower ketones. The alcohols are not particularly limited and may be properly selected according to purposes. Examples thereof include methanol, isopropanol, and ethylene glycol. The lower ketones are not particularly limited and may be properly selected according to purposes. Examples thereof include acetone and methyl ethyl ketone.

The aqueous medium phase can be prepared by dispersing the fine particles of styrene/acrylic resin in the aqueous medium in the presence of an anionic surfactant.

The amount of the anionic surfactant and the fine particles of styrene/acrylic resin added to the aqueous medium is not particularly limited and may be properly selected according to purposes. The addition amount, however, is preferably 0.5% by mass to 10% by mass based on the aqueous medium.

Thereafter, the fine particles of the acrylic resin are added to the aqueous medium. When the fine particles of the acrylic resin are likely to be aggregated with the anionic surfactant, preferably, the aqueous medium is dispersed with a high-speed shearing disperser before the emulsification.

The anionic surfactant is not particularly limited and may be properly selected according to purposes. Examples thereof include fatty acid salts, alkyl sulfuric ester salts, alkyl aryl sulfonic acid salts, alkyl diaryl ether disulfonic acid salts, dialkyl sulfosuccinic acid salts, alkyl phosphoric acid salts, naphthalene sulfonic acid-formalin condensate, polyoxyethylene alkyl phosphoric acid ester salts, and glycerol borate fatty acid esters.

Any fine particles of styrene/acrylic resin that are different from the fine particles of the acrylic resin and contain styrene as a constituent may be used without particular limitation and the fine particles of styrene/acrylic resin may be properly selected according to purposes. The volume average particle diameter, however, is preferably 5 nm to 50 nm. Preferably, the volume average particle diameter of the fine particles of styrene/acrylic resin is smaller than that of the fine particles of the acrylic resin.

Preferably, the fine particles of the acrylic resin can form an agglomerate in an aqueous medium containing the anionic surfactant. In the production process of the toner, it is not favorable that, when the fine particles of the acrylic resin are added to the aqueous medium, the fine particles of the acrylic resin are not adhered to liquid droplets of the toner material and are independently stably present. When the fine particles of the acrylic resin can form an agglomerate in an aqueous medium containing the anionic surfactant, the fine particles of the acrylic resin that have been present on the aqueous medium phase side during or after emulsification or dispersion are moved to the surface of liquid droplets of the toner material and can easily be adhered to the surface of liquid droplets of the toner material. In the aqueous medium containing the anionic surfactant, the fine particles of the acrylic resin are unstable and are generally agglomerated. On the other hand, in the presence of liquid droplets of the toner material, composites of dissimilar particles are formed when the attractive force between the fine particles of the acrylic resin and the liquid droplets of the toner material is strong.

<<Emulsification or Dispersion>>

The emulsification or dispersion of the toner material can be carried out by dispersing an oil phase containing the toner material in the aqueous medium. The amorphous polyester resin A is produced by subjecting the curing agent and the nonlinear reactive precursor to an extension reaction and/or a crosslinking reaction in the emulsification or dispersion of the toner material.

The amorphous polyester resin A can be produced, for example, by the following methods (1) to (3).

(1) A method that includes emulsifying or dispersing an oil phase containing the nonlinear reactive precursor and the curing agent in an aqueous medium and subjecting the curing agent and the nonlinear reactive precursor to an extension reaction and/or a crosslinking reaction in an aqueous medium to produce the amorphous polyester resin A.

(2) A method that includes emulsifying or dispersing an oil phase containing the nonlinear reactive precursor in an aqueous medium to which the curing agent has been previously added and subjecting the curing agent and the nonlinear reactive precursor to an extension reaction and/or a crosslinking reaction in an aqueous medium to produce the amorphous polyester resin A.

(3) A method that includes emulsifying or dispersing an oil phase containing the nonlinear reactive precursor in an aqueous medium, then adding the curing agent to the aqueous medium, and subjecting the curing agent and the nonlinear reactive precursor to an extension reaction and/or a crosslinking reaction from a particle boundary in an aqueous medium to produce the amorphous polyester resin A.

When the curing agent and the nonlinear reactive precursor are subjected to an extension reaction and/or a crosslinking reaction from a particle boundary, the amorphous polyester resin A is formed preferentially on the surface of the produced toner and the gradient of concentration of the amorphous polyester resin A can be provided in the toner.

Conditions for a reaction for producing the amorphous polyester resin A (reaction time and reaction temperature)

are not particularly limited and may be properly selected according to a combination of the curing agent with the nonlinear reactive precursor.

The reaction time is not particularly limited and may be properly selected according to purposes. The reaction time, however, is preferably 10 min to 40 hr, more preferably 2 hr to 24 hr.

The reaction temperature is not particularly limited and may be properly selected according to purposes. The reaction temperature, however, is preferably 0° C. to 150° C., more preferably 40° C. to 98° C.

Any method may be used for stably forming a dispersion containing the nonlinear reactive precursor in the aqueous medium without particular limitation, and the method may be properly selected according to purposes. An example thereof is a method that includes adding, to an aqueous medium phase, an oil phase prepared by dissolving or dispersing a toner material, followed by dispersion through the action of shearing force.

The disperser for the dispersion is not particularly limited and may be properly selected according to purposes. Examples thereof include low-speed shearing dispersers, high-speed shearing dispersers, frictional dispersers, high-pressure jet dispersers, and ultrasonic dispersers.

Among them, high-speed shearing dispersers are preferred because the particle diameter of the dispersion (oil droplets) can be regulated to 2 μm to 20 μm.

When the high-speed shearing dispersers are used, conditions such as rotation speed, dispersion time, and dispersion temperature may be properly selected according to purposes.

The rotation speed is not particularly limited and may be properly selected according to purposes. The rotation speed, however, is preferably 1,000 rpm to 30,000 rpm, more preferably 5,000 rpm to 20,000 rpm.

The dispersion time is not particularly limited and may be properly selected according to purposes. The dispersion time, however, is preferably 0.1 min to 5 min when batch dispersion is adopted.

The dispersion temperature is not particularly limited and may be properly selected according to purposes. The dispersion temperate, however, is preferably 0° C. to 150° C., more preferably 40° C. to 98° C., under pressure. In general, the higher the dispersion temperature is, the easier the dispersion.

The amount of the aqueous medium used in the emulsification or dispersion of the toner material is not particularly limited and may be properly selected according to purposes. The amount of the aqueous medium used, however, is preferably 50 parts by mass to 2,000 parts by mass, more preferably 100 parts by mass to 1,000 parts by mass, based on 100 parts by mass of the toner material.

When the amount of the aqueous medium used is less than 50 parts by mass, the dispersion state of the toner material is deteriorated and, consequently, toner mother particles having a predetermined particle diameter cannot be sometimes obtained. On the other hand, when the amount of the aqueous medium used is more than 2,000 parts by mass, the production cost is sometimes increased.

A catalyst can be used for the extension reaction and/or the crosslinking reaction for production of the amorphous polyester resin A.

The catalyst is not particularly limited and may be properly selected according to purposes. Examples thereof include dibutyl tin laurate and dioctyl tin laurate.

<<Removal of Organic Solvent>>

The organic solvent may be removed from the dispersion such as the emulsion slurry by any method without particular limitation and the method may be properly selected according to purposes. Examples thereof include a method in which the temperature of the whole reaction system is gradually raised to evaporate the organic solvent in the oil droplets, and a method in which the dispersion is sprayed into a drying atmosphere to remove the organic solvent in the oil droplets.

<<Heating>>

The heating method is not particularly limited and may be properly selected according to purposes. Examples thereof include (1) a method in which heat treatment is carried out in a static state and (2) a method in which heat treatment is carried out with stirring. When heating is carried out, toner particles having a smooth surface are formed. When the toner particles are dispersed in ion-exchanged water, the heating may be carried out before or after washing.

The heating temperature is not particularly limited and may be properly selected according to purposes. The heating temperature, however, is above the glass transition temperature of various resins used in the production of the toner.

The heating step can allow the fine particles of the acrylic resin to be strongly immobilized on the surface of the toner.

When the toner is produced through the heating step, toner mother particles can be obtained that have a core-shell structure including: a core that is a toner particle body containing the amorphous polyester resin A, the amorphous polyester resin B, the crystalline polyester resin C, and the colorant; and a shell that is adhered to the surface of the core and is formed of the fine particles of the acrylic resin.

The toner mother particles may be subjected to washing, drying and the like. Further, classification and the like may be carried out. The classification may be carried out by removing fine particles in a liquid, for example, by cyclone, decantation, or centrifugation. Alternatively, the classification may be carried out after drying.

The toner mother particles may be mixed with particles of the external additives, charge control agents and the like. In the mixing, when a mechanical impact is applied, the desorption of particles of the external additives and the like from the surface of the toner mother particles can be suppressed.

The mechanical impact may be applied by any method without particular limitation and may be properly selected according to purposes. Examples thereof include a method that includes applying an impact to a mixture with a high-speed rotating blade and a method that includes introducing a mixture into a high-speed gas stream and accelerating the gas stream to allow the particles to collide against one another or the particles to collide against a proper collision plate.

Any apparatus may be used for the method without particular limitation, and the apparatus may be properly selected according to purposes. Examples thereof include ANGMILL (manufactured by Hosokawa Micron Corporation), an apparatus manufactured by modifying an I-type mill (manufactured by Nippon Pneumatic Mfg. Co., Ltd.) so that a pulverizing air pressure is lowered, a hybridization system (manufactured by Nara Machinery Co., Ltd.), a kryptron system (manufactured by Kawasaki Heavy Industries, Ltd.), and an automatic mortar.

(Developer)

The developer according to the present invention includes at least the toner according to the present invention and optionally properly selected other components such as carriers.

By virtue of this constitution, the developer excels in transferability and electrification characteristics and the like and can stably form high-quality images. The developer may be a one-component developer or two-component developer. When the developer is used, for example, in high-speed printers that can meet a recent requirement for an increased information processing speed, the use of the two-component developer is preferred because the service life can be improved.

The use of the developer as the one-component developer is advantageous in that, even when a toner balance is carried out, a variation in the particle diameter of the toner in the developer is reduced; and filming of the toner on the development roller and fusion of the toner on members such as blades for the formation of a thin layer of the toner are less likely to occur; and good and stable developing properties and images can be obtained even in long-term stirring in the developing apparatus.

The use of the developer as the two-component developer is advantageous in that, even when a toner balance is carried out for a long period of time, a variation in the particle diameter of the toner in the developer is reduced, and good and stable developing properties and images can be obtained even in long-term stirring in the developing apparatus.

<Carrier>

The carrier is not particularly limited and may be properly selected according to purposes. Preferably, however, the carrier includes a core and a resin layer that covers the core.

—Core—

The core may be formed of any material without particular limitation, and the core material may be properly selected according to purposes. Examples thereof include manganese-strontium materials (50 emu/g to 90 emu/g) or manganese-magnesium materials (50 emu/g to 90 emu/g). The use of high magnetization materials such as iron powders (100 emu/g or more) or magnetites (75 emu/g to 120 emu/g) is preferred from the viewpoint of ensuring image density. Further, low magnetization materials such as copper-zinc (30 emu/g to 80 emu/g) is preferred because impact of the developer, which stands upright, against the photoconductor can be relaxed and an increased image quality can be advantageously obtained.

They may be used solely or in a combination of two or more of them.

The volume average particle diameter of the core is not particularly limited and may be properly selected according to purposes. The volume average particle diameter of the core, however, is preferably 10 μm to 150 μm, more preferably 40 μm to 100 μm. When the volume average particle diameter is less than 10 μm, the amount of fine powder in the carrier is increased and the magnetization per particle is lowered, sometimes leading to scattering of the carrier. When the volume average particle diameter is more than 150 μm, the specific surface area is lowered and scattering of the toner sometimes occurs. In full color having a large blotted area, the reproduction of the blotted area is sometimes particularly deteriorated.

When the toner is used in the two-component developer, the toner may be mixed with the carrier. The content of the carrier in the two-component developer is not particularly limited and may be properly selected according to purposes. The content of the carrier in the two-component developer, however, is preferably 90 parts by mass to 98 parts by mass, more preferably 93 parts by mass to 97 parts by mass based on 100 parts by mass of the two-component developer.

(Color Toner Set)

The color toner set according to the present invention contains two or more selected from the group consisting of: a yellow toner which is the toner of the present invention containing the yellow pigment; a magenta toner which is the toner of the present invention containing the magenta pigment; and a cyan toner which is the toner of the present invention containing the cyan pigment, and optionally contains other components such as a black toner.

The term "color toner set" as used herein refers to a set of a plurality of chromatic color toners to be used in combination with a view to supplying toner to an electrophotographic full-color image forming apparatus.

<Yellow Toner>

The yellow toner is the toner according to the present invention containing a yellow pigment. The yellow pigment is not particularly limited and may be properly selected according to purposes. Examples thereof include yellow pigments exemplified above in the description of the toner according to the present invention.

<Magenta Toner>

The magenta toner is the toner according to the present invention containing a magenta pigment. The magenta pigment is not particularly limited and may be properly selected according to purposes. Examples thereof include magenta pigments described above in the description of the toner according to the present invention.

<Cyan Toner>

The cyan toner is the toner according to the present invention containing a cyan pigment. The cyan pigment is not particularly limited and may be properly selected according to purposes. Examples thereof include cyan pigments described above in the description of the toner according to the present invention.

In the color toner set, preferably, at least any one of the magenta toner and the cyan toner contains a fluorescent brightening agent from the viewpoint of improving chroma.

Further, in the color toner set, more preferably, only the magenta toner contains a fluorescent brightening agent from the viewpoint of suppressing a shift of hue angle.

The fluorescent brightening agent is not particularly limited and may be properly selected according to purposes. Examples thereof include fluorescent brightening agents exemplified above in the description of the toner according to the present invention.

The content of the fluorescent brightening agent in the yellow toner, the magenta toner, the cyan toner is not particularly limited and may be properly selected according to purposes. The content of the fluorescent brightening agent, however, is preferably 0.01 parts by mass to 1.0 part by mass, more preferably 0.01 parts by mass to 0.5 parts by mass, particularly preferably 0.01 parts by mass to 0.02 parts by mass, based on 100 parts by mass of the toner. When the content of the fluorescent brightening agent is less than 0.01 parts by mass, light (color development) on short wavelength side is unsatisfactory and, consequently, chroma is sometimes unsatisfactory. When the content of the fluorescent brightening agent is more than 1.0 part by mass, light (color development) on the short wavelength side is supplemented beyond necessary. As a result, the hue angle is shifted and, consequently, the color reproducibility is sometimes lowered. When the content of the fluorescent brightening agent is in the above particularly preferred range, a satisfactory chroma can be advantageously ensured while suppressing a shift of the hue angle.

EXAMPLES

The present invention will next be described by way of Examples. However, it should be noted that the present invention is not limited to the following Examples. Unless otherwise specified, the unit "part(s)" is "part(s) by mass" and "%" is "% by mass."

At the outset, methods for measuring various property values will be described. The results of measurements are shown in Tables 1-1 to 1-3 and 2-1 to 2-6.

<Method for Measuring Melting Point (mp) and Glass Transition Temperature (Tg)>

The melting point (mp) and the glass transition temperature (Tg) were measured with a DSC system (a differential scanning calorimeter) ("Q-200," manufactured by TA Instruments).

Specifically, the melting point and the glass transition temperature of an object sample were measured according to the following procedure.

At the outset, about 5.0 mg of an object sample was placed in an aluminum sample container. The sample container was placed on a holder unit and set in an electric furnace. The sample container was then heated in a nitrogen atmosphere from −80° C. to 150° C. at a temperature rise rate of 10° C./min (first temperature rise). Thereafter, the sample container was cooled from 150° C. to −80° C. at a temperature fall rate of 10° C./min and was then heated to 150° C. at a temperature rise rate of 10° C./rain (second temperature rise). In each of the first temperature rise and the second temperature rise, a DSC curve was measured with a differential scanning calorimeter ("Q-200," manufactured by TA Instruments).

The glass transition temperature at the first temperature rise of the object sample was determined from the DSC curve at the first temperature rise selected from the obtained DSC curves with an analysis program in the Q-200 system. Likewise, the glass transition temperature at the second temperature rise of the object sample was determined from the DSC curve at the second temperature rise selected from the obtained DSC curves.

The endothermic peak top temperature at the first temperature rise of the object sample was determined as a melting point from the DSC curve at the first temperature rise selected from the obtained DSC curves with an analysis program in the Q-200 system. Likewise, the endothermic peak top temperature at the second temperature rise of the object sample was determined as a melting point from the DSC curve at the second temperature rise selected from the obtained DSC curves.

The glass transition temperature of a toner as the object sample at the first temperature rise was defined as Tg1st, and the glass transition temperature at the second temperature rise was defined as Tg2nd.

For the glass transition temperature and the melting point of the amorphous polyester resin A, the amorphous polyester resin B, and the crystalline polyester resin C, and the releasing agent, the endothermic peak top temperature and Tg at the second temperature rise were regarded as the melting point and Tg of each object sample.

<<Measurement of Weight Average Molecular Weight (Mw)>>

The weight average molecular weight (Mw) of the constituents of the toner was measured by the following method.

Gel permeation chromatography (GPC) measuring apparatus: GPC-8220GPC (manufactured by TOSOH CORPORATION)

Column: TSKgel, SuperHZM-H, 15 cm, triple (manufactured by TOSOH CORPORATION)

Temp.: 40° C.

Solvent: Tetrahydrofuran (THF)

Flow rate: 0.35 mL/min

Sample: 0.4 mL of sample (0.15% by mass) was injected.

Pretreatment of sample: The sample (0.15% by mass) was dissolved in tetrahydrofuran (THF, stabilizer incorporated, manufactured by Wako Pure Chemical Industries, Ltd.), the solution was filtered through a 0.2-μm filter, and the filtrate was used as the measurement sample. The THF sample solution (100 μL) was injected for the measurement. In the measurement of the molecular weight of the sample, the molecular weight distribution of the sample was calculated from a relationship between logarithmic values and counts in a calibration curve prepared using several types of monodispersed polystyrene standard samples. Std. No S-7300, S-210, S-390, S-875, S-1980, S-10.9, S-629, S-3.0, and S-0.580 in ShowdexSTANDARD manufactured by Showa Denko K.K. were used as standard polystyrene samples for the calibration curve. An RI (refractive index) detector was used as the detector.

<Method for Measuring Storage Modulus G' and Loss Modulus G" of Toner>

The storage modulus (G') and loss modulus (G") of the toner were measured with a dynamic viscoelasticity measuring device (ARES, manufactured by TA Instruments). The frequency in the measurement is 1 Hz.

Specifically, the storage modulus and the loss modulus were measured by molding a measurement sample into a pellet having a diameter of 8 mm and a thickness of 1 mm to 2 mm, fixing the pellet in a parallel plate having a diameter of 8 mm, then stabilizing at 40° C., and raising the temperature to 200° C. at a temperature rise rate of 2.0° C./min under conditions of a frequency of 1 Hz (6.28 rad/sec) and a strain level of 0.1% (a strain level control mode).

<Inflection Temperature>

The temperature at an inflection point in a function when the storage modulus of the toner is expressed as a function of temperature (° C.) was determined. The temperature at the inflection point is a temperature when the second derivative of the function is 0 (zero). In a given temperature range below a temperature at the inflection point, the second derivative of the function is negative. On the other hand, in a given temperature range above a temperature at the inflection point, the second derivative of the function is positive.

Specifically, the inflection temperature was determined by measuring the storage modulus of the toner according to the method for measuring the storage modulus of the toner and conducting calculation using the above-described method (calculation method using Excel).

<Compatibility and Incompatibility>

Each of the amorphous polyester resin A, the amorphous polyester resin B, and the crystalline polyester resin C was mixed with each of the fine particles of the acrylic resin at a toner mixing ratio. The mixture (50 parts) was added to 50 parts of ethyl acetate, and the compatibility was determined from the dissolved state.

[Evaluation Criteria]

Compatible: The mixed solution is transparent.

Incompatible: Fine particles of acrylic resin can be confirmed in the mixed solution.

<Core-Shell Structure>

Whether a core-shell structure is present was confirmed with a transmission electron microscope (TEM). Specifically, the shell-core structure was confirmed by the following method that measures the average thickness of the shell.

<Average Thickness of Shell>

The average thickness of the shell was measured by measuring the thickness of the shell for randomly extracted 10 pieces of toner and determining the mean of the thicknesses as the average thickness of the shell.

<<Evaluation with Transmission Electron Microscope (TEM)>>

At the outset, the toner was embedded in an epoxy-based resin in an amount approximately equal to a spatula of the toner, followed by curing. The shell and the core were subjected to discrimination dyeing by exposing the sample to gas using ruthenium tetraoxide for 5 min. The cross section was exposed with a knife, and an ultrathin section (thickness: 200 nm) of the toner was prepared with an ultramicrotome (manufactured by Leica, ULTRACUT UCT, diamond knife used). The ultrathin section was then observed under a transmission electron microscope (TEM; H7000, manufactured by Hitachi Hitec) at an acceleration voltage of 100 kV.

Production Example 1

Synthesis of Ketimine

Isophorone diamine (170 parts) and 75 parts of methyl ethyl ketone are charged into a reaction vessel equipped with a stirring rod and a thermometer, and a reaction was allowed to proceed at 50° C. for 5 hr to give a ketimine compound 1. The ketimine compound 1 had an amine value of 418.

Production Example A-1

Synthesis of Amorphous Polyester Resin A-1

—Synthesis of Prepolymer A-1—

3-Methyl-1,5-pentanediol, isophthalic acid, adipic acid, and trimellitic anhydride, together with titanium tetraisopropoxide (1,000 ppm based on resin component), were introduced into a reaction vessel equipped with a cooling tube, a stirrer, and a nitrogen introduction tube so that the molar ratio of the hydroxyl group to the carboxyl group, OH/COOH, was 1.5, the proportion of a diol component, 3-methyl-1,5-pentanediol, was 100% by mole, the proportion of a dicarboxylic acid component, isophthalic acid, was 40% by mole, the proportion of another dicarboxylic acid component, adipic acid, was 60% by mole, and the content of trimellitic anhydride in the whole monomer was 1% by mole. Thereafter, the temperature was raised to 200° C. over a period of about 4 hr, was then raised to 230° C. over a period of 2 hr, and a reaction was allowed to proceed until water no longer ran off. Thereafter, a reaction was further allowed to proceed under a reduced pressure of 10 mmHg to 15 mmHg for 5 hr to give an intermediate polyester A-1.

The intermediate polyester A-1 and isophorone diisocyanate (IPDI) were then introduced into a reaction vessel equipped with a cooling tube, a stirrer, and a nitrogen introduction tube at a molar ratio (isocyanate group in IPDI)/hydroxyl group in intermediate polyester) of 2.0, the mixture was diluted with ethyl acetate to give a 50% ethyl acetate solution, and a reaction was allowed to proceed at 100° C. for 5 hr to give a prepolymer A-1.

—Synthesis of Amorphous Polyester Resin A-1—

The prepolymer A-1 thus obtained was stirred in a reaction vessel equipped with a heating device, a stirrer, and a nitrogen introduction tube. Further, the ketimine compound 1 in an amount equimolar in terms of the amount of amine in the ketimine compound 1 to the amount of isocyanate in the prepolymer A-1 was added dropwise into the reaction vessel, the mixture was stirred at 45° C. for 10 hr, and an elongation product of the prepolymer was taken out from the reaction vessel. The elongation product of the prepolymer thus obtained was dried at 50° C. under reduced pressure until the amount of residual ethyl acetate reached 100 ppm or less to give an amorphous polyester resin A-1.

Production Example A-2

Synthesis of Amorphous Polyester Resin A-2

—Synthesis of Prepolymer A-2—

1,6-Hexanediol, isophthalic acid, adipic acid, and trimellitic anhydride, together with titanium tetraisopropoxide (1,000 ppm based on resin component), were introduced into a reaction vessel equipped with a cooling tube, a stirrer, and a nitrogen introduction tube so that the molar ratio of the hydroxyl group to the carboxyl group, OH/COOH, was 1.5, the proportion of a diol component, 1,6-hexanediol, was 100% by mole, the proportion of a dicarboxylic acid component, isophthalic acid, was 80% by mole, the proportion of another dicarboxylic acid component, adipic acid, was 20% by mole, and the content of trimellitic anhydride in the whole monomer was 1% by mole. Thereafter, the temperature was raised to 200° C. over a period of about 4 hr, was then raised to 230° C. over a period of 2 hr, and a reaction was allowed to proceed until water no longer ran off. Thereafter, a reaction was further allowed to proceed under a reduced pressure of 10 mmHg to 15 mmHg for 5 hr to give an intermediate polyester A-2.

The intermediate polyester A-2 and isophorone diisocyanate were then introduced into a reaction vessel equipped with a cooling tube, a stirrer, and a nitrogen introduction tube at a molar ratio (isocyanate group in IPDI/hydroxyl group in intermediate polyester) of 2.0, the mixture was diluted with ethyl acetate to give a 50% ethyl acetate solution, and a reaction was allowed to proceed at 100° C. for 5 hr to give a prepolymer A-2.

—Synthesis of Amorphous Polyester Resin A-2—

The prepolymer A-2 thus obtained was stirred in a reaction vessel equipped with a heating device, a stirrer, and a nitrogen introduction tube. Further, the ketimine compound 1 in an amount equimolar in terms of the amount of amine of the ketimine compound 1 to the amount of isocyanate in the prepolymer A-2 was added dropwise into the reaction vessel, the mixture was stirred at 45° C. for 10 hr, and an elongation product of the prepolymer was taken out from the reaction vessel. The elongation product of the prepolymer thus obtained was dried at 50° C. under reduced pressure until the amount of residual ethyl acetate reached 100 ppm or less to give an amorphous polyester resin A-2.

Production Example A-3

Synthesis of Amorphous Polyester Resin A-3

—Synthesis of Prepolymer A-3—

3-Methyl-1,5-pentanediol, adipic acid, and trimellitic anhydride, together with titanium tetraisopropoxide (1,000 ppm based on resin component), were introduced into a reaction vessel equipped with a cooling tube, a stirrer, and a nitrogen introduction tube so that the molar ratio of the hydroxyl group to the carboxyl group, OH/COOH, was 1.5, the proportion of a diol component, 3-methyl-1,5-pentanediol, was 100% by mole, the proportion of a dicarboxylic acid component, adipic acid, was 100% by mole, and the content of trimellitic anhydride in the whole monomer was 1% by mole. Thereafter, the temperature was raised to 200° C. over a period of about 4 hr, was then raised to 230° C. over a period of 2 hr, and a reaction was allowed to proceed until water no longer ran off. Thereafter, a reaction was further allowed to proceed under a reduced pressure of 10 mmHg to 15 mmHg for 5 hr to give an intermediate polyester A-3.

The intermediate polyester A-3 and isophorone diisocyanate were then introduced into a reaction vessel equipped with a cooling tube, a stirrer, and a nitrogen introduction tube at a molar ratio (isocyanate group in IPDI/hydroxyl group in intermediate polyester) of 2.0, the mixture was diluted with ethyl acetate to give a 50% ethyl acetate solution, and a reaction was allowed to proceed at 100° C. for 5 hr to give a prepolymer A-3.

—Synthesis of Amorphous Polyester Resin A-3—

The prepolymer A-3 thus obtained was stirred in a reaction vessel equipped with a heating device, a stirrer, and a nitrogen introduction tube. Further, the ketimine compound 1 in an amount equimolar in terms of the amount of amine of the ketimine compound 1 to the amount of isocyanate in the prepolymer A-3 was added dropwise into the reaction vessel, the mixture was stirred at 45° C. for 10 hr, and an elongation product of the prepolymer was taken out from the reaction vessel. The elongation product of the prepolymer thus obtained was dried at 50° C. under reduced pressure until the amount of residual ethyl acetate reached 100 ppm or less to give an amorphous polyester resin A-3.

Production Example A-4

Synthesis of Amorphous Polyester Resin A-4

—Synthesis of Prepolymer A-4—

3-Methyl-1,5-pentanediol, isophthalic acid, and trimellitic anhydride, together with titanium tetraisopropoxide (1,000 ppm based on resin component), were introduced into a reaction vessel equipped with a cooling tube, a stirrer, and a nitrogen introduction tube so that the molar ratio of the hydroxyl group to the carboxyl group, OH/COOH, was 1.5, the proportion of a diol component, 3-methyl-1,5-pentanediol, was 100% by mole, the proportion of a dicarboxylic acid component, isophthalic acid, was 100% by mole, and the content of trimellitic anhydride in the whole monomer was 1% by mole. Thereafter, the temperature was raised to 200° C. over a period of about 4 hr, was then raised to 230° C. over a period of 2 hr, and a reaction was allowed to proceed until water no longer ran off. Thereafter, a reaction was further allowed to proceed under a reduced pressure of 10 mmHg to 15 mmHg for 5 hr to give an intermediate polyester A-4.

The intermediate polyester A-4 and isophorone diisocyanate were then introduced into a reaction vessel equipped with a cooling tube, a stirrer, and a nitrogen introduction tube at a molar ratio (isocyanate group in IPDI/hydroxyl group in intermediate polyester) of 2.0, the mixture was diluted with ethyl acetate to give a 50% ethyl acetate solution, and a reaction was allowed to proceed at 100° C. for 5 hr to give a prepolymer A-4.

—Synthesis of Amorphous Polyester Resin A-4—

The prepolymer A-4 thus obtained was stirred in a reaction vessel equipped with a heating device, a stirrer, and a nitrogen introduction tube. Further, the ketimine compound 1 in an amount equimolar in terms of the amount of amine of the ketimine compound 1 to the amount of isocyanate in the prepolymer A-4 was added dropwise into the reaction vessel, the mixture was stirred at 45° C. for 10 hr, and an elongation product of the prepolymer was taken out from the reaction vessel. The elongation product of the prepolymer thus obtained was dried at 50° C. under reduced pressure until the amount of residual ethyl acetate reached 100 ppm or less to give an amorphous polyester resin A-4.

Production Example A-5

Synthesis of Amorphous Polyester Resin A-5

—Synthesis of Prepolymer A-5—

3-Methyl-1,5-pentanediol, decanedioic acid, and trimellitic anhydride, together with titanium tetraisopropoxide (1,000 ppm based on resin component), were introduced into a reaction vessel equipped with a cooling tube, a stirrer, and a nitrogen introduction tube so that the molar ratio of the hydroxyl group to the carboxyl group, OH/COOH, was 1.5, the proportion of a diol component, 3-methyl-1,5-pentanediol, was 100% by mole, the proportion of a dicarboxylic acid component, decanedioic acid, was 100% by mole, and the content of trimellitic anhydride in the whole monomer was 1% by mole. Thereafter, the temperature was raised to 200° C. over a period of about 4 hr, was then raised to 230° C. over a period of 2 hr, and a reaction was allowed to proceed until water no longer ran off. Thereafter, a reaction was further allowed to proceed under a reduced pressure of 10 mmHg to 15 mmHg for 5 hr to give an intermediate polyester A-5.

The intermediate polyester A-5 and isophorone diisocyanate were then introduced into a reaction vessel equipped with a cooling tube, a stirrer, and a nitrogen introduction tube at a molar ratio (isocyanate group in IPDI/hydroxyl group in intermediate polyester) of 2.0, the mixture was diluted with ethyl acetate to give a 50% ethyl acetate solution, and a reaction was allowed to proceed at 100° C. for 5 hr to give a prepolymer A-5.

—Synthesis of Amorphous Polyester Resin A-5—

The prepolymer A-5 thus obtained was stirred in a reaction vessel equipped with a heating device, a stirrer, and a nitrogen introduction tube. Further, the ketimine compound 1 in an amount equimolar in terms of the amount of amine of the ketimine compound 1 to the amount of isocyanate in the prepolymer A-5 was added dropwise into the reaction vessel, the mixture was stirred at 45° C. for 10 hr, and an elongation product of the prepolymer was taken out from the reaction vessel. The elongation product of the prepolymer thus obtained was dried at 50° C. under reduced pressure until the amount of residual ethyl acetate reached 100 ppm or less to give an amorphous polyester resin A-5.

Production Example A-6

Synthesis of Amorphous Polyester Resin A-6

—Synthesis of Prepolymer A-6—

A 2-mole ethylene oxide adduct of bisphenol A (682 parts), 81 parts of a 2-mole propylene oxide adduct of bisphenol A, 283 parts of terephthalic acid, 22 parts of trimellitic anhydride, and 2 parts of dibutyltin oxide were placed in a reaction vessel equipped with a cooling tube, a stirrer, and a nitrogen introduction tube, and a reaction was allowed to proceed at 230° C. under atmospheric pressure for 7 hr and was further allowed to proceed under a reduced pressure of 10 mmHg to 15 mmHg for 5 hr to give an intermediate polyester A-6.

The intermediate polyester A-5 and isophorone diisocyanate were then introduced into a reaction vessel equipped with a cooling tube, a stirrer, and a nitrogen introduction tube at a molar ratio (isocyanate group in IPDI/hydroxyl group in intermediate polyester) of 2.0, the mixture was diluted with ethyl acetate to give a 50% ethyl acetate solution, and a reaction was allowed to proceed at 100° C. for 5 hr to give a prepolymer A-6.

—Synthesis of Amorphous Polyester Resin A-6—

The prepolymer A-6 thus obtained was stirred in a reaction vessel equipped with a heating device, a stirrer, and a nitrogen introduction tube. Further, the ketimine compound 1 in an amount equimolar in terms of the amount of amine of the ketimine compound 1 to the amount of isocyanate in the prepolymer A-6 was added dropwise into the reaction vessel, the mixture was stirred at 45° C. for 10 hr, and an elongation product of the prepolymer was taken out from the reaction vessel. The elongation product of the prepolymer thus obtained was dried at 50° C. under reduced pressure until the amount of residual ethyl acetate reached 100 ppm or less to give an amorphous polyester resin A-6.

Production Example B-1

Synthesis of Amorphous Polyester Resin B-1

A 2-mole ethylene oxide adduct of bisphenol A, a 3-mole propylene oxide adduct of bisphenol A, isophthalic acid, and adipic acid were charged into a four-necked flask equipped with a nitrogen introduction tube, a dehydration tube, a stirrer, and a thermocouple so that the molar ratio of the 2-mole ethylene oxide adduct of bisphenol A to the 3-mole propylene oxide adduct of bisphenol A (2-mole ethylene oxide adduct of bisphenol A/3-mole propylene oxide adduct of bisphenol A) was 85/15, the molar ratio of isophthalic acid to adipic acid (isophthalic acid/adipic acid) was 80/20, and the molar ratio of hydroxyl group to carboxyl group (OH/COOH) was 1.3. The mixture, together with titanium tetraisopropoxide (500 ppm based on resin component), was allowed to react at 230° C. under atmospheric pressure for 8 hr, and a reaction was further allowed to proceed under a reduced pressure of 10 mmHg to 15 mmHg for 4 hr. Thereafter, trimellitic anhydride (1% by mole based on the whole resin component) was introduced into the flask and reaction was allowed to proceed at 180° C. under atmospheric pressure for 3 hr to give an amorphous polyester resin B-1.

Production Example B-2

Synthesis of Amorphous Polyester Resin B-2

A 2-mole ethylene oxide adduct of bisphenol A, a 3-mole propylene oxide adduct of bisphenol A, isophthalic acid, and adipic acid were charged into a four-necked flask equipped with a nitrogen introduction tube, a dehydration tube, a stirrer, and a thermocouple so that the molar ratio of the 2-mole ethylene oxide adduct of bisphenol A to the 3-mole is propylene oxide adduct of bisphenol A (2-mole ethylene oxide adduct of bisphenol A/3-mole propylene oxide adduct of bisphenol A) was 75/25, the molar ratio of isophthalic acid to adipic acid (isophthalic acid/adipic acid) was 70/30, and the molar ratio of hydroxyl group to carboxyl group (OH/COOH) was 1.4. The mixture, together with titanium tetraisopropoxide (500 ppm based on resin component), was allowed to react at 230° C. under atmospheric pressure for 8 hr, and a reaction was further allowed to proceed under a reduced pressure of 10 mmHg to 15 mmHg for 4 hr. Thereafter, trimellitic anhydride (1% by mole based on the whole resin component) was introduced into the flask and reaction was allowed to proceed at 180° C. under atmospheric pressure for 3 hr to give an amorphous polyester resin B-2.

Production Example B-3

Synthesis of Amorphous Polyester Resin B-3

A 2-mole ethylene oxide adduct of bisphenol A, isophthalic acid, and adipic acid were charged into a four-necked flask equipped with a nitrogen introduction tube, a dehydration tube, a stirrer, and a thermocouple so that the molar ratio of isophthalic acid to adipic acid (isophthalic acid/adipic acid) was 90/10 and the molar ratio of hydroxyl group to carboxyl group (OH/COOH) was 1.2. The mixture, together with titanium tetraisopropoxide (1,000 ppm based on resin component), was allowed to react at 230° C. under atmospheric pressure for 10 hr, and a reaction was further allowed to proceed under a reduced pressure of 10 mmHg to 15 mmHg for 5 hr. Thereafter, trimellitic anhydride (1% by mole based on the whole resin component) was introduced into the flask and reaction was allowed to proceed at 180° C. under atmospheric pressure for 3 hr to give an amorphous polyester resin B-3.

Production Example B-4

Synthesis of Amorphous Polyester Resin B-4

A 2-mole ethylene oxide adduct of bisphenol A, a 3-mole propylene oxide adduct of bisphenol A, isophthalic acid, and adipic acid were charged into a four-necked flask equipped with a nitrogen introduction tube, a dehydration tube, a stirrer, and a thermocouple so that the molar ratio of the 2-mole ethylene oxide adduct of bisphenol A to the 3-mole propylene oxide adduct of bisphenol A (2-mole ethylene oxide adduct of bisphenol A/3-mole propylene oxide adduct of bisphenol A) was 75/25, the molar ratio of isophthalic acid to adipic acid (isophthalic acid/adipic acid) was 65/35, and the molar ratio of hydroxyl group to carboxyl group (OH/COOH) was 1.4. The mixture, together with titanium tetraisopropoxide (500 ppm based on resin component), was allowed to react at 230° C. under atmospheric pressure for 8 hr, and a reaction was further allowed to proceed under a reduced pressure of 10 mmHg to 15 mmHg for 4 hr. Thereafter, trimellitic anhydride (1% by mole based on the whole resin component) was introduced into the flask and reaction was allowed to proceed at 180° C. under atmospheric pressure for 3 hr to give an amorphous polyester resin B-4.

Production Example B-5

Synthesis of Amorphous Polyester Resin B-5

A 2-mole ethylene oxide adduct of bisphenol A, isophthalic acid, and adipic acid were charged into a four-necked flask equipped with a nitrogen introduction tube, a dehydration tube, a stirrer, and a thermocouple so that the molar ratio of isophthalic acid to adipic acid (isophthalic acid/adipic acid) was 95/5 and the molar ratio of hydroxyl group to carboxyl group (OH/COOH) was 1.15. The mixture, together with titanium tetraisopropoxide (1,000 ppm based on resin component), was allowed to react at 230° C. under atmospheric pressure for 10 hr, and a reaction was further allowed to proceed under a reduced pressure of 10 mmHg to 15 mmHg for 5 hr. Thereafter, trimellitic anhydride (1% by mole based on the whole resin component) was introduced into the flask and reaction was allowed to proceed at 180° C. under atmospheric pressure for 3 hr to give an amorphous polyester resin B-5.

Production Example B-6

Synthesis of Amorphous Polyester Resin B-6

1,2-Propanediol, terephthalic acid, and fumaric acid were charged into a four-necked flask equipped with a nitrogen introduction tube, a dehydration tube, a stirrer, and a thermocouple so that the molar ratio of terephthalic acid to fumaric acid (terephthalic acid/fumaric acid) was 75/25 and the molar ratio of hydroxyl group to carboxyl group (OH/COOH) was 1.3. The mixture, together with titanium tetraisopropoxide (500 ppm based on resin component), was allowed to react at 230° C. under atmospheric pressure for 8 hr, and a reaction was further allowed to proceed under a reduced pressure of 10 mmHg to 15 mmHg for 4 hr. Thereafter, trimellitic anhydride (1% by mole based on the whole resin component) was introduced into the flask and reaction was allowed to proceed at 180° C. under atmospheric pressure for 3 hr to give an amorphous polyester resin B-6.

Production Example C-1

Synthesis of Crystalline Polyester Resin C-1

Dodecanedioic acid and 1,6-hexanediol were charged into a 5-L four-necked flask equipped with a nitrogen introduction tube, a dehydration tube, a stirrer, and a thermocouple so that the molar ratio of hydroxyl group to carboxyl group (OH/COOH) was 0.9. The mixture, together with titanium tetraisopropoxide (500 ppm based on resin component), was allowed to react at 180° C. for 10 hr. The temperature was raised to 200° C., and, in this state, a reaction was allowed to proceed for 3 hr, and a reaction was further allowed to proceed at a pressure of 8.3 kPa for 2 hr to give a crystalline polyester resin C-1.

Production Example C-2

Synthesis of Crystalline Polyester Resin C-2

Adipic acid, 1,6-hexanediol, and 1,4-butanediol were charged into a 5-L four-necked flask equipped with a nitrogen introduction tube, a dehydration tube, a stirrer, and a thermocouple so that the molar ratio of hydroxyl group to carboxyl group (OH/COOH) was 0.9, the proportion of an acid component, adipic acid, was 100% by mole, and the proportion of an alcohol component, 1,6-hexanediol, and the proportion of another alcohol component, 1,4-butanediol, were 50% by mole and 50% by mole, respectively. The mixture, together with titanium tetraisopropoxide (500 ppm based on resin component), was allowed to react at 180° C. for 10 hr. The temperature was raised to 200° C., and, in this state, a reaction was allowed to proceed for 3 hr, and a reaction was further allowed to proceed at a pressure of 8.3 kPa for 2 hr to give a crystalline polyester resin C-2.

Production Example C-3

Synthesis of Crystalline Polyester Resin C-3

Terephthalic acid, 1,6-hexanediol, and 1,4-butanediol were charged into a 5-L four-necked flask equipped with a nitrogen introduction tube, a dehydration tube, a stirrer, and a thermocouple so that the molar ratio of hydroxyl group to carboxyl group (OH/COOH) was 0.9, the proportion of an acid component, terephthalic acid, was 100% by mole, and the proportion of an alcohol component, 1,6-hexanediol, and the proportion of another alcohol component, 1,4-butanediol, were 50% by mole and 50% by mole, respectively. The mixture, together with titanium tetraisopropoxide (500 ppm based on resin component), was allowed to react at 180° C. for 10 hr. The temperature was raised to 200° C., and, in this state, a reaction was allowed to proceed for 3 hr, and a reaction was further allowed to proceed at a pressure of 8.3 kPa for 2 hr to give a crystalline polyester resin C-3.

Production Example C-4

Synthesis of Crystalline Polyester Resin C-4

Sebacic acid (241 parts), 31 parts of adipic acid, 164 parts of 1,4-butanediol, and 0.75 part of titanium dihydroxybis (triethanolaminate) (as a condensation catalyst) were placed in a reaction tank equipped with a cooling tube, a stirrer, and a nitrogen introduction tube. A reaction was allowed to proceed for 8 hr under a nitrogen gas stream at 180° C. while removing produced water by distillation. Subsequently, a reaction was allowed to proceed for 4 hr while gradually raising the temperature to 225° C. and removing water and 1,4-butanediol being produced under a nitrogen gas stream. A reaction was further allowed to proceed under a reduced pressure of 5 mmHg to 20 mmHg until the molecular weight (Mw) reached 6,000.

The crystalline resin (218 parts) thus obtained was transferred to a reaction tank equipped with a cooling tube, a stirrer, and a nitrogen introduction tube, 250 parts of ethyl acetate and 82 parts of hexamethylene diisocyanate (HDI) were added thereto, and a reaction was allowed to proceed under a nitrogen gas stream at 80° C. for 5 hr to give a crystalline polyester resin C-4 (modified crystalline polyester resin).

Production Example D-1

Synthesis of Master Batch 1 (MB1)

Water (1,200 parts), 1,200 parts of Pigment Blue 15:3 (PB15:3, manufactured by DIC), and 1,800 parts of the amorphous polyester resin B-1 were added and were mixed together in a Henschel mixer (manufactured by MITSUI MINING CO., LTD.). The mixture was kneaded with a twin roll at 120° C. for 30 min, and the kneaded product was roll-cooled and ground with a pelletizer to give a master batch 1.

Production Example D-2

Synthesis of Master Batch 2 (MB2)

Water (1,200 parts), 500 parts of zinc-phthalocyanine (Zn-Pc, manufactured by DIC), 700 parts of Pigment Blue15:3 (PB15:3, manufactured by DIC), and 1,800 parts of the amorphous polyester resin B-1 were added and were mixed together in a Henschel mixer (manufactured by MITSUI MINING CO., LTD.). The mixture was kneaded with a twin roll at 120° C. for 30 min, and the kneaded product was roll-cooled and ground with a pelletizer to give a master batch 2.

Production Example D-3

Synthesis of Master Batch 3 (MB3)

Water (1,200 parts), 500 parts of aluminum-phthalocyanine (Al-Pc, manufactured by Sanyo Color Works, Ltd.), 700 parts of Pigment Blue15:3 (PB15:3, manufactured by DIC), and 1,800 parts of the amorphous polyester resin B-1 were added and were mixed together in a Henschel mixer (manufactured by MITSUI MINING CO., LTD.). The mixture was kneaded with a twin roll at 120° C. for 30 min, and the kneaded product was roll-cooled and ground with a pelletizer to give a master batch 3.

Production Example D-4

Synthesis of Master Batch 4 (MB4)

Water (900 parts), 1,350 parts of Pigment Red 269 (PR269, manufactured by DIC), 450 parts of Pigment Red 122 (PR122, manufactured by DIC), and 1,200 parts of the amorphous polyester resin B-1 were added and were mixed together in a Henschel mixer (manufactured by MITSUI MINING CO., LTD.). The mixture was kneaded with a twin roll at 120° C. for 30 min, and the kneaded product was roll-cooled and ground with a pelletizer to give a master batch 4.

Production Example D-5

Synthesis of Master Batch 5 (MB5)

Water (1,200 parts), 1,200 parts of Pigment Yellow 74 (PY74, manufactured by BASF), and 1,800 parts of the amorphous polyester resin B-1 were added and were mixed together in a Henschel mixer (manufactured by MITSUI MINING CO., LTD.). The mixture was kneaded with a twin roll at 120° C. for 30 min, and the kneaded product was roll-cooled and ground with a pelletizer to give a master batch 5.

Example 1

Preparation of WAX Dispersion

A paraffin wax (manufactured by NIPPON SEIRO CO., LTD., HNP-9, hydrocarbon wax, melting point 75° C., SP value 8.8) (50 parts) as a releasing agent 1 and 450 parts of ethyl acetate were charged into a vessel equipped with a stirring rod and a thermometer. The temperature was raised to 80° C. with stirring, and the contents in the vessel were held at 80° C. for 5 hr and were then cooled to 30° C. over a period of one hr, followed by dispersion with a bead mill (ULTRAVISCOMILL, manufactured by IMEX) under conditions of a liquid feed speed of 1 kg/hr, a disk peripheral velocity of 6 m/sec, filling (80% by volume) of zirconia beads with a diameter of 0.5 mm, and 3 passes to give a WAX dispersion 1.

<Preparation of Crystalline Polyester Resin Dispersion

The crystalline polyester resin C-1 (50 parts) and 450 parts of ethyl acetate were charged into a vessel equipped with a stirring rod and a thermometer. The temperature was raised to 80° C. with stirring, and the contents in the vessel were held at 80° C. for 5 hr and were then cooled to 30° C. over a period of one hr, followed by dispersion with a bead mill (ULTRAVISCOMILL, manufactured by IMEX) under conditions of a liquid feed speed of 1 kg/hr, a disk peripheral velocity of 6 m/sec, filling (80% by volume) of zirconia beads with a diameter of 0.5 mm, and 3 passes to give a crystalline polyester resin dispersion 1.

<Preparation of Oil Phase>

A WAX dispersion 1 (400 parts), 260 parts of the prepolymer A-1, 500 parts of the crystalline polyester resin dispersion 1,630 parts of the amorphous polyester resin B-1,150 parts of the master batch 1, and 2 parts of the ketimine compound 1 were placed into a vessel and were mixed together in a TK homomixer (manufactured by PRIMIX Corporation) at 5,000 rpm for 60 min to give an oil phase 1.

<Synthesis of Fine Particles of Styrene/Acrylic Resin>

Water (683 parts), 16 parts of a sodium salt of a sulfate ester of an ethylene oxide adduct of methacrylic acid (Eleminol RS-30, manufactured by Sanyo Chemical Industries, Ltd.), 83 parts of styrene, 83 parts of methacrylic acid, 110 parts of n-butyl acrylate, and 1 part of ammonium persulfate were charged into a reaction vessel equipped with a stirring rod and a thermometer. The contents in the vessel were stirred at 400 rpm (revolutions per min) for 15 min to give a white emulsion. The emulsion was heated to raise the temperature in the system to 75° C. and was allowed to react at that temperature for 5 hr. Further, 30 parts of a 1% aqueous ammonium persulfate solution was added thereto, followed by aging at 75° C. for 5 hr to give an aqueous dispersion of a copolymer of styrene-methacrylic acid-butyl acrylate-sodium salt of sulfate ester of ethylene oxide adduct of methacrylic acid [styrene/acrylic resin fine particle dispersion 1].

The volume average particle diameter of the styrene/acrylic resin fine particle dispersion 1 was measured with LA-920 (manufactured by Horiba, Ltd.) and found to be 14 nm. The fine particles of the styrene/acrylic resin had an acid value of 45 mg KOH/g and a weight average molecular weight (Mw) of 300,000, and a glass transition temperature (Tg) of 60° C.

<Synthesis of Acrylic Resin Fine Particle 1>

Water (683 parts), 10 parts of distearyl dimethyl ammonium chloride (Cation DS, manufactured by Kao Corp.), 176 parts of methyl methacrylate, 18 parts of n-butyl acrylate, 1 part of ammonium persulfate, and 2 parts of ethylene glycol dimethacrylate were charged into a reaction vessel equipped with a stirring rod and a thermometer. The contents in the vessel were stirred at 400 rpm for 15 min to give a white emulsion. The emulsion was heated to raise the temperature in the system to 65° C. and was allowed to react at that temperature for 10 hr. Further, 30 parts of a 1% aqueous ammonium persulfate solution was added thereto, followed by aging at 75° C. for 5 hr to give an aqueous dispersion of the acrylic resin fine particle 1 [acrylic resin fine particle dispersion 1].

The volume average particle diameter of the acrylic resin fine particle dispersion 1 was measured with LA-920 (manufactured by Horiba, Ltd.) and found to be 35 nm. The acrylic resin fine particle 1 had an acid value of 2 mg KOH/g and a weight average molecular weight (Mw) of 30,000, and a glass transition temperature (Tg) of 82° C.

<Preparation of Aqueous Phase>

Water (660 parts), 25 parts of the styrene/acrylic resin fine particle dispersion 1, 25 parts of a 48.5% aqueous sodium dodecyl diphenyl ether disulfonate solution (Eleminol MON-7, manufactured by Sanyo Chemical Industries, Ltd.), and 60 parts of ethyl acetate were mixed with stirring to give a milky-white liquid (aqueous phase). Further, 50 parts of the acrylic resin fine particle 1 was added to give an aqueous phase 1. When the aqueous phase 1 was observed under an optical microscope, agglomerates having a size of several hundreds of micrometers were noticed. The observation under an optical microscope revealed that, when the aqueous phase 1 was stirred with a TK homomixer (manufactured by PRIMIX Corporation) at 8,000 rpm, the agglomerates were broken and dispersed as small agglomerates having a size of several micrometers. Accordingly, it is expected that, also in the step of emulsifying a toner material that is carried out later, the acrylic resin fine particle 1 is dispersed and adhered to liquid droplets of a toner material component. Thus, the property that agglomerates are produced but are broken by shearing is important to the acrylic resin fine particles for uniform adherence on the surface of the toner.

<Emulsification and Removal of Solvent>

The aqueous phase 1 (1,200 parts) was added to a vessel containing the oil phase 1. The contents in the vessel were mixed with a TK homomixer at 13,000 rpm for 20 min to give an emulsion slurry 1.

The emulsion slurry 1 was introduced into a vessel equipped with a stirrer and a thermometer. The solvent was removed from the emulsion slurry 1 at 30° C. for 8 hr, and the residue was matured at 45° C. for 4 hr to give a dispersion slurry 1.

<Washing and Drying>

The dispersion slurry 1 (100 parts) was filtered under reduced pressure to give a filter cake. Thereafter, the following procedures (1) to (4) were carried out twice to give a filter cake 1.

(1): Ion-exchanged water (100 parts) was added to the filter cake, they were mixed with a TK homomixer (at 12,000 rpm for 10 min), and the mixture was filtered to give a filter cake.

(2): A 10% aqueous sodium hydroxide solution (100 parts) was added to the filter cake obtained in (1), they were mixed with a TK homomixer (at 12,000 rpm for 30 min), and the mixture was filtered under reduced pressure to give a filter cake.

(3): 10% Hydrochloric acid (100 parts) was added to the filter cake obtained in (2), they were mixed with a TK homomixer (at 12,000 rpm for 10 min), and the mixture was filtered to give a filter cake.

(4): Ion-exchanged water (300 parts) was added to the filter cake obtained in (3), they were mixed with a TK hono-mixer (at 12,000 rpm for 10 min), and the mixture was filtered to give a filter cake.

The filter cake 1 was dried in a circulated air drier at 45° C. for 48 hr, and the dried product was sieved through a mesh having an opening size of 75 μm to obtain a toner 1.

Example 2

A toner 2 was obtained in the same manner as in Example 1, except that the prepolymer A-2 was used instead of the prepolymer A-1.

Example 3

A toner 3 was obtained in the same manner as in Example 1, except that the prepolymer A-3 was used instead of the prepolymer A-1.

Example 4

A toner 4 was obtained in the same manner as in Example 1, except that the amorphous polyester resin B-2 was used instead of the amorphous polyester resin B-1.

Example 5

A toner 5 was obtained in the same manner as in Example 1, except that the amorphous polyester resin B-3 was used instead of the amorphous polyester resin B-1 and, in the "preparation of oil phase," the amount of the prepolymer A-1 was changed from 260 parts to 500 parts and the amount of the amorphous polyester resin B-3 was changed from 630 parts to 510 parts.

Example 6

A toner 6 was obtained in the same manner as in Example 1, except that the crystalline polyester resin C-2 was used instead of the crystalline polyester resin C-1.

Example 7

A toner 7 was obtained in the same manner as in Example 1, except that the crystalline polyester resin C-3 was used instead of the crystalline polyester resin C-1.

Example 8

A toner 8 was obtained in the same manner as in Example 1, except that the master batch 2 was used instead of the master batch 1.

Example 9

A toner 9 was obtained in the same manner as in Example 1, except that the master batch 4 was used instead of the master batch 1.

Example 10

A toner 10 was obtained in the same manner as in Example 10, except that the master batch 5 was used instead of the master batch 1.

Example 11

A toner 11 was obtained in the same manner as in Example 1, except that the oil phase 2 was used instead of the oil phase 1.

<Preparation of Oil Phase 2>

The WAX dispersion (400 parts), 260 parts of the prepolymer 500 parts of the crystalline polyester resin dispersion 1,630 parts of the amorphous polyester resin B-1, 150 parts of the master batch 1, 2 parts of the ketimine compound 1, and 1.4 parts of a benzoxazole derivative (2,5-thiophenediylbis(5-t-butyl-1,3-benzoxazole), tradename: Tinopal OB, manufactured by BASF) as a fluorescent brightening agent were placed in a vessel, and the contents in the vessel were mixed with a TK homomixer (manufactured by PRIMIX Corporation) at 5,000 rpm for 60 min to obtain an oil phase 2.

Example 12

A toner 12 was obtained in the same manner as in Example 11, except that the master batch 2 was used instead of the master batch 1.

Example 13

A toner 13 was obtained in the same manner as in Example 11, except that the master batch 3 was used instead of the master batch 1.

Example 14

A toner 14 was obtained in the same manner as in Example 11, except that the master batch 4 was used instead of the master batch 1.

Example 15

A toner 15 was obtained in the same manner as in Example 1, except that the oil phase 3 was used instead of the oil phase 1.

<Preparation of Oil Phase 3>

The WAX dispersion (400 parts), 140 parts of the prepolymer A-1, 5,000 parts of the crystalline polyester resin dispersion 1, 240 parts of the amorphous polyester resin B-1, 150 parts of the master batch 1, 2 parts of the ketimine compound 1, and 1.4 parts of a benzoxazole derivative (2,5-thiophenediylbis(5-t-butyl-1,3-benzoxazole), tradename: Tinopal OB, manufactured by BASF) as a fluorescent brightening agent were placed in a vessel, and the contents in the vessel were mixed with a TK homomixer (manufactured by PRIMIX Corporation) at 5,000 rpm for 60 min to obtain an oil phase 3.

Example 16

A toner 16 was obtained in the same manner as in Example 1, except that the amorphous polyester resin B-6 was used instead of the amorphous polyester resin B-1.

Example 17

A toner 17 was obtained in the same manner as in Example 1, except that the oil phase 4 was used instead of the oil phase 1.

<Preparation of Oil Phase 4>

The WAX dispersion 1 (400 parts), 200 parts of the prepolymer A-1,500 parts of the crystalline polyester resin dispersion 1, 660 parts of the amorphous polyester resin B-1, 150 parts of the master batch 1, and 2 parts of the ketimine compound 1 were placed in a vessel, and the contents in the vessel were mixed with a TK homomixer (manufactured by PRIMIX Corporation) at 5,000 rpm for 60 min to obtain an oil phase 4.

Example 18

A toner 18 was obtained in the same manner as in Example 1, except that the oil phase 5 was used instead of the oil phase 1.

<Preparation of Oil Phase 5>

The WAX dispersion 1 (400 parts), 400 parts of the prepolymer A-1,500 parts of the crystalline polyester resin dispersion 1, 560 parts of the amorphous polyester resin B-1, 150 parts of the master batch 1, and 2 parts of the ketimine compound 1 were placed in a vessel, and the contents in the vessel were mixed with a TK homomixer (manufactured by PRIMIX Corporation) at 5,000 rpm for 60 min to obtain an oil phase 5.

Example 19

A toner 19 was obtained in the same manner as in Example 1, except that, in the "preparation of aqueous phase" in Example 1, the acrylic resin fine particle dispersion 2 was used instead of the acrylic resin fine particle dispersion 1.

<Synthesis of Acrylic Resin Fine Particle 2>

Water (688 parts), 5 parts of distearyl dimethyl ammonium chloride (Cation DS, manufactured by Kao Corp.), 144 parts of methyl methacrylate, 47 parts of n-butyl acrylate, 5 parts of methacrylic acid, and 1 part of ammonium persulfate were charged into a reaction vessel equipped with a stirring rod and a thermometer. The contents in the vessel were stirred at 400 rpm for 15 min to obtain a white emulsion. The white emulsion was heated to raise the temperature in the system to 65° C., and a reaction was allowed to proceed for 10 hr. Further, 30 parts of a 1% aqueous ammonium persulfate solution was added thereto, followed by aging at 75° C. for 5 hr to obtain an aqueous dispersion of the acrylic resin fine particle 2 that is a vinyl resin (a methyl methacrylate-butyl acrylate-methacrylic acid copolymer) [an acrylic resin fine particle dispersion 2].

The volume average particle diameter of the acrylic resin fine particle dispersion 2 was measured with LA-920 (manufactured by Horiba, Ltd.) and found to be 50 nm. The acrylic resin fine particle 2 had an acid value of 13 mg KOH/g, a weight average molecular weight (Mw) of 30,000, and a glass transition temperature (Tg) of 55° C.

Example 20

A toner 20 was obtained in the same manner as in Example 1, except that the oil phase 6 was used instead of the oil phase 1.

<Preparation of Crystalline Polyester Resin Dispersion 4>

The crystalline polyester resin C-4 (50 parts) and 450 parts of ethyl acetate were charged into a vessel equipped with a stirring rod and a thermometer. The contents in the vessel were heated to 80° C. with stirring, were held at 80° C. for 5 hr, and were cooled to 30° C. over a period of one hr, followed by dispersion with a bead mill (ULTRAVISCOMILL, manufactured by IMEX) under conditions of a liquid feed speed of 1 kg/hr, a disk peripheral velocity of 6 m/sec, filling (80% by volume) of zirconia beads with a diameter of 0.5 mm, and 3 passes to give a crystalline polyester resin dispersion 4.

<Preparation of Oil Phase 6>

The WAX dispersion 1 (400 parts), 260 parts of the prepolymer A-1, 6,800 parts of the crystalline polyester resin dispersion 4, 150 parts of the master batch 1, and 2 parts of the ketimine compound 1 were placed in a vessel, and the contents in the vessel were mixed with a TK homomixer (manufactured by PRIMIX Corporation) at 5,000 rpm for 60 min to give an oil phase 6.

Comparative Example 1

A toner 21 was obtained in the same manner as in Example 1, except that the prepolymer A-4 was used instead of the prepolymer A-1.

Comparative Example 2

A toner 22 was obtained in the same manner as in Example 1, except that the amorphous polyester resin B-4 was used instead of the amorphous polyester resin B-1.

Comparative Example 3

A toner 23 was obtained in the same manner as in Example 1, except that the amorphous polyester resin B-5 was used instead of the amorphous polyester resin B-1, the amount of the prepolymer A-1 in the "preparation of oil phase" was changed from 260 parts to 600 parts, and the amount of the amorphous polyester resin B-5 was changed from 630 parts to 460 parts.

Comparative Example 4

A toner 24 was obtained in the same manner as in Example 1, except that, in the "preparation of oil phase" in Example 1, 260 parts of the prepolymer A-1 was changed to 200 parts of the prepolymer A-4, and the amount of the amorphous polyester resin B-1 was changed from 630 parts to 660 parts.

Comparative Example 5

A toner 25 of Comparative Example 6 was obtained in the same manner as in Example 1, except that, in the "preparation of oil phase" in Example 1,400 parts of the prepolymer A-5 was used instead of 260 parts of the prepolymer A-1, and the amount of the amorphous polyester resin B-1 was changed from 630 parts to 560 parts.

Comparative Example 6

A toner 26 was obtained in the same manner as in Example 1, except that, in the "preparation of oil phase" in Example 1, the crystalline polyester resin dispersion C-1 was changed from 500 parts to 0 part, and the amount of the amorphous polyester resin B-1 was changed from 630 parts to 680 parts.

Comparative Example 7

A toner 27 was obtained in the same manner as in Example 1, except that the oil phase 7 was used instead of the oil phase 1.

<Preparation of Oil Phase 7>

The WAX dispersion (400 parts), 70 parts of the prepolymer A-1, 7,000 parts of the crystalline polyester resin dispersion 1, 75 parts of the amorphous polyester resin B-1, 150 parts of the master batch 1, 2 parts of the ketimine compound 1, and 1.4 parts of a benzoxazole derivative (2,5-thiophenediylbis(5-t-butyl-1,3-benzoxazole), tradename: Tinopl OB, manufactured by BASF) as a fluorescent brightening agent were placed in a vessel. The contents in the vessel were mixed with a TK homomixer (manufactured by PRIMIX Corporation) at 5,000 rpm for 60 min to obtain an oil phase 7.

Comparative Example 8

A toner 28 was obtained in the same manner as in Example 1, except that the oil phase 8 was used instead of the oil phase 1.

<Preparation of Oil Phase 8>

The WAX dispersion 1 (400 parts), 0 part of the prepolymer A-1, 500 parts of the crystalline polyester resin dispersion 1, 760 parts of the amorphous polyester resin B-1, 150 parts of the master batch 1, and 2 parts of the ketimine compound 1 were placed in a vessel. The contents in the vessel were mixed with a TK homomixer (manufactured by PRIMIX Corporation) at 5,000 rpm for 60 min to give an oil phase 8.

Comparative Example 9

A toner 29 was obtained in the same manner as in Example 1, except that the oil phase 9 was used instead of the oil phase 1.

<Preparation of Oil Phase 9>

The WAX dispersion 1 (400 parts), 500 parts of the prepolymer A-1,500 parts of the crystalline polyester resin dispersion 1, 510 parts of the amorphous polyester resin B-1, 150 parts of the master batch 1, and 2 parts of the ketimine compound 1 were placed in a vessel. The contents in the vessel were mixed with a TK homomixer (manufactured by PRIMIX Corporation) at 5,000 rpm for 60 min to obtain an oil phase 9.

Comparative Example 10

A toner 30 was obtained in the same manner as in Example 1, except that the prepolymer A-6 was used instead of the prepolymer A-1.

Comparative Example 11

A toner 31 was obtained in the same manner as in Example 9, except that the acrylic resin fine particle dispersion 1 was not used.

<Evaluation>

For the toners thus obtained, developers were prepared by the following method. The toners were evaluated as follows. The results are shown in Tables 2-1 to 2-6.

<<Preparation of Developing Solutions>>

—Preparation of Carriers—

Organostraight silicone (SR2440, manufactured by Dow Corning Toray Silicone Co., Ltd.) that is a silicone resin (100 parts), 5 parts of γ-(2-aminoethyl)aminopropyltrimethoxysilane (SH6020, manufactured by Dow Corning Toray Silicone Co., Ltd.), and 10 parts of carbon black were added to 100 parts of toluene, and the mixture was subjected to dispersion with a homomixer for 20 min to prepare a coating liquid for a resin layer. A carrier was prepared by coating the coating liquid for a resin layer on the surface of 1,000 parts of a spherical magnetite having an average particle diameter of 50 μm with a fluidized bed coating device.

—Preparation of Developer—

The toner (5 parts) prepared in each Example and 95 parts of the carrier were mixed together in a ball mill to prepare a developer.

<<Low-Temperature Fixability and High-Temperature Anti-Offset Property>>

For the toners, the fixation was evaluated with a fixing device obtained by modifying a fixing portion in a full-color complex machine Imagio NeoC600Pro manufactured by Ricoh Co., Ltd. so that a temperature and a linear velocity can be regulated, by forming a solid image on type 6200 paper (manufactured by Ricoh Co., Ltd.) at a toner coverage of 0.85±0.01 mg/cm$^2$. A fixing roll temperature at which the retention of the density of the image is 70% or more after rubbing the fixed image with a pad was determined as a lower limit fixation temperature.

Specifically, the fixation temperature was varied, and a cold offset temperature (a lower limit fixation temperature) and a high-temperature offset temperature (an upper limit fixation temperature) were determined.

The lower limit fixation temperature was evaluated under conditions of a paper feed linear velocity of 150 mm/sec, a face pressure of 1.2 kgf/cm$^2$, and a nip width of 3 mm.

Further, the upper limit fixation temperature was evaluated under conditions of a paper feed linear velocity of 50 mm/sec, a face pressure of 2.0 kgf/cm$^2$, and a nip width of 4.5 mm.

<<Heat-Resistant Storage Property>>

The toner was stored at 50° C. for 8 hr and was screened with a 42-mesh (355 μm) metallic sieve for 2 min, and the proportion of the oversize was determined. The better the heat-resistant storage property, the smaller the proportion of the oversize.

The heat-resistant storage property was evaluated according to the following criteria.

A: A proportion of oversize of less than 10%

B: A proportion of oversize of 10% or more but less than 20%

C: A proportion of oversize of 20% or more but less than 30%

D: A proportion of oversize of 30% or more

TABLE 1-1

| | | Production Example A-1 | Production Example A-2 | Production Example A-3 | Production Example A-4 | Production Example A-5 | Production Example A-6 |
|---|---|---|---|---|---|---|---|
| Amorphous polyester resin A | Type | A-1 | A-2 | A-3 | A-4 | A-5 | A-6 |
| | Diol | 3-Methyl-1,5-pentanediol 100% | Hexanediol 100% | 3-Methyl-1,5-pentanediol 100% | 3-Methyl-1,5-pentanediol 100% | 3-Methyl-1,5-pentanediol 100% | BisA-EO/BisA-PO2 |
| | Dicarboxylic acid | Isophthalic acid 40%/adipic acid 60% | Isophthalic acid 80%/adipic acid 20% | Adipic acid 100% | Isophthalic acid 100% | Decanedioic acid 100% | Terephthalic acid 100% |
| | Mw | 150,000 | 120,000 | 130,000 | 120,000 | 100,000 | 37,000 |
| | Tg | −40° C. | −5° C. | −55° C. | 5° C. | −65° C. | 54° C. |

TABLE 1-2

| | | Production Example B-1 | Production Example B-2 | Production Example B-3 | Production Example B-4 | Production Example B-5 | Production Example B-6 |
|---|---|---|---|---|---|---|---|
| Amorphous polyester resin B | Type | B-1 | B-2 | B-3 | B-4 | B-5 | B-6 |
| | Diol | BisA-EO 85%/BisA-PO 15% | BisA-EO 75%/BisA-PO 25% | BisA-EO 100% | BisA-EO 75%/BisA-PO 25% | BisA-EO 100% | PO 100% |
| | Dicarboxylic acid | Isophthalic acid 80%/adipic acid 20% | Isophthalic acid 70%/adipic acid 30% | Isophthalic acid 90%/adipic acid 10% | Isophthalic acid 65%/adipic acid 35% | Isophthalic acid 95%/adipic acid 5% | Terephthalic acid 75%/adipic acid 25% |
| | Mw | 5,000 | 4,500 | 7.500 | 4,000 | 8,000 | 5,000 |
| | Tg | 48° C. | 42° C. | 68° C. | 38° C. | 72° C. | 55° C. |

TABLE 1-3

| | | Production Example C-1 | Production Example C-2 | Production Example C-3 | Production Example C-4 |
|---|---|---|---|---|---|
| Crystalline polyester resin C | Type | C-1 | C-2 | C-3 | C-4 |
| | Diol | Hexanediol 100% | Hexanediol 60%/butanediol 60% | Hexanediol 50%/butanediol 50% | 1,4-Butanediol 100% |
| | Dicarboxylic acid | Dodecanedioic acid 100% | Adipic acid 100% | Terephthalic acid 100% | Sebacic acid 85%/adipic acid 15% |
| | Isocyanate | — | — | — | HDI |
| | Mw | 15,000 | 12,000 | 8,500 | 22,000 |
| | mp | 70° C. | 68° C. | 82° C. | 60° C. |

In Tables 1-1 to 1-3, "BisA-EO" represents a 2-mole ethylene oxide adduct of bisphenol A. "BisA-PO" represents a 3-mole propylene oxide adduct of bisphenol A. "BisA-PO2" represents a 2-mole propylene oxide adduct of bisphenol A. "PO" represents 1,2-propanediol. "Hexanediol" represents 1,6-hexanediol. "Butanediol" represents 1,4-butanediol. "HDI" represents hexamethylene diisocyanate. "%" in the composition of diol and dicarboxylic acid in each of the resins is "% by mole."

TABLE 2-1

| | | Ex. 1 | Ex. 2 | Ex. 3 | Ex. 4 | Ex. 5 |
|---|---|---|---|---|---|---|
| Amorphous polyester resin A | Type | A-1 | A-2 | A-3 | A-1 | A-1 |
| Amorphous polyester resin B | Type | B-1 | B-1 | B-1 | B-2 | B-3 |
| Crystalline polyester resin C | Type | C-1 | C-1 | C-1 | C-1 | C-1 |
| Type of pigment | | PB 15:3 | PB 15:3 | PB 15:3 | PB 15:3 | PB 15:3 |
| Releasing agent | Type | HNP-9 | HNP-9 | HNP-9 | HNP-9 | HNP-9 |
| | mp | 75° C. | 75° C. | 75° C. | 75° C. | 75° C. |
| Compatibility | Between shell and resin A | Incompatible | Incompatible | Incompatible | Incompatible | Incompatible |
| | Between shell and resin B | Incompatible | Incompatible | Incompatible | Incompatible | Incompatible |
| | Between shell and resin C | Incompatible | Incompatible | Incompatible | Incompatible | Incompatible |
| Formulation | Resin A | 13 | 13 | 13 | 13 | 25 |
| | Resin B | 72 | 72 | 72 | 72 | 60 |
| | Resin C | 5 | 5 | 5 | 5 | 5 |
| | Releasing agent | 4 | 4 | 4 | 4 | 4 |
| | Fluorescent brightening agent | 0 | 0 | 0 | 0 | 0 |
| | Pigment | 6 | 6 | 6 | 6 | 6 |
| Core-shell structure | | Present | Present | Present | Present | Present |
| Tg of shell (° C.) | | 82° C. | 82° C. | 82° C. | 82° C. | 82° C. |
| Average thickness of shell layer (nm) | | 70 | 70 | 70 | 70 | 70 |
| Quality | Tg1st (° C.) | 30 | 36 | 26 | 27 | 38 |
| | Tg2nd (° C.) | 15 | 20 | 13 | 15 | 25 |
| | G' (50° C.) (Pa) | $1.4 \times 10^7$ | $1.5 \times 10^7$ | $1.5 \times 10^7$ | $1.4 \times 10^7$ | $1.4 \times 10^7$ |
| | G'' (80° C.) (Pa) | $1.4 \times 10^5$ | $1.8 \times 10^5$ | $1.4 \times 10^5$ | $1.4 \times 10^5$ | $1.6 \times 10^5$ |
| | G'' (160° C.) (Pa) | $4.3 \times 10^2$ | $5.1 \times 10^2$ | $3.6 \times 10^2$ | $4.2 \times 10^2$ | $5.5 \times 10^2$ |
| | Inflexion temp. | 58° C. | 59° C. | 57° C. | 57° C. | 61° C. |
| | Lower limit fixation temp. | 95° C. | 100° C. | 95° C. | 95° C. | 100° C. |
| | Upper limit fixation temp. | 190° C. | 200° C. | 185° C. | 185° C. | 210° C. |
| | Heat-resistant storage property | A | A | A | A | A |

TABLE 2-2

| | | Ex. 6 | Ex. 7 | Ex. 8 | Ex. 9 | Ex. 10 |
|---|---|---|---|---|---|---|
| Amorphous polyester resin A | Type | A-1 | A-1 | A-1 | A-1 | A-1 |
| Amorphous polyester resin B | Type | B-1 | B-1 | B-1 | B-1 | B-1 |
| Crystalline polyester resin C | Type | C-2 | C-3 | C-1 | C-1 | C-1 |
| Type of pigment | | PB 15:3 | PB 15:3 | PB 15:3/Zn-Pc | PR269/PR 122 | PY74 |
| Releasing agent | Type | HNP-9 | HNP-9 | HNP-9 | HNP-9 | HNP-9 |
| | mp | 75° C. | 75° C. | 75° C. | 75° C. | 75° C. |
| Compatibility | Between shell and resin A | Incompatible | Incompatible | Incompatible | Incompatible | Incompatible |
| | Between shell and resin B | Incompatible | Incompatible | Incompatible | Incompatible | Incompatible |
| | Between shell and resin C | Incompatible | Incompatible | Incompatible | Incompatible | Incompatible |

TABLE 2-2-continued

| | | Ex. 6 | Ex. 7 | Ex. 8 | Ex. 9 | Ex. 10 |
|---|---|---|---|---|---|---|
| Formulation | Resin A | 13 | 13 | 13 | 13 | 13 |
| | Resin B | 72 | 72 | 72 | 72 | 72 |
| | Resin C | 5 | 5 | 5 | 5 | 5 |
| | Releasing agent | 4 | 4 | 4 | 4 | 4 |
| | Fluorescent brightening agent | 0 | 0 | 0 | 0 | 0 |
| | Pigment | 6 | 6 | 6 | 6 | 6 |
| Core-shell structure | | Present | Present | Present | Present | Present |
| Tg of shell (° C.) | | 82° C. | 82° C. | 82° C. | 82° C. | 82° C. |
| Average thickness of shell layer (nm) | | 70 | 70 | 70 | 70 | 70 |
| Quality | Tg1st (° C.) | 30 | 30 | 30 | 30 | 30 |
| | Tg2nd (° C.) | 17 | 22 | 15 | 15 | 15 |
| | G' (50° C.) (Pa) | $1.8 \times 10^7$ | $1.4 \times 10^7$ | $1.5 \times 10^7$ | $1.4 \times 10^7$ | $1.4 \times 10^7$ |
| | G'' (80° C.) (Pa) | $1.4 \times 10^5$ | $2.0 \times 10^5$ | $1.4 \times 10^5$ | $1.5 \times 10^5$ | $1.6 \times 10^5$ |
| | G'' (160° C.) (Pa) | $3.6 \times 10^2$ | $5.8 \times 10^2$ | $4.4 \times 10^2$ | $4.2 \times 10^2$ | $4.3 \times 10^2$ |
| | Inflexion temp. | 58° C. | 58° C. | 58° C. | 58° C. | 58° C. |
| | Lower limit fixation temp. | 95° C. | 105° C. | 95° C. | 95° C. | 95° C. |
| | Upper limit fixation temp. | 185° C. | 210° C. | 190° C. | 190° C. | 190° C. |
| | Heat-resistant storage property | A | A | A | A | A |

TABLE 2-3

| | | Ex. 11 | Ex. 12 | Ex. 13 | Ex. 14 | Ex. 15 |
|---|---|---|---|---|---|---|
| Amorphous polyester resin A | Type | A-1 | A-1 | A-1 | A-1 | A-1 |
| Amorphous polyester resin B | Type | B-1 | B-1 | B-1 | B-1 | B-1 |
| Crystalline polyester resin C | Type | C-1 | C-1 | C-1 | C-1 | C-1 |
| Type of pigment | | PB 15:3 | PB 15:3/Zn-Pc | Al-PC/PB 15:3 | PR269/PR 122 | PB 15:3 |
| Releasing agent | Type | HNP-9 | HNP-9 | HNP-9 | HNP-9 | HNP-9 |
| | mp | 75° C. | 75° C. | 75° C. | 75° C. | 75° C. |
| Compatibility | Between shell and resin A | Incompatible | Incompatible | Incompatible | Incompatible | Incompatible |
| | Between shell and resin B | Incompatible | Incompatible | Incompatible | Incompatible | Incompatible |
| | Between shell and resin C | Incompatible | Incompatible | Incompatible | Incompatible | Incompatible |
| Formulation | Resin A | 13 | 13 | 13 | 13 | 7 |
| | Resin B | 72 | 72 | 72 | 72 | 33 |
| | Resin C | 5 | 5 | 5 | 5 | 50 |
| | Releasing agent | 4 | 4 | 4 | 4 | 4 |
| | Fluorescent brightening agent | 0.12 | 0.12 | 0.12 | 0.12 | 0.12 |
| | Pigment | 6 | 6 | 6 | 6 | 6 |
| Core-shell structure | | Present | Present | Present | Present | Present |
| Tg of shell (° C.) | | 82° C. | 82° C. | 82° C. | 82° C. | 82° C. |
| Average thickness of shell layer (nm) | | 70 | 70 | 70 | 70 | 70 |
| Quality | Tg1st (° C.) | 30 | 30 | 30 | 30 | 33 |
| | Tg2nd (° C.) | 15 | 15 | 15 | 15 | 15 |
| | G' (50° C.) (Pa) | $1.5 \times 10^7$ | $1.4 \times 10^7$ | $1.4 \times 10^7$ | $1.4 \times 10^7$ | $1.1 \times 10^7$ |
| | G'' (80° C.) (Pa) | $1.5 \times 10^5$ | $1.4 \times 10^5$ | $1.5 \times 10^5$ | $1.5 \times 10^5$ | $1.0 \times 10^5$ |
| | G'' (160° C.) (Pa) | $4.1 \times 10^2$ | $4.2 \times 10^2$ | $4.2 \times 10^2$ | $4.2 \times 10^2$ | $2.1 \times 10^2$ |
| | Inflexion temp. | 58° C. | 58° C. | 58° C. | 58° C. | 60° C. |
| | Lower limit fixation temp. | 95° C. | 95° C. | 95° C. | 95° C. | 90° C. |
| | Upper limit | 190° C. | 190° C. | 190° C. | 190° C. | 185° C. |

TABLE 2-3-continued

| | | Ex. 11 | Ex. 12 | Ex. 13 | Ex. 14 | Ex. 15 |
|---|---|---|---|---|---|---|
| | fixation temp. | | | | | |
| | Heat-resistant storage property | A | A | A | A | B |

TABLE 2-4

| | | Ex. 16 | Ex. 17 | Ex. 18 | Ex. 19 | Ex. 20 |
|---|---|---|---|---|---|---|
| Amorphous polyester resin A | Type | A-1 | A-1 | A-1 | A-1 | A-1 |
| Amorphous polyester resin B | Type | B-6 | B-1 | B-1 | B-1 | B-1 |
| Crystalline polyester resin C | Type | C-1 | C-1 | C-1 | C-1 | C-4 |
| Type of pigment | | PB 15:3 | PB 15:3 | PB 15:3 | PB 15:3 | PB 15:3 |
| Releasing agent | Type | HNP-9 | HNP-9 | HNP-9 | HNP-9 | HNP-9 |
| | mp | 75° C. | 75° C. | 75° C. | 75° C. | 75° C. |
| Compatibility | Between shell and resin A | Incompatible | Incompatible | Incompatible | Incompatible | Incompatible |
| | Between shell and resin B | Incompatible | Incompatible | Incompatible | Incompatible | Incompatible |
| | Between shell and resin C | Incompatible | Incompatible | Incompatible | Incompatible | Incompatible |
| Formulation | Resin A | 13 | 10 | 20 | 13 | 13 |
| | Resin B | 72 | 75 | 65 | 72 | 9 |
| | Resin C | 5 | 5 | 5 | 5 | 68 |
| | Releasing agent | 4 | 4 | 4 | 4 | 4 |
| | Fluorescent brightening agent | 0 | 0 | 0 | 0 | 0 |
| | Pigment | 6 | 6 | 6 | 6 | 6 |
| Core-shell structure | | Present | Present | Present | Present | Present |
| Tg of shell (° C.) | | 82° C. | 82° C. | 82° C. | 55° C. | 82° C. |
| Average thickness of shell layer (nm) | | 70 | 70 | 70 | 90 | 70 |
| Quality | Tg1st (° C.) | 35 | 30 | 30 | 30 | 50 |
| | Tg2nd (° C.) | 20 | 15 | 15 | 15 | 39 |
| | G' (50° C.) (Pa) | $2.1 \times 10^7$ | $1.3 \times 10^7$ | $1.4 \times 10^7$ | $1.4 \times 10^7$ | $1.1 \times 10^7$ |
| | G'' (80° C.) (Pa) | $1.8 \times 10^5$ | $1.2 \times 10^5$ | $2.0 \times 10^5$ | $1.2 \times 10^5$ | $1.0 \times 10^5$ |
| | G'' (160° C.) (Pa) | $4.3 \times 10^2$ | $3.9 \times 10^2$ | $9.0 \times 10^2$ | $3.8 \times 10^2$ | $1.0 \times 10^3$ |
| | Inflexion temp. | 59° C. | 58° C. | 58° C. | 58° C. | 59° C. |
| | Lower limit fixation temp. | 105° C. | 95° C. | 100° C. | 95° C. | 100° C. |
| | Upper limit fixation temp. | 190° C. | 185° C. | 195° C. | 185° C. | 200° C. |
| | Heat-resistant storage property | A | A | A | B | A |

TABLE 2-5

| | | Comp. Ex. 1 | Comp. Ex. 2 | Comp. Ex. 3 | Comp. Ex. 4 | Comp. Ex. 5 |
|---|---|---|---|---|---|---|
| Amorphous polyester resin A | Type | A-4 | A-1 | A-1 | A-4 | A-5 |
| Amorphous polyester resin B | Type | B-1 | B-4 | B-5 | B-1 | B-1 |
| Crystalline polyester resin C | Type | C-1 | C-1 | C-1 | C-1 | C-1 |
| Type of pigment | | PB 15:3 | PB 15:3 | PB 15:3 | PB 15:3 | PB 15:3 |
| Releasing agent | Type | HNP-9 | HNP-9 | HNP-9 | HNP-9 | HNP-9 |
| | mp | 75° C. | 75° C. | 75° C. | 75° C. | 75° C. |

TABLE 2-5-continued

| | | Comp. Ex. 1 | Comp. Ex. 2 | Comp. Ex. 3 | Comp. Ex. 4 | Comp. Ex. 5 |
|---|---|---|---|---|---|---|
| Compatibility | Between shell and resin A | Incompatible | Incompatible | Incompatible | Incompatible | Incompatible |
| | Between shell and resin B | Incompatible | Incompatible | Incompatible | Incompatible | Incompatible |
| | Between shell and resin C | Incompatible | Incompatible | Incompatible | Incompatible | Incompatible |
| Formulation | Resin A | 13 | 13 | 30 | 10 | 20 |
| | Resin B | 72 | 72 | 55 | 75 | 65 |
| | Resin C | 5 | 5 | 5 | 5 | 5 |
| | Releasing agent | 4 | 4 | 4 | 4 | 4 |
| | Fluorescent brightening agent | 0 | 0 | 0 | 0 | 0 |
| | Pigment | 6 | 6 | 6 | 6 | 6 |
| Core-shell structure | | Present | Present | Present | Present | Present |
| Tg of shell (° C.) | | 82° C. | 82° C. | 82° C. | 82° C. | 82° C. |
| Average thickness of shell layer (nm) | | 70 | 70 | 70 | 70 | 70 |
| Quality | Tg1st (° C.) | 36 | 22 | 38 | 42 | 18 |
| | Tg2nd (° C.) | 18 | 10 | 22 | 22 | 8 |
| | G' (50° C.) (Pa) | $1.4 \times 10^7$ | $5.4 \times 10^6$ | $1.4 \times 10^7$ | $1.4 \times 10^7$ | $9.8 \times 10^6$ |
| | G'' (80° C.) (Pa) | $2.5 \times 10^5$ | $1.5 \times 10^5$ | $3.4 \times 10^5$ | $3.8 \times 10^5$ | $1.4 \times 10^5$ |
| | G'' (160° C.) (Pa) | $3.6 \times 10^2$ | $2.8 \times 10^2$ | $1.4 \times 10^3$ | $4.4 \times 10^2$ | $2.8 \times 10^2$ |
| | Inflexion temp. | 58° C. | 54° C. | 62° C. | 58° C. | 58° C. |
| | Lower limit fixation temp. | 115° C. | 95° C. | 120° C. | 125° C. | 95° C. |
| | Upper limit fixation temp. | 180° C. | 170° C. | 190° C. | 190° C. | 170° C. |
| | Heat-resistant storage property | A | D | A | A | D |

TABLE 2-6

| | | | Comp. Ex. 6 | Comp. Ex. 7 | Comp. Ex. 8 | Comp. Ex. 9 | Comp. Ex. 10 | Comp. Ex. 11 |
|---|---|---|---|---|---|---|---|---|
| Amorphous polyester resin A | | Type | A-1 | A-1 | — | A-1 | A-6 | A-1 |
| Amorphous polyester resin B | | Type | B-1 | B-1 | B-1 | B-1 | B-1 | B-1 |
| Crystalline polyester resin C | | Type | — | C-1 | C-1 | C-1 | C-1 | C-1 |
| Type of pigment | | | PB 15:3 | PB 15:3 | PB 15:3 | PB 15:3 | PB 15:3 | PB 15:3 |
| Releasing agent | Type | | HNP-9 | HNP-9 | HNP-9 | HNP-9 | HNP-9 | HNP-9 |
| | mp | | 75° C. | 75° C. | 75° C. | 75° C. | 75° C. | 75° C. |
| Compatiability | Between shell and resin A | | Incompatible | Incompatible | — | Incompatible | Incompatible | — |
| | Between shell and resin B | | Incompatible | Incompatible | Incompatible | Incompatible | Incompatible | — |
| | Between shell and resin C | | — | Incompatible | Incompatible | Incompatible | Incompatible | — |
| Formulation | Resin A | | 13 | 35 | 0 | 25 | 13 | 13 |
| | Resin B | | 77 | 16.5 | 85 | 60 | 72 | 72 |
| | Resin C | | 0 | 70 | 5 | 5 | 5 | 5 |
| | Releasing agent | | 4 | 4 | 4 | 4 | 4 | 4 |
| | Fluorescent brightening agent | | 0 | 0.12 | 0 | 0 | 0 | 0 |
| | Pigment | | 6 | 6 | 6 | 6 | 6 | 6 |
| Core-shell structure | | | Present | Present | Present | Present | Present | Absent |
| Tg of shell (° C.) | | | 82° C. | 82° C. | 82° C. | 82° C. | 82° C. | — |
| Average thickness of shell layer (nm) | | | 70 | 70 | 70 | 70 | 70 | — |

TABLE 2-6-continued

| | | Comp. Ex. 6 | Comp. Ex. 7 | Comp. Ex. 8 | Comp. Ex. 9 | Comp. Ex. 10 | Comp. Ex. 11 |
|---|---|---|---|---|---|---|---|
| Quality | Tg1st (° C.) | 30 | 35 | 30 | 27 | 30 | 27 |
| | Tg2nd (° C.) | 28 | 13 | 15 | 15 | 15 | 15 |
| | G' (50° C.) (Pa) | $1.4 \times 10^7$ | $1.0 \times 10^7$ | $1.2 \times 10^7$ | $1.4 \times 10^7$ | $2.0 \times 10^7$ | $1.4 \times 10^7$ |
| | G'' (80° C.) (Pa) | $3.3 \times 10^5$ | $7.0 \times 10^4$ | $1.0 \times 10^5$ | $1.4 \times 10^5$ | $8.0 \times 10^5$ | $1.4 \times 10^5$ |
| | G'' (160° C.) (Pa) | $4.4 \times 10^2$ | $3.5 \times 10^2$ | $1.8 \times 10^2$ | $1.2 \times 10^3$ | $1.2 \times 10^3$ | $1.1 \times 10^3$ |
| | Inflexion temp. | 58° C. | 58° C. | 58° C. | 57° C. | 58° C. | 58° C. |
| | Lower limit fixation temp. | 125° C. | 95° C. | 95° C. | 95° C. | 140° C. | 90° C. |
| | Upper limit fixation temp. | 190° C. | 175° C. | 170° C. | 190° C. | 200° C. | 190° C. |
| | Heat-resistant storage property | A | D | B | B | A | D |

In Tables 2-1 to 2-6, the formulation shows the content (parts by mass) when the total amount of the resin A, the resin B, the resin C, the releasing agent, and the pigment is presumed to be 100 parts by mass.

In Tables 2-1 to 2-6, Tg of the shell was determined by measuring Tg of the fine particle of the acrylic resin.

The toners of Examples 1 to 20 had excellent low-temperature fixability, high-temperature anti-offset property, and heat-resistant storage property and, at the same time, exhibited excellent color reproducibility.

On the other hand, the toner of Comparative Example 1 had a loss modulus of more than $2.0\times10^5$ Pa at 80° C. and thus exhibited unsatisfactory low-temperature fixability. The toner of Comparative Example 2 had a storage modulus of less than $1.0\times10^7$ Pa at 50° C. and thus exhibited unsatisfactory high-temperature anti-offset property and heat-resistant storage property. The toner of Comparative Example 3 had a loss modulus of more than $2.0\times10^5$ Pa at 80° C. and thus exhibited unsatisfactory low-temperature fixability. The toner of Comparative Example 4 had a loss modulus of more than $2.0\times10^5$ Pa at 80° C. and thus exhibited unsatisfactory low-temperature fixability. The toner of Comparative Example 5 had a storage modulus of less than $1.0\times10^7$ Pa at 50° C. and thus exhibited unsatisfactory high-temperature anti-offset property and heat-resistant storage property. The toner of Comparative Example 6 had a loss modulus of more than $2.0\times10^5$ Pa at 80° C. and thus exhibited unsatisfactory low-temperature fixability. The toner of Comparative Example 7 had a loss modulus of less than $8.0\times10^4$ Pa at 80° C. and thus exhibited unsatisfactory high-temperature anti-offset property and heat-resistant storage property. The toner of Comparative Example 8 had a loss modulus of less than $2.0\times10^2$ Pa at 160° C. and thus exhibited unsatisfactory high-temperature anti-offset property. The toner of Comparative Example 9 had a loss modulus of more than $1.0\times10^3$ Pa at 160° C. and thus exhibited unsatisfactory color reproducibility, as is also apparent from Comparative Example 20 that will be described hereinafter. The toner of Comparative Example 10 had a loss modulus of more than $2.0\times10^5$ Pa at 80° C. and a loss modulus of more than $1.0\times10^3$ Pa at 160° C. and thus exhibited unsatisfactory low-temperature fixability. The toner of Comparative Example 11 exhibited unsatisfactory heat-resistant storage property.

Examples 21 to 40 and Comparative Examples 12 to 22

Conditions for Colorimetric Evaluation of Single Color

Colorimetric evaluation of single color: A single-color solid image of any one of cyan, magenta, and yellow was developed on a POD gloss coated paper (manufactured by Oji Paper Co., Ltd.; basis weight 158 g/cm$^2$) at a toner coverage of 0.30±0.01 mg/cm$^2$ with a fixing device obtained by modifying a fixing portion in a full-color complex machine Imagio NeoC600Pro manufactured by Ricoh Co., Ltd. so that a temperature and a linear velocity can be regulated, and, after fixation, the image was then evaluated. The results are shown in Tables 4-1 to $4^{-6}$.

The color of the image area was evaluated under the following conditions for colorimetric measurement.

—Conditions for Colorimetric Measurement—

L*, a*, and b* were measured with X-Rite938 (manufactured by Xrite) under the following conditions.

Light source: D50

Measured light: 0° light reception, 45° lighting

Colorimetric measurement: 2° view

Ten sheets of gloss paper were put on top of each other, and the measurement was carried out.

—Chroma—

Chroma C* was determined by calculation according to the following equation.

$$\text{Chroma}(C^*)=[(a^*)^2+(b^*)^2]^{1/2}$$

<<Conditions for Colorimetric Evaluation of Secondary Color>>

Colorimetric evaluation of secondary color: A single-color solid image of any one of cyan, magenta, and yellow was developed on a POD gloss coated paper (manufactured by Oji Paper Co., Ltd.; basis weight 158 g/cm$^2$) at a toner coverage of 0.30±0.01 mg/cm$^2$ with a fixing device obtained by modifying a fixing portion in a full-color complex machine Imagio NeoC600Pro manufactured by Ricoh Co., Ltd so that a temperature and a linear velocity can be regulated. Thereafter, a single-color solid image of any one of cyan, magenta, and yellow was superimposed and developed at a toner coverage of 0.30±0.01 mg/cm$^2$ to fix the image, followed by evaluation. The results are shown in Tables 4-1 to 4-6.

L*, a*, and b* of the image area were measured under the following conditions for colorimetric measurement. The conditions for colorimetric measurement were the same as those for the colorimetic measurement for the single color.

For color reproducibility, L* a* b* values of Japan Color 2007, chromas calculated therefrom (see Table 3 below), and chromas in each of the Examples and Comparative Examples were compared, and the results were evaluated according to the following criteria.

TABLE 3

| | Yellow | Green | Cyan | Blue | Magenta |
|---|---|---|---|---|---|
| L* | 88 | 50 | 55 | 23 | 46 |
| a* | −6 | −71 | −39 | 18 | 75 |
| b* | 92 | 24 | −49 | −47 | −6 |
| Chroma | 92.2 | 74.9 | 62.6 | 50.3 | 75.2 |

<Yellow, green, cyan, blue, and magenta>

A: [Japan Color chroma] ≤ [Chroma]

B: [Japan Color chroma − 2.0] ≤ [Chroma] < [Japan Color chroma]

C: [Chroma] < [Japan Color chroma − 2.0]

TABLE 4-1

| | | Example 21 | Example 22 | Example 23 | Example 24 | Example 25 |
|---|---|---|---|---|---|---|
| Single-color toner | | Example 1 | Example 2 | Example 3 | Example 4 | Example 5 |
| Results of | L* | 52 | 52 | 52 | 52 | 53 |
| colorimetric | a* | −36 | −35 | −36 | −36 | −35 |
| measurement | b* | −51 | −50 | −52 | −52 | −50 |
| for single color | C* | 62.4 | 61.0 | 63.2 | 63.2 | 61.0 |
| Color reproducibility | | B | B | A | A | B |
| Color | | Cyan | Cyan | Cyan | Cyan | Cyan |
| Secondary-color toner | | Example 9 | Example 9 | Example 9 | Example 9 | Example 9 |
| Results of | L* | 19 | 19 | 19 | 19 | 20 |
| colorimetric | a* | 21 | 22 | 21 | 21 | 22 |
| measurement | b* | −47 | −46 | −47 | −48 | −45 |
| for secondary color | C* | 51.5 | 51.0 | 51.5 | 52.4 | 50.1 |
| Color reproducibility | | A | A | A | A | B |
| Color | | Blue | Blue | Blue | Blue | Blue |

TABLE 4-2

| | | Example 26 | Example 27 | Example 28 | Example 29 | Example 30 |
|---|---|---|---|---|---|---|
| Single-color toner | | Example 6 | Example 7 | Example 8 | Example 9 | Example 10 |
| Results of | L* | 52 | 53 | 53 | 46 | 90 |
| colorimetric | a* | −36 | −35 | −38 | 76 | −9 |
| measurement | b* | −52 | −50 | −50 | −5 | 93 |
| for single color | C* | 63.2 | 61.0 | 62.8 | 76.2 | 93.4 |
| Color reproducibility | | A | B | A | A | A |
| Color | | Cyan | Cyan | Cyan | Magenta | Yellow |
| Secondary-color toner | | Example 9 | Example 9 | Example 9 | Example 11 | Example 11 |
| Results of | L* | 19 | 20 | 20 | 20 | 50 |
| colorimetric | a* | 21 | 21 | 19 | 22 | −68 |
| measurement | b* | −47 | −45 | −48 | −51 | 29 |
| for secondary color | C* | 51.5 | 49.7 | 51.6 | 55.5 | 73.9 |
| Color reproducibility | | A | B | A | A | B |
| Color | | Blue | Blue | Blue | Blue | Green |

TABLE 4-3

| | | Example 31 | Example 32 | Example 33 | Example 34 | Example 35 |
|---|---|---|---|---|---|---|
| Single-color toner | | Example 11 | Example 12 | Example 13 | Example 14 | Example 15 |
| Results of | L* | 52 | 52 | 52 | 46 | 52 |
| colorimetric | a* | −35 | −37 | −39 | 77 | −36 |
| measurement | b* | −53 | −51 | −48 | −7 | −52 |
| for single color | C* | 63.5 | 63.0 | 61.8 | 77.3 | 63.2 |
| Color reproducibility | | A | A | B | A | A |
| Color | | Cyan | Cyan | Cyan | Magenta | Cyan |

TABLE 4-3-continued

| | | Example 31 | Example 32 | Example 33 | Example 34 | Example 35 |
|---|---|---|---|---|---|---|
| Secondary-color toner | | Example 14 | Example 14 | Example 14 | Example 8 | Example 9 |
| Results of colorimetric measurement for secondary color | L* | 19 | 19 | 19 | 20 | 19 |
| | a* | 23 | 21 | 20 | 20 | 21 |
| | b* | −53 | −51 | −49 | −50 | −48 |
| | C* | 57.8 | 55.2 | 52.9 | 53.9 | 52.4 |
| Color reproducibility | | A | A | A | A | A |
| Color | | Blue | Blue | Blue | Blue | Blue |

TABLE 4-4

| | | Example 36 | Example 37 | Example 38 | Example 39 | Example 40 |
|---|---|---|---|---|---|---|
| Single-color toner | | Example 16 | Example 17 | Example 18 | Example 19 | Example 20 |
| Results of colorimetric measurement for single color | L* | 52 | 52 | 52 | 52 | 52 |
| | a* | −36 | −36 | −35 | −36 | −35 |
| | b* | −51 | −52 | −50 | −51 | −50 |
| | C* | 62.4 | 63.2 | 61.0 | 62.4 | 61.0 |
| Color reproducibility | | B | A | B | B | B |
| Color | | Cyan | Cyan | Cyan | Cyan | Cyan |
| Secondary-color toner | | Example 9 | Example 9 | Example 9 | Example 9 | Example 9 |
| Results of colorimetric measurement for secondary color | L* | 19 | 19 | 19 | 19 | 19 |
| | a* | 21 | 21 | 20 | 21 | 20 |
| | b* | −46 | −47 | −44 | −45 | −44 |
| | C* | 50.6 | 51.5 | 48.3 | 51.5 | 48.3 |
| Color reproducibility | | A | A | B | A | B |
| Color | | Blue | Blue | Blue | Blue | Blue |

TABLE 4-5

| | | Comp. Ex. 12 | Comp. Ex. 13 | Comp. Ex. 14 | Comp. Ex. 15 | Comp. Ex. 16 |
|---|---|---|---|---|---|---|
| Single-color toner | | Comp. Ex. 1 | Comp. Ex. 2 | Comp. Ex. 3 | Comp. Ex. 4 | Comp. Ex. 5 |
| Results of colorimetric measurement for single color | L* | 52 | Hot offset | 52 | 52 | Hot offset |
| | a* | −35 | | −36 | −36 | |
| | b* | −51 | | −49 | −51 | |
| | C* | 61.9 | | 60.8 | 62.4 | |
| Color reproducibility | | B | | B | B | |
| Color | | Cyan | | Cyan | Cyan | |
| Secondary-color toner | | Example 9 | | Example 9 | Example 9 | |
| Results of colorimetric measurement for secondary color | L* | 19 | | 19 | 19 | |
| | a* | 21 | | 20 | 20 | |
| | b* | −44 | | −44 | −46 | |
| | C* | 48.8 | | 48.3 | 50.2 | |
| Color reproducibility | | B | | B | B | |
| Color | | Blue | | Blue | Blue | |

TABLE 4-6

| | | Comp. Ex. 17 | Comp. Ex. 18 | Comp. Ex. 19 | Comp. Ex. 20 | Comp. Ex. 21 | Comp.Ex. 22 |
|---|---|---|---|---|---|---|---|
| Single-color toner | | Comp. Ex. 6 | Comp. Ex. 7 | Comp. Ex. 8 | Comp. Ex. 9 | Comp. Ex. 10 | Comp. Ex. 12 |
| Results of colorimetric measurement for single color | L* | 52 | 53 | 52 | 52 | 52 | 52 |
| | a* | −36 | −36 | −34 | −34 | −33 | −34 |
| | b* | −51 | −52 | −50 | −49 | −49 | −49 |
| | C* | 62.4 | 63.2 | 60.5 | 59.6 | 59.1 | 59.6 |

TABLE 4-6-continued

| | | Comp. Ex. 17 | Comp. Ex. 18 | Comp. Ex. 19 | Comp. Ex. 20 | Comp. Ex. 21 | Comp.Ex. 22 |
|---|---|---|---|---|---|---|---|
| Color reproducibility | | B | A | C | C | C | C |
| Color | | Cyan | Cyan | Cyan | Cyan | Cyan | Cyan |
| Secondary-color toner | | Example 9 | Example 9 | Example 9 | Example 9 | Example 9 | Example 9 |
| Results of | L* | 19 | 19 | 19 | 19 | 19 | 19 |
| colorimetric | a* | 20 | 20 | 21 | 21 | 21 | 21 |
| measurement | b* | −46 | −48 | −45 | −44 | −43 | −43 |
| for secondary color | C* | 50.2 | 52.0 | 49.7 | 48.8 | 47.9 | 47.9 |
| Color reproducibility | | B | A | B | B | C | C |
| Color | | Blue | Blue | Blue | Blue | Blue | Blue |

In colorimetric evaluation of secondary color, single-color toners specified in Tables 4-1 to 4-6 were used as a toner for lower-layer image formation, and secondary-color toners specified in Tables 4-1 to 4-6 were used as a toner for upper-layer image formation.

The "hot offset" in Table 4-5 indicates that the fixation upper limit value is so low (170° C.) that hot offset (high-temperature offset) occurred, making it impossible to conduct the evaluation.

In the colorimetric evaluation of secondary color for Examples 21 to 40, the color of the toner in the lower layer was visible, and there was no lowering in chroma. As a result, desired secondary colors could be obtained.

On the other hand, for Comparative Examples 13 and 16, when the lower layer was formed using the toners of Comparative Examples 2 and 5, hot offset occurred, making it impossible to conduct the evaluation.

The embodiments of the present invention are, for example, as follows.

<1> A toner, including:

a binder resin; and a colorant, wherein the toner has a storage modulus of $1.0\times10^7$ Pa or more at 50° C., a loss modulus of $8.0\times10^4$ Pa to $2.0\times10^5$ Pa at 80° C., and a loss modulus of $2.0\times10^2$ Pa to $1.0\times10^3$ Pa at 160° C.

<2> The toner according to <1>, wherein, when the storage modulus is expressed as a function of temperature (° C.), the function has an inflection point in a range of 55° C. to 65° C.

<3> The toner according to <1> or <2>, wherein the toner has a glass transition temperature (Tg1st) of 20° C. to 40° C. on first temperature raising in differential scanning calorimetry (DSC), and wherein the binder resin contains:

an amorphous polyester resin A which is obtained by a reaction of a non-linear reactive precursor with a curing agent and has a glass transition temperature of −60° C. to 0° C.;

an amorphous polyester resin B having a glass transition temperature of 40° C. to 70° C.; and a crystalline polyester resin C.

<4> The toner according to any one of <1> to <3>, wherein the toner has a core-shell structure containing a core and a shell, and wherein the shell has a glass transition temperature of 50° C. to 100° C.

<5> The toner according to <4>, wherein the shell is incompatible with the amorphous polyester resin A, the shell is incompatible with the amorphous polyester resin B, and the shell is incompatible with the crystalline polyester resin C.

<6> The toner according to <4> or <5>, wherein the shell is formed of fine particles of an acrylic resin.

<7> The toner according to any one of <1> to <6>, wherein the colorant contains a yellow pigment, a magenta pigment or a cyan pigment.

<8> A color toner set, including:

two or more selected from the group consisting of:

a yellow toner which is the toner according to <7> and containing the yellow pigment;

a magenta toner which is the toner according to <7> and containing the magenta pigment; and a cyan toner which is the toner according to <7> and containing the cyan pigment.

<9> The color toner set according to <8>, wherein the magenta toner, the cyan toner, or both thereof contain a fluorescent brightening agent.

<10> A developer, including:

the toner according to any one of <1> to <7>.

The invention claimed is:

1. A toner, comprising:

a binder resin; and a colorant;

wherein:

the toner has a storage modulus of $1.0\times10^7$ Pa or more at 50° C., a loss modulus of $8.0\times10^4$ Pa to $2.0\times10^5$ Pa at 80° C., and a loss modulus of $2.0\times10^2$ Pa to $1.0\times10^3$ Pa at 160° C.; and the toner has a glass transition temperature (Tglst) of 20° C. to 38° C. at a first temperature rise in differential scanning calorimetry (DSC).

2. The toner according to claim 1, wherein the binder resin comprises:

an amorphous polyester resin A which is obtained by a reaction of a non-linear reactive precursor with a curing agent and has a glass transition temperature of 60° C. to 0° C.;

an amorphous polyester resin B having a glass transition temperature of 40° C. to 70° C.; and a crystalline polyester resin C.

3. The toner according to claim 1, wherein the toner has a core-shell structure comprising a core and a shell, and wherein the shell has a glass transition temperature of 50° C. to 100° C.

4. The toner according to claim 3,
wherein:
the core comprises:
an amorphous polyester resin A which is obtained by a reaction of a non-linear reactive precursor with a curing agent and has a glass transition temperature of −60° C. to 0° C.;
an amorphous polyester resin B having a glass transition temperature of 40° C. to 70° C.; and
a crystalline polyester resin C;
the shell is incompatible with the amorphous polyester resin A;
the shell is incompatible with the amorphous polyester resin B; and
the shell is incompatible with the crystalline polyester resin C.

5. The toner according to claim 3,
wherein the shell is formed of fine particles of an acrylic resin.

6. The toner according to claim 1,
wherein the colorant comprises a yellow pigment, a magenta pigment or a cyan pigment.

7. A color toner set, comprising:
two or more selected from the group consisting of:
a yellow toner, a magenta toner, and a cyan toner,
wherein the yellow toner comprises a binder resin and a yellow pigment, the yellow toner has a storage modulus of $1.0\times10^7$ Pa or more at 50° C., a loss modulus of $8.0\times10^4$ Pa to $2.0\times10^5$ Pa at 80° C., and a loss modulus of $2.0\times10^2$ Pa to $1.0\times10^3$ Pa at 160° C., and the yellow toner has a glass transition temperature (Tg1st) of 20° C. to 38° C. at a first temperature rise in differential scanning calorimetry (DSC);
wherein the magenta toner comprises a binder resin and a magenta pigment, the magenta toner has a storage modulus of $1.0\times10^7$ Pa or more at 50° C., a loss modulus of $8.0\times10^4$ Pa to $2.0\times10^5$ Pa at 80° C., and a loss modulus of $2.0\times10^2$ Pa to $1.0\times10^3$ Pa at 160° C., and the magenta toner has a glass transition temperature (Tg1st) of 20° C. to 38° C. at a first temperature rise in differential scanning calorimetry (DSC); and
wherein the cyan toner comprises a binder resin and a cyan pigment, the cyan toner has a storage modulus of $1.0\times10^7$ Pa or more at 50° C., a loss modulus of $8.0\times10^4$ Pa to $2.0\times10^5$ Pa at 80° C., and a loss modulus of $2.0\times10^2$ Pa to $1.0\times10^3$ Pa at 160° C., and the cyan toner has a glass transition temperature (Tg1st) of 20° C. to 38° C. at a first temperature rise in differential scanning calorimetry (DSC).

8. The color toner set according to claim 7,
wherein the magenta toner, the cyan toner, or both thereof comprise a fluorescent brightening agent.

9. A developer, comprising:
the toner according to claim 1.

10. The toner according to claim 1, wherein the toner comprises an amorphous polyester resin B which is an unmodified linear polyester resin and which has a glass transition temperature of 40° C. to 70° C.

11. A toner, comprising:
a binder resin;
a colorant; and
a fluorescent brightening agent;
wherein:
the toner has a storage modulus of $1.0\times10^7$ Pa or more at 50° C., a loss modulus of $8.0\times10^4$ Pa to $2.0\times10^5$ Pa at 80° C., and a loss modulus of $2.0\times10^2$ Pa to $1.0\times10^3$ Pa at 160° C.; and
the toner has a glass transition temperature (Tg1st) of 20° C. to 38° C. at a first temperature rise in differential scanning calorimetry (DSC).

* * * * *